US011125183B1

(12) United States Patent
Warren

(10) Patent No.: US 11,125,183 B1
(45) Date of Patent: Sep. 21, 2021

(54) EFFECTIVE LOW TEMPERATURE DIFFERENTIAL POWERED ENGINES, SYSTEMS, AND METHODS

(71) Applicant: Navita Energy, Inc., Melville (CA)

(72) Inventor: John Warren, Melville (CA)

(73) Assignee: Navita Energy, Inc., Melville (CA)

( * ) Notice: Subject to any disclaimer, the term of this patent is extended or adjusted under 35 U.S.C. 154(b) by 0 days.

(21) Appl. No.: 16/985,192

(22) Filed: Aug. 4, 2020

(51) Int. Cl.

| | |
|---|---|
| ***F02G 1/053*** | (2006.01) |
| ***F02G 1/043*** | (2006.01) |
| ***F02G 1/04*** | (2006.01) |
| ***F02G 1/047*** | (2006.01) |
| ***F02G 1/06*** | (2006.01) |

(52) U.S. Cl.
CPC ..... *F02G 1/053* (2013.01); *F02G 1/04* (2013.01); *F02G 1/043* (2013.01); *F02G 1/047* (2013.01); *F02G 1/0435* (2013.01); *F02G 1/06* (2013.01)

(58) Field of Classification Search
CPC . F02G 1/053; F02G 1/06; F02G 1/043; F02G 1/047; F02G 1/04; F02G 1/0435
USPC ..... 60/517, 520, 521, 524, 525, 530, 531
See application file for complete search history.

(56) References Cited

U.S. PATENT DOCUMENTS 3,608,311 A * 9/1971 Roesel ..... F02G 1/0435 60/516
4,170,878 A 10/1979 Jahnig
4,387,576 A * 6/1983 Bissell ..... F01K 21/04 60/649
4,393,653 A * 7/1983 Fischer ..... F28D 7/024 60/511
5,638,684 A * 6/1997 Siegel ..... F02G 1/043 62/6

(Continued)

FOREIGN PATENT DOCUMENTS

| | | |
|---|---|---|
| WO | 2009081171 | 7/2009 |
| WO | 2015165581 | 11/2015 |

OTHER PUBLICATIONS

Written Opinion based on PCT/CA2020/051084, International Filing Date of Aug. 7, 2020, Written Opinion dated Apr. 6, 2021.

(Continued)

*Primary Examiner* — Mark A Laurenzi
*Assistant Examiner* — Mickey H France
(74) *Attorney, Agent, or Firm* — Transformative Legal, LLC; Len S. Smith; Denise M. Brown

(57) ABSTRACT

The invention described herein provides new devices suitable for effectively converting relatively low temperature differences into useful work (e.g., for generating electrical power), related systems, and methods of using and developing such devices/systems. The devices are characterized in, inter alia, comprising an at least partially enclosed moveable component (e.g., a piston), a closed pressurized gas system comprising sizeable void spaces, and a closed temperature modifying liquid system having portions that obtain temperature characteristics from two sources, which are alternatingly dispensed as droplets into the pressurized gas, creating a pressure/temperature difference in the gas which causes the moveable component to move back and forth along a stroke distance that does not include the void spaces, the pressure of the gas and liquid being at substantially balanced when the device is ready for operation.

39 Claims, 14 Drawing Sheets

(56) References Cited

U.S. PATENT DOCUMENTS

| | | | | |
|---|---|---|---|---|
| 6,564,551 | B1 * | 5/2003 | Stock | F01K 27/005 60/516 |
| 8,061,132 | B2 | 11/2011 | Fong et al. | |
| 8,387,379 | B2 * | 3/2013 | Liu | F01K 27/00 60/511 |
| 9,435,291 | B2 | 9/2016 | Klassen | |
| 10,947,926 | B1 * | 3/2021 | Wang | F02G 1/043 |
| 2011/0005219 | A1 * | 1/2011 | Liu | F01K 27/00 60/516 |
| 2011/0048007 | A1 * | 3/2011 | Murphy | F03G 7/00 60/641.6 |
| 2016/0201599 | A1 | 7/2016 | Richter | |
| 2018/0209308 | A1 * | 7/2018 | Heinen | F01K 27/005 |
| 2021/0054766 | A1 * | 2/2021 | Wang | F03G 7/05 |
| 2021/0054806 | A1 * | 2/2021 | Wang | F02G 1/043 |

OTHER PUBLICATIONS

International Search Report based on PCT/CA2020/051084, International Filing Date Aug. 7, 2020, International Search Report dated Apr. 6, 2021.

* cited by examiner

EFFECTIVE LOW TEMPERATURE DIFFERENTIAL POWERED ENGINES, SYSTEMS, AND METHODS

FIELD OF THE INVENTION

The invention described here relates to heat engines capable of converting relatively small temperature differentials into useful work, systems comprising such devices, and further related methods and systems.

BACKGROUND OF THE INVENTION

The need to develop systems to transform energy into work has driven the invention of systems for creating energy since at least the dawn of the Industrial Revolution. Even prior to the early $19^{th}$ century when the laws of thermodynamics were formally established, steam power, for example, was used to generate work. The earliest steam engines were scientific novelties, such as the aeolipile of the first century. It was not until the $17^{th}$ century that attempts were made to harness steam for practical work purposes. In 1698 Thomas Savery patented a pump with hand-operated valves to raise water from mines by suction produced by condensing steam. In about 1712 another Englishman, Thomas Newcomen, developed a more efficient steam engine with a piston separating the condensing steam from the water. In 1765 James Watt greatly improved the Newcomen engine by adding a separate condenser to avoid heating and cooling the cylinder with each stroke. Watt then developed a new engine that rotated a shaft instead of providing the simple up-and-down motion of the pump, and he added many other improvements to produce a practical power plant. For related work, Watt was granted British Patent 913 in 1769, and Watt became one of the most remembered inventors of the early Industrial Revolution. Further technology utilizing gas under pressure in the form of steam was introduced throughout the late 1700s and into the $19^{th}$ century, at which time steam locomotion became a commercial success, transforming transportation from that point forward. Steam engines were largely replaced by internal-combustion engines in the early $20^{th}$ century. However, both steam and internal combustion systems that are capable of meaningful work, such as in transportation, often also require significant inputs of fuel, typically in the form of fossil fuels, which are often limited resources and always lead to pollution and disruption of environmental systems, as well as significant costs in terms of extraction, delivery, and the like.

Around the time the steam engine first gained commercial success, another type of "hot air engine" was conceived, which ultimately led to the development of the Stirling Engine (first patented in 1816). Stirling Engines also use temperature and pressure to generate work, however via a mechanism comprising two pistons and a cyclic compression and expansion of a gas, often called a working fluid. As opposed to steam engines, Stirling Engines maintain the working fluid in a gaseous state within a closed circuit but can perform work with very little input of external energy. A limitation that restricted advancement of the Stirling engine for some time was that the low working pressure meant that it could only be directed to low-power applications which limited commercial application. In the late 1820s, the principle of using air at an increased density, that is, a gas at a higher pressure, was introduced by Parkinson and Crosley, which increased the amount of power that such an engine could produce. This advancement led to modifications by Stirling to his earlier engine designs, and ultimately to the development of an engine capable of producing over 30 kW of power.

However, further advancements in Stirling Engine technology were restricted by material limitations, among other issues, as Stirling engines require very high temperatures to maximize power and efficiency and such higher temperatures were limited to temperatures which the materials available during that time period could tolerate. For this and other reasons, Stirling Engine technology ceased to be an area of much development and were only revived to a significant extent in the late $20^{th}$ century due to much experimental work by the Philips technology development teams, which led to the filing of many patents on improved Stirling Engine technology. Despite such efforts by one of the world's leading companies to improve on this technology, Stirling Engine technology remains primarily only used for specialized applications, as a secondary or alternative power source, or for applications outside of performing meaningful work (e.g., as novelty devices).

Functional characteristics of Sterling Engine systems still limit the feasibility of using such devices for significant work; including, most notably, the need for a displacer to transfer heat in the system. A further limitation to the Stirling engine is the limited speed and efficiency at which movement of the piston movement is obtained. To heat the working fluid (e.g., gas) on one side of the displacer in a Stirling engine, heat must be transferred through a cylinder wall, a process which takes considerable time. The incorporation of heat exchanges has been proposed to address at least some of these limitations; however, such adaptations increase the cost, complicate the design, and fail to create an engine having a size which can be feasibly and realistically incorporated into most industrial work settings, such as generating power for a home, building, community, or larger area.

Given the issues associated with fossil fuels, interest in alternative energy sources having a lower environmental impact has led to the development of numerous efforts to develop efficient, sustainable, non-carbon-based work-producing systems, such as power generators. An increasing amount of energy today is generated through solar, hydrothermal, geothermal, and wind-powered systems. However, each of these systems have limitations that have prevented such alternative systems from completely replacing fossil fuels, and many of these systems still require significant energy inputs.

In recent years there also have been several reported attempts to conceive and, in some cases, actually develop, systems that can generate work from temperature differences for applications such as power generation. For example, U.S. Pat. No. 4,170,878 by Jahnig (the "Jahnig '878 patent") describes a proposed system for deriving power from a low-level heat source by contacting a confined gas with warm and cool liquid in alternating sequence in the form of misting. The energy conversion system derives power from thermal gradients present in the ocean (primarily exemplified as Ocean Thermal Energy Conversion (OTEC) plant designs) or from solar, geothermal, or other sources of low-level heat. In the described systems, increased pressure results from warming the gas, such gas expansion resulting in the movement of a piston. Cooling of the gas results in a decrease in the amount of work required for recompression. Warming and cooling liquids are provided from sources which remain warmer and colder relative to one another, and system pressurization is established by pressures of the environment within which the system is operated (e.g., oceanic pressure is utilized to maintain the gas). The amount of work required for decompression is less than the amount of work generated by expansion at the higher temperature, thus resulting in a net amount of work produced. However while the amount of work taken out during expansion exceeds that required for compression, it is not completely balanced with respect to timing as the system is quite simple, hence a flywheel is utilized to store power and to supply it as needed.

WO2009081171 to Gary describes a proposed power conversion device for converting temperature differentials between two fluids into an energy source utilizing a movable piston wherein the piston resides within a cylinder having a different dimension than the pressure vessel to amplify the extent of travel of the master piston which is caused by the expansion of the fluid in the pressure vessel. In this way, the described system has a design like a Stirling engine. While this system describes the use of a temperature differential to generate work and misting of a working fluid to affect temperature change, only a single temperature misting application is applied to move the piston in a single direction, and a separate system for returning the piston to a starting position in the cycle is reportedly required to operate the system. Hence, like the Stirling Engine no temperature differential between two input sources is required to operate the Gary system. The system of this disclosure is not a closed system; once the piston is moved in a first direction due to the expansion of the heated working fluid, the pressurized chamber housing the heated gas is opened, allowing for the heated working fluid to naturally rise due to convection and exit the chamber to the cooler outside environment, while simultaneously the heated air is replaced through a second opening whereby the cooler outside gas, e.g., air, is drawn into the chamber. As this exchange occurs, a series of further valve activity and a secondary piston cooperate to return the master piston to a starting position, at which time the openings to the now cooled, previously pressurized, chamber are closed and the chamber re-pressurized to facilitate start of a new cycle. A complex series of switches, sensors, and valves operated and/or monitored by computer control facilitate operation of this device.

WO2015165581 to Richter describes a proposed method of electrical energy production utilizing heat sources, such as waste heat, in a heat engine utilizing a piston, wherein the movement of the piston generates an electrical current through the use of, e.g., piezoelectric blocks. To move the piston, a heat transfer medium, e.g., air or water, is sprayed into a working gas, e.g., air, held within a cylinder chamber on one side of the piston. Upon application of the heat transfer fluid, the gas in the working chamber is heated, expands, and moves the piston (like conventional steam engine technology). To facilitate return of the piston, the heat transfer medium is sprayed into a separate cylinder chamber on the opposite side of the piston, causing the working fluid on that side of the piston to expand and move the piston back to its first position. The system described therein hence utilizes a single medium having a warm/hot temperature to affect an expansion of a working gas on alternating sides of a movable piston. A single temperature heat source is required for operation of the system. As misting of a single relative temperature is used (temperature being consistently warmer than the temperature of the working fluid into which it is sprayed), there is no reliance on a temperature differential between two input sources to operate the system. The system also comprises a complicated set of components to operate the heat engine including use of a labyrinth seal on the piston's outer edges interfacing with the interior of the chamber and rollers to reduce piston friction.

US20160201599 also to RICHTER describes a proposed method of operating a heat engine for generating electricity or mechanical power, wherein mist is used to transfer heat to a gas (preferably air) under pressure on one side of a piston, upon which the gas expands and moves the piston. The piston is designed with the same labyrinth air seal around the piston and optional rollers as described in the above-described Richter '581 publication. Once the piston is moved in a first direction due to the expansion of the working fluid on one side of the piston, the piston is reversed by the cooling of the working fluid through power generation as well as by the cylinder walls which can be cooled by a coolant circulating through cooling channels formed therein, and the application of the same temperature mist to the opposite side of the same piston. A system for cooling based on a Stirling Refrigeration Machine/Cooler (an application of Stirling Engine technology to remove heat) is also proposed as a mechanism for cooling the working fluid, utilizing a recouperator within the end of the piston for intermediate energy storage and flow to the opposite side. The system is an open system in that the mist utilized to cool the pressurized gas (e.g., air) is collected and dispensed, along with any dissolved gas held within it. Because of the dissolution of gas within the misting liquid causing pressure loss, the system is designed to provide for replenishing of the pressurized gas to maintain system pressure.

To date, none of these proposed or described systems have been developed into a commercially available system for energy or work production. The status of heat engine technology may be attributable to the fact that none of these systems appears to provide a workable solution for sustainably and reliably taking low temperature differentials, such as those that exist in environmental systems, and converting such differentials into a workable power generation or work generation system. Clearly the existence of these and numerous similar impractical efforts evidence that the development of a practical low temperature differential energy-producing system capable of meeting both the power-intensive and environmentally conscious demands of the 21$^{st}$ Century will require practical inventive steps over the current state of the art, much like the inventive improvements Watt made to steam engine technology which allowed that technology to play a key role in powering much of the Industrial Revolution.

Construction, Definition & Abbreviations

Any heading(s) here (e.g., "Principles of Construction & Associated Abbreviations") are used for convenience and do not limit the scope of the invention. Except where clearly otherwise indicated, aspects of the invention described in part or entirely under a heading can apply to other aspects described in other sections of this disclosure.

Unless expressly otherwise indicated, description of terms known in the art is for exemplifying versions or embodiments only; and is not intended to limit the scope of any aspect of the invention. Unless defined otherwise, all technical and scientific terms used herein have the same meanings as commonly understood by one of ordinary skill in the art and implicitly comprise the broadest interpretation based on such usage as well as any narrower interpretation(s) based on specific descriptions provided here. In general, any methods and materials similar or equivalent to those described herein can be used in the practice or testing of embodiments of the invention, the methods, devices, and materials described herein.

The inclusion of "(s)" after an element indicates that 1 of such an element is present, performed, and the like. E.g., "a composition comprising component(s)" means a composition including one component and a composition comprising two or more components, each part of the statement being separate aspects of the invention.

For conciseness symbols are used wherever clear. E.g., "&" is used for "and" and "~" is used for "about." The symbols > and < are given their ordinary meaning (e.g., >1 means "greater than 1", <2 means "less than 2," e.g., >2 ABCs means "more than two ABCs"). The symbol "≤" means "less than or equal to" and "≥" means "greater or equal to." The "/" symbol indicates "or" (A/B means A or B) or an element with 2 names.

The abbreviation "WRT" means "with respect to."

"AW" means "associated with."

"ACB" in connection with steps/elements means "are characterized by" (e.g., methods ACB steps) and "CB" is used to abbreviate the phrase "characterized by." ACA means "are characterized/characterizable as" and ICA means "is characterized/characterizable as."

Ranges of values are used to concisely refer to each value falling within the range within an order of magnitude of the range's endpoints. For example, a recited range of 1-2 should be interpreted as implicitly disclosing each of 1.0, 1.1, 1.2, 1.3, 1.4, 1.5, 1.6, 1.7, 1.8, 1.9, and 2.0 and a recited range of 10-20 is to be interpreted as implicitly providing support for each of 10, 11, 12, 13, . . . 19, and 20). All recited ranges include the end points of the provided range, regardless of how the range is described, unless the exclusion of such endpoints is clearly indicated, regardless of the terminology used to describe the range. For example, a range between 1 and 5 will include 1 and 5 in addition to 2, 3, and 4 (and all numbers between such number within an order of magnitude of such endpoints and within such endpoints, in this example 1.1 and 4.9).

Terms of approximation, such as "about" or "approximately" (or ~) are sometimes used to conveniently refer to a range of closely related values or where a precise value is difficult to measure or a precise measurement is difficult to define. Unless otherwise stated, all exact values provided herein are representative of corresponding approximate values and vice versa (e.g., all exact exemplary values provided with respect to a particular factor or measurement can be considered to also provide a corresponding approximate measurement, modified by "about," where appropriate—e.g., disclosure of "about 10" is to be understood as also providing support for 10 exactly). Ranges described with one or more approximate numbers should be interpreted as indicating that all endpoints and other relevant values encompassed by the range may be similarly described, regardless of any different presentations included in this disclosure (e.g., "about 10-20" should be interpreted in the same manner as "about 10-about 20"). The scope of value modified by a term of approximation will depend on the context of the disclosure or understanding of those skilled in the art. In the absence of such guidance, terms such as "about" should be understood as meaning +/−10% of the indicated value(s).

Lists of elements are employed for conciseness. Unless indicated, each member of each list of aspects/features is an independent aspect of the invention. Each such aspect can have and often will comprise nonobvious properties with respect to the other listed elements.

The terms "a" and "an" and "the" and similar referents are to be construed to cover both the singular and the plural, unless otherwise indicated herein or clearly contradicted by context. Terms in the singular implicitly convey the plural and vice versa herein, unless clearly contradicted by context or plausibility (e.g., a passage referring to use of a "composition" implicitly discloses corresponding use of corresponding "compositions," and vice versa).

Terms such as "here" & "herein" means "in this disclosure" unless otherwise indicated. The abbreviation "TD" similarly means "this disclosure." The term "i.a." (sometimes "ia") means "inter alia" or "among other things." "Also known as" is abbreviated "aka." The abbreviation "ORT" means "otherwise referred to" and ORTA is "otherwise referred to as."

The modifier "OTI" means "of the invention." "AOTI" means "aspect(s) of the invention." "ATAOTI" means "adaptable to" AOTI(s). "PMCs" means "principles, methods, or compositions." "ITA" means "in the art." "KITA" means "known in the art." "POOSITA" means "person of ordinary skill in the art."

"DEH" means "discussed elsewhere here." "DFEH" "means "discussed further elsewhere herein." "CEH" means "cited elsewhere herein." "EH" means "elsewhere herein." "SFE" means "see, for example."

In the absence of other definition or understanding ITA, the term "some" WRT elements of a method or composition means "two or more" & WRT a part of a whole means "at least 5%" (i.e., ≥5%).

The abbreviation OSMGAOA means "one, some, most, generally all (i.e., at least 75%), or all," each of which is an independent aspect.

Fragments of abbreviations provided here are given the meaning of the presented parts of the abbreviation. E.g., "OSMOA" means "one, some, most or all" and "GAOA" means "generally all (GA) or all." MGAOSA means "most, generally all or substantially all" and MGASAOA means, "most, generally all, substantially all, or all", each of which is an independent aspect. SMGAOSA means "some, most, generally all, or substantially all", and SMGAOA means "some, most, generally all, or all", each of which is an independent aspect. Abbreviations in this disclosure are often combined, e.g., "WRT OSMOA of X" means "with respect to one, some, or all of X." SOM means "some or most." Similarly, e.g., GAOA means "generally all or all" and OOS means "one or some." Similarly, GAOSA means "generally all or substantially all."

The modifier "DOS" means detectable or significant/detectably or significantly. "Significant" means results that are statistically significant using an appropriate test in the given context (e.g., $p \leq 0.05/0.01$).

Use of the term "or" herein is not meant to imply that alternatives are mutually exclusive unless clearly stated or clearly contradicted by context. Thus, in this disclosure, the use of "or" means "and/or" unless expressly stated or understood by one skilled in the art. The occasional explicit use of "and/or" herein has no effect on this interpretation of "or." The scope of "or" meaning "and/or" in a phrase such as "A, B, and/or C" implicitly supports each of the following embodiments: A, B, and C; A, B, or C; A or C; A or B; B or C; A and C; A and B; B and C; A (alone); B (alone); and C (alone). The term "also" means "also or alternatively" (abbreviated "AOA") unless expressly stated.

Terms such as "combination," "and combinations," or "or any combinations" WRT listed elements means combinations of any or all thereof. "CT" means any and all possible "combination(s) thereof."

Terms such as "including," "containing," and "having" should be interpreted openly herein, e.g., as meaning "including, but not limited to," "including, without limitation," or "comprising," unless the description clearly states otherwise. Comprising means including any detectable amount of an element or including any detectable performance of a step. Description of an aspect "comprising" or "including" a step, or an element should be interpreted as AOA including that element/step (with any other steps/elements or alone).

Unless clearly contradicted, a description of any AOTI using terms such as "comprising" or "including" with reference to a step/element simultaneously implicitly discloses corresponding AOTIs that (1) consists of ("CO") of the step/element (or "only is"), (2) consist(s) essentially of the step/element, (3) substantially consists of ("SCO") the step/element (or "substantially is" or "substantially only" is/are the step/element), (4) generally consists of ("GCO") the step/element (or is "generally adapted" to, is "generally composed" of, "generally is," "generally only" is/are, "generally are," the element, and the like), (5) predominately comprises ("PC") ("mostly" or "primarily" comprises) the step/element, (6) materially comprises the step/element, and (7) appreciably comprises ("AC") the step/element. The phrases "consists of" (abbreviated "CO") & "consists essentially of" ("CEO") are given their ordinary meaning here. Specifically, "consists of" (e.g., elements that "consist of" a step/element) means limited to the step or element, within bounds of detection and practically construed ITA, and "consists essentially of" and the descriptor "essentially" mean(s) do/does not materially affect the basic and novel characteristics of the referenced step, element, method, or composition. The "basic and novel characteristics" will be clear to those of skill in the art from the description of the step, element, method, or composition provided, but in no event will be narrower than the scope of a corresponding description replaced with "substantially consists of" (defined below).

"Substantially consists of" ("SCO") means ≥95% of the referenced class is made up of the referenced element and "substantially associated" means that at least 95% of a referenced item are associated with a second referenced item. "Substantially all" means at least 95% of the referenced items/steps meet(s) the indicated condition.

"Substantially impervious to" means ≥95% of a substance (PG or TML) is held within a referenced barrier, container, or material and maintained therein without loss over a referenced period or over at least 100 operating cycles (e.g., ≥1000 operating cycles). In aspects, a substantially impervious container/barrier/component loses less than 2%, less than 1%, less than 0.5%, or less than 0.1% of a contained material over a period of regular operation of at least 3, 6, 9, 12, 18, 24, 30, 36, 48, or 60 months.

Phrases such as "generally consists of" (abbreviated "GCO"), "generally is," "generally are," "generally all," "generally," or "generally is composed of" means the referenced element makes up ≥75%+ of the related whole. Similarly, the phrase "generally associated" means ≥75% of an element is associated with a 2nd referenced item (e.g., ≥75% of 1 agent is associated with a 2nd agent). The phrases "generally most" and "generally all" mean ≥75% of the referenced items/steps meet the indicated condition.

"Predominately comprises" (abbreviated "PC") means that detectably greater than 50% of a composition is composed of the referenced element/component and "predominately associated" is construed similarly.

"Materially comprises" ("MTC") means ≥5% of a composition/component is made up of the subject element/component. The phrase "materially associated" is similarly construed. The phrase "in material part" means ≥5% of referenced items/steps.

The phrase "appreciably comprises" (abbreviated "AC") means at least 1% of a composition is composed of the referenced element/component. The phrase "appreciably associated" means that ≥1% of an element is associated with another referenced element.

Changes to tense or presentation of terms (e.g., using "comprises predominately" in place of "predominately comprises") do not modify the meaning of the related phrase unless indicated.

The phrase "operatively associated with" means an element such as a component of a device that operates in association with another element (an associated element), or AOA, is an element which causes the operation of (is relied upon by) a second associated or promotes or enhances the operation of such a second element.

Abbreviations for these terms are used here and combined for sake of conciseness. For example, the phrase "a composition MTCPCGCOSCO or CO element X" is used to describe compositions that (1) materially comprise element X, (2) primarily comprise element X, (3) generally consist of element X, (4) substantially consist of element X, or (5) consist of element X. Similarly, a passage that refers to "compositions that PCGCO or SCO element Y" provides support for compositions that primarily comprise, generally consist of, or substantially consist of element Y.

Although some elements may be described in terms of a "means for" performing a function or a "step for" performing a method, no element of this disclosure should be interpreted as indicating a "means-plus-function" construction unless such intent is clearly indicated by use of the terms "means for" or "step for." Terms such as "configured to" or "adapted to" are not intended to suggest a "means-plus-function" interpretation, but, rather, indicate an element is configured to, designed to, selected to, or adapted to achieve a certain performance, characteristic, property, or the like using the principles described herein and/or that are generally known in the art.

Unless otherwise indicated, compositions specifying a percentage are by weight unless a different value would be understood ITA. If a variable is not accompanied by a value, any previously provided value typically still applies unless contradicted by context or information KITA.

All described methods can be performed in any suitable order unless otherwise indicated or contradicted by context/plausibility. Unless contradicted, elements of a composition can be assembled in any suitable manner by any suitable method. Unless contradicted, any combination of elements, steps, components, and/or features of aspects of the invention and all possible variations thereof, are within the scope of the invention.

Numerous examples of aspects are provided in this disclosure to illuminate AOTI. The breadth and scope of the invention should not be limited by any of the exemplary embodiments. No language in the specification should be construed as indicating any element is essential to the practice of the invention unless such a requirement is explicitly stated.

All references, including publications, patent applications, and patents, cited herein, are hereby incorporated by reference to the same extent as if each reference were individually and specifically indicated to be incorporated by reference and were set forth in its entirety herein. The disclosure of such documents relating to compositions and methods can be combined with the teachings provided herein to provide additional useful compositions and applications. However, the citation and incorporation of patent documents herein is limited to the technical disclosure of such patent documents and does not reflect any view of the validity, patentability, and/or enforceability of any claims thereof. Moreover, in the event of any conflict between this disclosure and the teachings of such documents, the content of this disclosure will control with respect to properly understanding the various aspects of the invention. Numerous references have been included in this disclosure to incorporate information available from other sources that illustrate the scope of the invention or aid in putting aspects of it into practice. While efforts have been made to include the most relevant references for such purposes, readers will understand that not every aspect of every cited reference will be applicable to the practice of the invention.

Terms Specific to the Invention

The term "operation" (or "device operation"/"regular operation") WRT to device(s) OTI means a condition in which the difference in T1 to T2 is sufficiently great to cause the moveable component to move at least 33% of its stroke length (in any direction) without input of extraneous energy.

A "stroke" is the movement of a MC from one end of an SL to another. A "stroke period" is the period required to complete a stroke. The "dispensation gap" is the time between the end of dispensation of one TML (e.g., T1L) and the start of dispensation of a $2^{nd}$ liquid (e.g., T2L).

An "operation cycle" (or "operating cycle") is any period comprising device initiation, device operation, inactivity, and re-initiation. Any "operating cycle period" or "OCP" is any period comprising ≥1, typically ≥2 (e.g., ≥3, ≥10, ≥14, ≥50, ≥60, ≥100, ≥150, ≥200, ≥300, ≥500, ≥1000, ≥5000, or ≥10000) operation cycles (e.g., a period of ~1 week, ~1 month, ~3 months, ~1 year, or longer). In aspects, devices OTI operate substantially identically over such a number of operating cycles/periods.

Phrases such as "useful work" herein mean performing work that is equivalent to at least about 1000 watts. In aspects, "useful work" means performing work equivalent to at least ~1500 watts, ~2000 watts, ~2500 watts, ~3000 watts, ~4000 watts, or ~5000 watts. Terms such as "useful work," "significant work," and "meaningful work" herein simultaneously disclose each such level of work as independent AOTI. Alternative corresponding measurements in Joules, Horsepower, and the like also can suitably be used to describe "useful work."

Terms such as "mechanically linked (to)", "mechanically tied (to)", "mechanically connected (to)", or "mechanically driven (by)" refer to the activity of one component physically affecting or effectuating the operation of another component by a physical mechanical relationship (e.g., component A causing component B to move), typically automatically upon the occurrence of an event or condition. Such terms do not include coordinated movement of separate parts by operation of a processor.

Terms such as "substantially closed" and "substantially impervious" means that no more than about 5%, e.g., no more than ~4.5%, ~4%, ~3.5%, ~3%, ~2.5%, ~2%, ~1.5%, or more than about 1% of the volume of PG, TML, or both are lost or increased during operation for extended OCP(s) (e.g., ≥1, ≥~3, ≥~6, ≥~12, ≥~24, or ≥~60 months).

The term "stored power" or "extraneous power" refers to power generated by the device which is not converted by the device for use outside of the devices or systems described herein (e.g., device which is not considered power output by the devices or systems described herein) but rather is used in operation of the device, e.g., in operation of pump(s).

The following table lists abbreviations that are frequently used in this disclosure and provides a description of the meanings/scope thereof:

TABLE 1

Abbreviations

| Abbreviation | Term | Brief Description |
|---|---|---|
| BC | Interior of the barrier | Interior of the barrier forming the chamber(s) comprising IVS(s) and a stroke length (SL). |
| CS | Contact surface | A surface of the MC that comes in contact with TML-induced temperature-modulated gas. |
| DC | Dispensing component | A device or system that dispenses TML into the chamber. |
| DCU | Data collection unit | A component of an electronic control unit (ECU) aiding in the automated control of a device for storing and executing instructions for receiving data from one or more sensors. |
| DDFP | Device design fabrication processor | and A processor used for designing a device according to user inputs and design constraints and optionally causing the fabrication of one or more device components. |
| DLCS | Device liquid conducting system | A portion of a device that conducts TML and contacts T1L & T2L and which may contact T1S or T2S or be adapted to engage a SLCS that contacts T2S or T2S. |
| ECU | Electronic control unit | A component of an operation control component (OCC) participating in the automated control of a device; commonly comprising a data collection unit (DCU), a means for relaying data, and one or more processing units (PUs). |
| ELCS/SLCS | Extended liquid | A system that conducts TML wherein a |

TABLE 1-continued

| Abbreviations | | |
|---|---|---|
| Abbreviation | Term | Brief Description |
| | conducting system; system liquid conducting system | 1st portion is in contact with T1S, and a $2^{nd}$ portion is in contact with T2S, and comprises connection element(s) capable of connecting the device to the ELCS to maintain a closed TMS; the system may also be referred to as a system liquid conducting system (SLCS). |
| EPCCU | Electronic programmable complex control unit | A unit responsible for receiving information signal(s) for one or more DCUs and storing data. |
| FSDD | Fluid switch (or T1L/T2L switch) driving device | Device which drives or causes operation of the fluid switch (ORT as a T1L/T2L switch); typically driven by movement of the MC. Except for PG, fluids herein typically are primarily, generally only, substantially only, or only present as liquids. |
| IVS | Internal void space | Portions of a chamber of a low temperature differential energy converting device that are entirely free of structures at all time during operation. |
| LCC | Liquid capture component | Component of device (e.g., feature of housing) where post-dispensation, accumulated TML collects for draining from the housing. |
| LCS | Liquid conducting system | A system for conducting TML flow through a device (DLCS) or system (SLCS). Can be an extended component of a system (ELCS). An LCS can conduct TML comprising a 1st portion (T1L) in contact with a 1st temperature input (T1S) & a $2^{nd}$ portion (T2L) in contact with a second temperature input (T2S). |
| MC | Moveable component | A component of a device that moves a stroke length (SL) in response to temperature differences in the gas caused by dispensing T1L and T2L into the chamber. |
| MLMC(s) | Mechanically linked movable component(s) | Components of a device which are movable only by way of mechanical linkage to the MC. |
| MRE | Motion receiving element | An element capable of receiving energy of motion from a moving device or system part (e.g. from an MC) |
| OCC | Operation control component | A component of an automated system providing automated control of a device; commonly comprising an electronic control unit (ECU). |
| PG | Pressurized gas | The pressurized gas that fills a chamber of the device in operation. |
| PM | Protruding member | An element of the movable component (MC) which, if present, can protrude through a SLIPBO and exposed to the exterior of the housing. ORT sometimes as a "pin". Can connect to MLMC(s). |
| RFO or RFOS | Ready for operation (or Ready for operation state) | A state of a device or system wherein the device or system is operable/ready to be operated but is not in operation. |
| SL | Stroke length | The maximum distance traveled by an MC in operation of a device. The SL is also often used synonymously here with the entire "track" or distance that the MC travels when the device is in operation. A stroke length can refer to the maximum distance traveled by an MC in operation of a device in any direction. |
| SLIP | Stroke length interior portion (interior portion of an SL) | An inner portion of an SL which lacks detectable or significant pressurized gas (PG); in aspects a SLIP comprises opening(s) in the barrier surrounding the SLIP (e.g., one or more SLIPBOs). |
| SLIPBO(s) | SLIP barrier opening(s) | An opening in the barrier surrounding the SLIP, through which, e.g., a PM may extend from the MC through the barrier to the exterior of the housing without allowing DOS pressurized gas (PG) to |

TABLE 1-continued

| Abbreviations | | |
|---|---|---|
| Abbreviation | Term | Brief Description |
| | | escape. ORT as a "slit"/"slot"/"ropening". |
| SOOASF | Selectively operable or automatic/automated safety feature | A safety feature of a device/system, e.g., an autonnatable shut off valve or switch linked to sensor(s) which automatically modifies system function (e.g., shut down the device/system) if an event occurs triggering preprogrammed instructions. |
| SOP | Selectively operable pump | A pump which may be controlled by manual or mechanical means or also or alternatively automatically controlled, e.g., by an operating system. |
| SS | Source switch | A component of a device that changes the input to part of the dispensing component from T1S to T2S and a 2nd part of the dispensing component from T2S to T1S. Sometimes ORTA an "orientation switch" ("OS"). |
| T1; T1L; T1G; and T2S | Temperature 1; T1 liquid; T1 gas; and T1 source | 1 of the 2 different temperatures that power the device; a portion of the TML having a temperature modified by contact with T1S; PG modified by contact with T1L; and a source of a T1 temperature. |
| T2, T2L, T2G, and T2S | Temperature 2 and temperature 2 liquid | The 2nd of the 2 temperatures that power the device; a portion of the TML having a temperature modified by contact with T2S; PG modified by contact with T2L; and a source of a T2 temperature. |
| T1ΔT2 | Difference in temperature between T1 and T2 | The temperature differential that exists between a first temperature (T1) and a second temperature (T2). |
| TML | Temperature modulating liquid | A liquid that is in contact with T1S and T2S and that is dispensed into a chamber of a device to modulate gas temperatures. May also be referred to as a heat transfer medium. |
| TMS | Temperature modulating system | A system comprising TML in indirect contact with a T1S and T2S and dispenser(s) and, ia, components for transporting and dispensing TML. |
| VAC | Visual aid component | A window or equivalent component providing visual access to an interior space from the exterior of a device/system. |

SUMMARY OF THE INVENTION

The invention provides inventive devices that effectively convert temperature differences, even relatively low temperature differences, to useful work. The devices OTI operate as closed system devices, comprising a suitable gas under relatively high pressure, in operation having its temperature alternatingly changed through contact with different portions of a suitable temperature/heat modulating liquid having different temperature characteristics. Structurally, the devices OTRI comprise (a) a housing comprising (i) a barrier component (e.g., a collection of 3, 4, or more walls) that is at least substantially impervious to unintentional fluid, e.g., liquid, loss and that forms (ii) a selectively sealable chamber comprising two internal void spaces, each internal void space ("IVS") comprises only PG or PG & TML in operation and comprise a dimension (e.g., a length) that is at least about 5%, is ≥7.5%, or is ≥10% of a dimension of the chamber (e.g., the length of the chamber); (b) a movable component ("MC") (e.g., a piston) positioned in the chamber, the MC further comprising contact surface(s) ("CS(s)"); and (c) a temperature modulating system ("TMS") comprising (i) a liquid conducting system ("LCS"), (ii) a temperature modulating liquid ("TML") in a liquid container that in operation comprises a first portion at a first temperature (T1) and a second portion at a second temperature (T2), and (iii) a dispensing component ("DC"). In operation, the pressurized gas ("PG") fills the chamber; the TML contacts the T1S and T2S; a fluid switch (TL1/TL2 switch) alternates delivery of T1L and T2L to the DC and the DC alternately dispenses T1 and T2 liquid into the chamber. The stroke length ("SL") is smaller than a corresponding dimension of the chamber (e.g., the length of the chamber), thus, e.g., the MC does not enter the IVSs. In aspects, the MC is configured to move along a path between the IVSs (ORTA voids). Provided that there is a sufficient temperature difference between T1 and T2, the alternating dispensing of T1L & T2L creates a temperature difference in the chamber that causes the MC to repeatedly move back and forth along/across the SL. Typically, (i) dispensing the TML takes up no more than 33% of the work/energy produced by the movement of the MC, (ii) the pressures of the TML and PG before operation vary by no more than 5%; or (iii) both (i)&(ii).

In aspects, the IVSs each make up at least about 16.5% of the chamber, collectively make up ≥33% of the chamber, or both.

In aspects, the MC comprises only 1 CS and the DC is oriented to dispense TML on only 1 side of the CS & on only 1 side of the MC.

In aspects, any flow of PG in the chamber is substantially in the same orientation (e.g., in a direct vertical planar orientation).

In aspects, the pressure of the PG and the TML, once established, typically prior to initial operation, vary by 5%≤, and, except for pressure introduced by temperature modulation brought about by dispensing T1L and T2L into the chamber maintain such similar pressure throughout operating cycle periods of ≥6, ≥12, ≥24, or ≥60 months.

In aspects, pressure within the chamber during operation is sufficiently high so as to cause any heating or cooling of the gas caused by the barrier to make up 2%≤, or less than about 1% (e.g., 0.5%≤) of the average gas temperature in the chamber during an operating cycle.

In aspects, the chamber/device is capable maintaining PG pressure over significant periods of time; e.g., the device requiring re-pressurization, on average, no more than 1× per month, quarter, or year or only upon the failure of a device or system component, e.g., a seal.

In aspects, the device comprises component(s) that automatically start pumping, stop pumping, or both under conditions, e.g., when the difference between T1/T2 ("T1ΔT2") is above/below a threshold.

In aspects, one or both of T1S and T2S are naturally occurring sources, e.g., different parts of an environment (e.g., lake and air).

In aspects, the device is operable even when the high temperature/low temperature relationship between T1S & T2S switches (e.g., T1S goes from hot to cold and T2S correspondingly goes from cold to hot). In aspects, the device comprises a source switch ("SS") (sometimes ORT as an orientation switch ("OS")) that changes the input to the DC/DC part from T1S to T2S to the DC/DC part from T2S to T1S (e.g., where T1S & T2S are environmental sources and time passes from night to day).

In aspects, the invention provides systems comprising devices (e.g., those described above) and secondary component(s), e.g., an extended liquid conducting system ("ELCS") that in operation holds & conducts TML wherein a 1st portion is in contact with T1S, and a $2^{nd}$ portion is in contact with T2S, and comprises connection element(s) capable of connecting the device to the ELCS to maintain a closed TMS. In aspects, the system AOA comprises a power-generating device/component that uses work of the device to generate electricity. In aspects, the device AOA comprises a power generator that converts the work of the device, induced by the T1ΔT2, to transferrable energy (e.g., an electricity generator).

In aspects, the device or system comprises automated control(s), sensor(s), processor(s), or combinations thereof. Sensor(s) can include, e.g., temperature sensors for T1 & T2, T1L & T2L, or both, pressure sensors, motion, flow, humidity, sound, light, power, volume, or other types of sensors. Automated controls can allow the device/system to operate continuously over operating cycle(s) without human input/intervention. In aspects, such controls control pump(s) that reinitiate operation after inactivity periods.

Features of devices/systems OTI enable devices OTI to perform meaningful levels of work. E.g., in aspects, a device can generate an average energy output of at least 7.5 kWh over extended periods of time (≥1, ≥3, ≥6, ≥12 months) or indefinitely when T1ΔT2 is only ~1, ~1.5, or ~2 degrees C. or greater. Devices/systems once initially initiated can operate over extended periods with little maintenance requirements (e.g., operating cycle periods ("OCPs") of ≥1, ≥3, ≥6, ≥12, ≥18, ≥24, ≥36, or ≥60 months without re-pressurization or PG/TML addition are possible). In aspects, the average continuous OCP of a device/system will be significantly the same as the lifetime of the soonest-to-expire component of the device/system, which may be, e.g., a seal or hose of the device/system.

In aspects, the device is adapted (DC parts arranged) such that dispensing of TML droplets can occur in at least 25%, such as ≥33%, ≥40%, ≥50%, ≥60%, ≥66.6%, ≥70%, ≥75%, or ≥30% of the chamber. In aspects, ≥25%, ≥33.3%, ≥50%, ≥66.6%, ≥75%, or ≥90% of dispensed TML travels across more than 50% of the chamber in the orientation in which the TML is dispensed (and the dispensed droplets have a corresponding velocity in order to achieve such a result). In aspects, most, generally all, substantially all, or all the DC parts are placed along one end of the chamber in its largest dimension (e.g., along the bottom of a lengthwise oriented chamber).

In aspects, devices/systems can power small appliances, vehicles, buildings, towns, and the like, either alone or when connected to other devices or systems capable of energy production. In aspects, the invention is a device or system which can be incorporated into mobile devices such as a boat or vehicle. In aspects, a device is mounted to a building or is part of a power generating operation for a town.

In aspects, the invention provides methods of transforming a temperature differential into useful work, comprising (a) providing (1) a TML held within a closed TMS comprising and (2) a container comprising (i) a sealed chamber having two IVSs together making up ≥10%, ≥15% or ≥20% of the chamber, a PG, and a MC having an SL that does not include the IVSs (b) establishing a closed system pressure in the PG and TML before regular operation thus, e.g., the pressure of the liquid having a first temperature and a second temperature is substantially the same as that of the pressurized gas; (c) exposing one portion of the TML to a T1S and a second portion of the TML to a T2S; and (c) dispensing droplets of the TML into the PG in an alternating fashion through a dispensing component (DC) creating alternating T1G and T2G conditions in the PG, the change in T1G & T2G causing the MC to move back-and-forth along the SL. In aspects, the method comprises changing the source of TML in a $1^{st}$ portion of the DC from T1 to T2 and changing the source of TML in a $2^{nd}$ portion of the DC from T2 to T1 (e.g., when the T1S is a lake and the T2S is the air in an environment the sources are switched when time passes from day to night).

Aspects relating to methods of the invention and devices/systems of the invention can be applied to one another herein unless otherwise indicated. E.g., in aspects, the method is performed when the T1ΔT2 is 10 degrees C. or less, e.g., ≤7.5° C., ≤5° C., ≤2.5° C., or ≤1° C.

In aspects, T1S, T2S, or both, are a waste stream from another power consuming or power generating process (e.g., combustion exhaust, air conditioning, factory exhaust, and the like).

In aspects, methods comprise a step of reinitiating movement of the MC after any period of inactivity caused by the T1ΔT2 falling below a threshold. In aspects, the reinitiation step comprises applying power to the MC to cause the MC to move along the SL at a time when the T1ΔT2 is above or approaching a threshold after which the MC will move without extraneous power input. In aspects, such a reinitiation step is performed automatically (e.g., in response to a programmable controller).

In certain facets, the invention is an automated system for performing useful work comprising (a) a device according to any device AOTI and comprising selectively operable pump (s) ("SOP(s)") that when activated pump TML into the chamber using stored power or extraneous power, (b) temperature sensor(s) that detect T1& T2, T1L & T2L, T1G & T2G, or a combination of any or all thereof, (c) an electronic control unit comprising a processor that receives inputs from the temperature sensor(s) and stores and executes instructions that control the operation of the SOP(s) based upon such inputs and preprogrammed instructions (e.g., relating to differences in T1& T2, T1L & T2L, or T1G & T2G, such as in promoting or causing reinitiation of the device by operating a pump to re-start movement of the MC). In aspects, data collection processes are performed in the sensor(s) (i.e., the sensors comprise specialized function computers). In aspects, the processor is located remote from the device or system. In aspects, the processor comprises means for storing and analyzing device operation data (e.g., the processor can comprise an artificial intelligence unit that learns to optimize reinitiation of the MC).

Another AOTI is embodied in an automated system for performing work comprising a device according to device AOTI comprising a fluid switch (T1L/T2L switch) that is under the control of a processor unit and operates during operation according to preprogrammed instructions. In aspects, the processor causes a detectable gap in time between operation of the switch and, thus, the reversal in direction of the MC. In aspects, the gap in time DOS increases work output of the device.

In aspects, GASA or all the dispensation of a liquid (e.g., T1L) occurs before any dispensation of a second type of liquid (e.g., T2L) during most, generally all, or substantially all phases of operation. In aspects, the device is configured to have a dispensation gap. In aspects, the device has an average dispensation gap that DOS enhances the work performed by the device during SMGAOA of operation. In aspects, the dispensation gap generally or substantially DOS enhances the work output of the device during SMGAOA of operation. In aspects, the dispensation gap in operation mostly is, generally is, substantially is, or always in operation is ~0.1-~2.5 seconds (aka, "sec"), ~0.25-~2.5 sec, ~0.3-~2.4 sec, ~0.4-~2.4 sec, ~0.5-~2 sec, ~0.5-~2.5 sec, ~0.75-~2.25 seconds, or ~0.8-~2.2 seconds.

In aspects, the average length of the stroke period and the average dispensation gap differ by ≤~25%, ≤~20%, ≤~1.5%, ≤~10%, ≤~5%, ≤~2.5%, or ≤~1%. In aspects, the average stroke period and the average dispensation time generally, substantially only, or only, in operation, differ by ≤~25%, ≤~15%, ≤~10%, ≤~5%, or ≤~2%.

In aspects, the device comprises a system that creates a gap in time between the completion of a SL by an MC and the dispensation of a TML, and the gap in time, the stroke period, the dispensation gap, or any or all thereof detectably or significantly increase(s) the work output or efficiency of the device.

In aspects, a device/system comprising a processor unit (PU) AOA includes temperature sensor(s), pressure sensor (s), or CT (e.g., PG or TML pressure/temperature sensor(s), TML/MC motion sensor(s), or CT) & the PU comprises means for receiving such data from the sensor(s) and preprogrammed instruction(s) for triggering action(s) in response thereto (e.g., providing an audible or, visual, or audiovisual alarm).

In aspects, PU(s) include means for receiving instructions from and relaying messages to user interface(s) (e.g., mobile phones, web pages, etc.), allowing users to control operation of the device/system.

In aspects, the invention is a complex comprising a system as described above wherein (a) the system, or in some embodiments specifically the device within the system, comprises a power-generating device or component, (b) the complex further comprises a secondary power source, (c) both the system and the secondary power source provide power to an associated powered apparatus, structure, or network (e.g., a vehicle, house, or appliance), (d) the complex comprises an electronic sensor network which comprises (1) temperature sensor(s) (e.g., as described above), (2) a second sensor/data collection unit that collects the available energy in the second power source, and (3) a 3rd data collection unit/component that receives or collects the anticipated energy demand of the apparatus, structure, or network; (e) the complex comprises means for relaying information signals from the first, second, and third sensors; (f) the complex comprises an electronic programmable complex control unit that receives the information signals from the sensors and stores and executes preprogrammed instructions for directing energy from the system or the second power source to the apparatus, structure, or network depending on the differences between the primary temperature and secondary temperature, the energy needs of the apparatus, structure, or network, and the amount of energy in the second power source.

The invention also provides a system for fabricating a low temperature differential energy device (e.g., as described above) comprising (a) entering a required work output for the device to be fabricated to a device design & fabrication processor comprising means for receiving inputs from a user & preprogrammed instructions for analyzing the inputs; (b) entering a series of inputs into the device design and fabrication processor and directing the device design and fabrication processor to generate an estimated work output that the device is expected to produce based on the inputs; (c) entering constraints associated with the inputs; (d) directing the design and fabrication processor to adjust the variables associated with the inputs based on the constraints & ordering the modulation of variables based on either preprogrammed or inputted criteria to generate a device design anticipated to provide the required work output; & (e) fabricating component(s) of the device based on the calculated variables.

These and additional AOTI are described, illustrated, and exemplified in further detail in the following sections of this disclosure.

BRIEF DESCRIPTION OF THE DRAWINGS/FIGURES

DETAILED DESCRIPTION OF THE INVENTION

Disclosed herein are devices, systems, and methods for the effective conversion of temperature differential(s) to useful work, e.g., to mechanical energy, which in aspects are further converted to other types of energy, such as electricity. The devices, systems, and methods typically employ sources of different temperatures (T1& T2) from naturally occurring or otherwise available sources (e.g., industrial or consumer waste stream(s)). Devices OTI can produce useful work at relatively low average temperature differentials. The different temperatures heat and cool portions of a closed TML that are alternatingly dispensed into the PG through the DC creating a difference in T1G and T2G and thereby causing the MC to move along the SL. The devices' gas and liquid systems in operation are closed and, prior to operation, are similarly pressurized thus, e.g., the device and or system comprises a substantially uniform pressure throughout (e.g., pressures that are within +/−5%, =/−2.5%, or +/−1% of each other).

The invention provides devices that convert low temperature differentials into useful work. The devices can be standalone devices comprising all components required for operation or the devices can be parts of systems comprising secondary component(s), the device and secondary component(s) cooperatively operating together to form a system capable of producing work and possibly performing other function(s) (e.g., controlling operation of aspects of the device, converting the device's work into other forms of energy, and the like). E.g., in operation, devices comprise a TMS comprising TML(s). The TMS comprises a liquid conducting system ("LCS") (LCSs are DEH). In aspects, the device LCS ("DLCS") comprises portion(s) that contact T1S or T2S. In aspects, the DLCS does not contact T1S or T2S (or does not comprise components suitable for contacting intended T1Ss or T2Ss), but rather the DLCS is adapted to engage a system LCS ("SLCS") that contacts T1S or T2S. In such aspects, the device typically comprises connector(s) for securely connecting the DLCS to the SLCS without loss of TML or TML pressure in operation over extended OCPs.

Because devices are also elements of the systems and methods described herein, any AOTI described in relation to devices also can be applied to the system and method AOTI described below. E.g., as devices in one aspect comprise source switch(es) which reverse the sourcing of T1L and T2L. As such, methods OTI can comprise use of a SS and systems OTI can comprise devices comprising a source switch.

Figure 2:
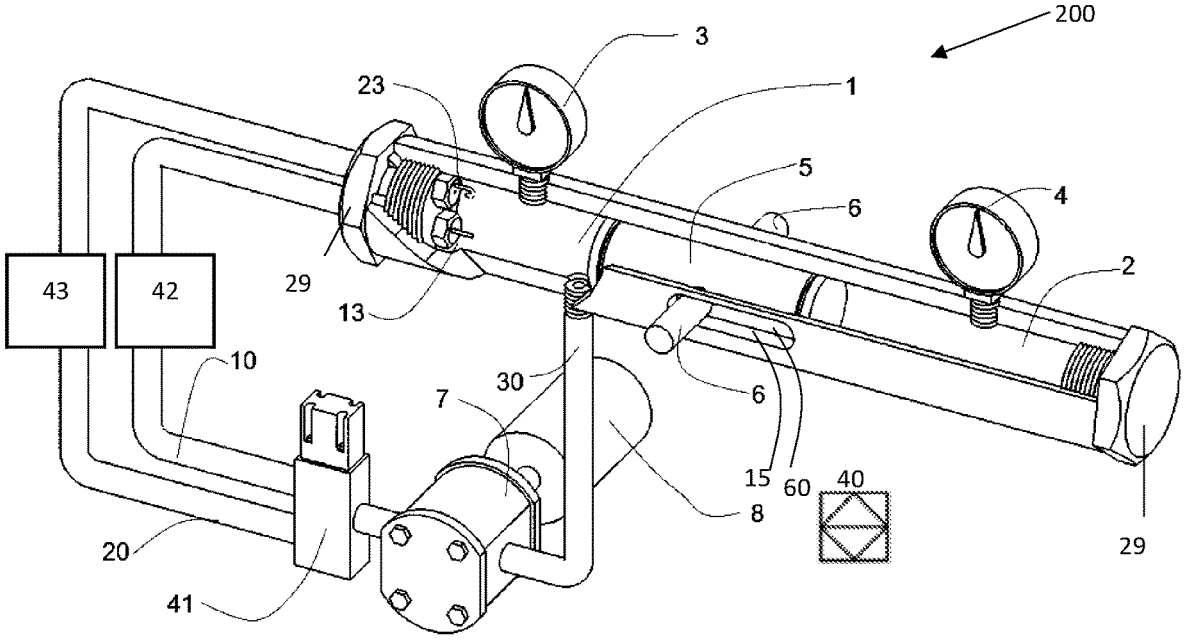
FIG. 2 illustrates one configuration of a device/system described herein comprising a single liquid conducting pump.

In aspects, the principles applicable to a device or system are similar, thus, e.g., some aspects OTI are described as a device/system (e.g., the embodiments shown in FIG. 2 can either be a device comprising a DLCS that contacts T1S & T2S or a system comprising both DLCS & SLCS, with parts of the SLCS contacting T1S & T2S).

In operation and immediately prior to operation (in a "ready for operation" ("RFO" state or "RFOS"), devices OTI comprise closed liquid (TMS) and gas systems. In RFOS, the pressures of the TML & PG are substantially similar, as DEH.

In aspects, devices are selectively openable (e.g., WRT to the chamber(s) of the device, TMS, or otherwise). When closed, a selectively openable device typically maintains pressure in the TMS and PG over extended periods, as DEH.

According to embodiments, devices comprise closed and at least initially similarly pressured TML and PG systems. In aspects, the TML and PG pressure remain within at least about 5%, e.g., within at least about 4.5%, 4%, 3.5%, 3%, 2.5%, 2%, 1.5%, or within at least about 1% of each other in RFOS, at initial operation, or both. "Initial operation" in this sense and others, unless otherwise indicated, means initiation of operation in an OCP, rather than the first time a device is ever operated.

In AOTI, devices ACA at least substantially closed WRT to PG or TML. In AOTI, MGASAOA devices exhibit no DOS TML or PG loss in OCP(s).

According to aspects, re-pressurization of the TML, chamber, or both is required, on average, no more than the earlier of a) the lifetime of the first expiring system seal, (e.g., ~12 months (1 year), ~16 months, ~20 months, ~24 months (2 years), ~28 months, ~32 months, or ~36 months (3 years)), or b) a point in time wherein the system loses at least ~5%, such as at least ~5.5%, at least ~6%, at least ~6.5%, at least ~7%, at least ~7.5%, at least ~8%, at least ~8.5%, at least ~9% at least ~9.5%, or at least ~10% of its pressure when the system is in continual use. In aspects, the TML, PG, or both require re-pressurization no more than once per month, e.g., no more than once every ~2 months, once every ~4 months, once every ~6 months, once every ~8 months, once every ~10 months, or once every ~1 year, such as once every ~14 months, once every ~16 months, once every ~18 months (1.5 years), once every about 20 months, once every ~22 months, or once every ~24 months.

Devices comprise a housing that houses the MC. The housing comprises a barrier component, e.g., walls, that form a chamber in which the MC is located. In aspects, the housing or barrier component comprises one or more visual aid component(s) (VAC(s)) DEH. The chamber includes ≥2 IVSs, which make up a portion of the chamber that typically is sufficiently large to allow T1ΔT2 to cause movement of the MC along most of the SL during MGASAOA times of intended operation. In operation, the IVSs typically only contain PG and TML (when dispensed). Devices typically also include fluid switch(es) (T1L/T2L switch(es)) that in operation alternate(s) the dispensing of T1L and T2L into the PG/chamber. In aspects, at least 1 void space is present within the chamber on each (opposite) side(s) of the movable component, each comprising only the gas or the gas and the liquid and, provided that there is a sufficient temperature difference between the first portion and the second portion, the alternating dispensing of the liquid into the pressurized gas creates a temperature differential in the chamber that causes the movable component to repeatedly move back and forth across a SL. According to certain aspects, the alternating dispensation of T1L and T2L occurs on the same side of the MC (contacting the same contact surface thereof) and usually into only 1 of 2 IVSs in the chamber. Such AOTI are also DFEH.

In aspects, the DLCS of the TMS (or DLCS & SLCS) and the PG have a substantially equal pressure when in RFOS (i.e., have pressures that differ by ≤~5%, ≤~4%, ≤~3%, ≤~2%, ≤~1.5%, or less than ~0.5%. In aspects, the device operates at high pressure(s) in the TML and PG. In aspects, the pressure of the PG, TML, or both is ~12 to ~720 atmospheres (ATM) (176-10,600 psi), e.g., ~12-710 ATM (176-10,400 psi), ~12-700 ATM, ~12-675 ATM, ~12-650 ATM, ~12-620 ATM, ~12-600 ATM (176-8800 psi), such as ~20-720 ATM (290-10,600 psi), ~50-720 ATM, ~75-720 ATM, ~100-720 ATM, ~125-720 ATM, ~150-720 ATM, or ~200-720 ATM or ~300-720 ATM (e.g., 15-600, 25-650, or 25-500 ATM).

In aspects, the DLCS of the TMS (or DLCS & SLCS) and the PG have approximately equal or substantially equal pressure at points in time where a TML is dispensed into the PG (e.g., have pressures that differ by ≤~5%). In aspects, in operation, a TML is dispensed into a PG chamber having a different pressure than the pressure of the PG when in RFOS, e.g., a pressure that is within ~30%, within ~25%, within ~20%, within ~15%, within ~10%, or within about 5% of the PG pressure when the device is in RFOS. In aspects, the DLCS of the TMS (or DLCS & SLCS) and the PG have pressures within ≤~5% of one another at points in time where a TML is dispensed into the PG while the pressure of the PG into which the TML is dispensed during operation is within about 30% of the PG when in RFOS for at one cycle period of the device. In aspects, the difference in pressure between the TML and PG (a) in at least about 33% of the time, at least most of the time, generally all of the time, in operation, and (b) in RFOS, differ by ≤~15%, ≤~10%, ≤~5%, ≤~2.5%, ≤~1.5%, ≤~1%, or ≤~0.5%. While an LCC can be open and can allow collected liquid to flow into an LCS (DLCS or SLCS) as is DEH, the system as a whole typically is classifiable as closed to the environment, wherein a pressure change in one component (e.g., PG) is also made in (a) component(s) in open, fluid communication therewith (e.g., TML). Thus, e.g., dispensation of TML into PG, changing the pressure of the PG in the chamber, also ultimately changes the pressure of the LCS (and the TML within it) with which it is in fluid communication via the LCC, so that when the next TML is dispensed into the chamber, the TML is at substantially the same pressure as the PG into which it is dispensed.

In aspects, the temperature of the barrier modulates the average temperature of the PG by about 1%≤ during MGASAOA operation cycles, such as less than ~0.85%, ≤0.7%, ≤0.6%, ≤0.5%, ≤0.4%, ≤0.3%, ≤0.2%, or ≤0.1% of the average PG temperature.

According to facets, the pressure of the PG within the device, and the pressure of the liquid within the device, can be such that they vary by no more than about 15% prior to operation, e.g., in RFOS such pressures vary by no more than ~7.5%, no more than ~5%, ≤~3.5%, no more than ~3%, ≤~2.5%, no more than ~2%, no more than ~1.5%, or e.g., by ≤1% or about ≤0.5% prior to operation. Such devices can be characterized as comprising "pressure balanced" TML and PG components in RFOS.

In aspects, dispensing of TML into the PG causes SMGA or SA of the PG in chamber(s) to DOS change temperature, creating a pressure differential in the chamber(s) that causes the MC to move from areas of high to low pressure and in the process to convert the energy of the temperature difference into useful work. In aspects, the MC, in most, GA, or SA strokes/movements during operation, moves until the MC reaches a position whereby the PG pressure on either side of the MC reaches approximate equilibrium (approximate pressure balance) (an end of the SL). In aspects, upon or about reaching such an approximate pressure balance in the chamber(s), the next cycle of TML dispensation occurs, creating an opposite change in pressure in the PG/chamber, forcing movement of the MC in response, typically returning along the SL, until again the MC reaches a point of approximate pressure balance.

In aspects, dispensation of TML occurs as the portions of the chamber on either side of the MC approach a pressure balance (e.g., are within ~15%, within ~10%, within ~5%, or within ~2.5% of one another).

In aspects, in operation, dispensing the pressurized TML (sometimes simply ORTA the "liquid") into the PG during system operation takes up, on average, no more than about 33% of the work produced by movement of the MC. In aspects, dispensing pressurized TML takes up ≤30%, ≤25%, ≤20%, ≤17%, or ≤15%, e.g., no more than approximately 13%, ≤10%, ≤7%, ≤5% of the work produced by the movement of the MC.

In aspects, MGASAOA of the outlets, vents, or nozzles of a dispensation component, are oriented such at least a small amount of force is required to dispense liquid. E.g., in aspects parts of the dispenser component are oriented in an upward direction to DOS reduce the risk of uncontrolled DOS release of TML (e.g., via dripping).

In aspects, the pressurized gas (PG) can be any gas that is suitable for use under the intended system pressure and design characteristics of the device and can repeatedly undergo temperature modulation in response to the dispensing of T1L & T2L TML into the gas in a manner that causes the MC to perform useful work over several OCPs.

In aspects, the PG is inert (WRT to GAOA components (and materials thereof) the PG contacts). In aspects, the gas (aka the "working gas") is not DOS prone to leak from the barrier component. In aspects, the PG is inert WRT to the TML, and any absorption of gas by the liquid or dissolution of the gas within the TML does not DOS impact the frequency at which the chamber/TML must be re-pressurized. In AOTI, chemical reactions between the PG & either the TML or component(s) are not DOS.

In aspects, the specific heat of the PG (ORTA the "gas") has a molar specific heat at constant pressure (Cp; the amount of heat transfer required to raise the temperature of one mole of a gas by 1K at constant volume), and a molar specific heat at constant volume (Cv; the amount of heat transfer required to raise the temperature of one mole of a gas by 1K at constant pressure), or both a Cp and a Cv, that is DOS greater than that of air. In aspects, PG has both a Cp and a Cv DOS higher than that of air. Examples of such gasses include carbon monoxide, helium, hydrogen, neon, or nitrogen. In aspects, the PG PCGCOSCO, CEO, or consists of $N_2$ gas. In aspects, a device/system comprises a source of gas. In aspects, a device/system lacks a gas source, as gas in AOTI is only added infrequently (e.g., no more than every ~1, 3, 6, 12, 18, 24, 36, 48, or ~60 months).

In aspects, the gas is maintained in a gaseous state, and is not DOS condensed from a gas to a liquid during operation.

In aspects, the device comprises a chamber formed by the barrier component (barrier). In aspects, the MC effectively divides the chamber into two chambers, each comprising an IVS on either end/side of the SL. In aspects, a detectable amount of PG flows around part of MC from sub-chamber to sub-chamber (e.g., in a gap between the MC and the barrier). In aspects, PG does not flow around the MC and the device comprises two separate chambers and two volumes of PG. Substantially all or all the PG will be in the chamber (s) of the housing during operation.

In operation, GASA or all PG movement is caused by/limited to the expansion and contraction of the gas as effectuated by the dispensation of TML into the chamber. In aspects, any movement of the gas is at least generally, at least substantially, or entirely within the confined space of the chamber. In aspects, the gas does not travel to multiple locations, e.g., does not DOS travel from one significantly distinguishable compartment to another. In aspects, gas is not forced to pass through a path comprising any angle of more than ~30°, ~45°, ~75°, or ~90° in the device. In aspects, the device lacks any components that force the PG to wind, curve, or pass through any tortuous route. In aspects, any movement or flow of gas within the closed system in regular operation is substantially in the same planar orientation. E.g., in a horizontally oriented device, flow of PG will MTCGCOSCO or consist of horizontal flow (albeit back and forth with changes in temperature/pressure brought about by alternating dispensing of T1L and T2L into the PG). In aspects, the device lacks any component that agitates the PG other than any agitation caused by dispensing TML (e.g., the device does not rotate PG).

As indicated EH, devices comprise a housing for the PG and the MC. A housing can be of any suitable shape, size, and orientation and composed of any suitable materials. In aspects, GASA or all the housing has a single orientation (direction/angle). In aspects, the housing is vertically oriented. In aspects, the housing is horizontally oriented. In aspects, the device can operate in any orientation or in several orientations (e.g., when the housing is either in a vertical or a horizontal orientation).

In AOTI, the device is oriented so post-dispensation collected TML gravitationally moves to liquid capture component(s) ("LCC(s)").

A housing can have a shape that GCO, SCO or CO a box-like shape, rectangular shape, or a cylindrical shape. In aspects, a housing can comprise one or more VACs as previously noted and DEH.

In aspects, the housing may have one dimension which is longer than any one or more other dimensions of the housing.

In certain facets, the housing can have a diameter which is substantially the same across GASA or all of its length, e.g., the housing can comprise a diameter wherein the diameter does not vary by more than ~10%, ≥~8%, ≥~6%, ≥~4%, or more than ~2% across its length.

In aspects, the housing is relatively stationary during operation.

In aspects, the device lacks any component that would be considered a "storage tank." E.g., in aspects, no part of a DLCS has a diameter ≥10× the average diameter of the DLCS, e.g., no part of the DLCS has a diameter ≥7×, ≥5×, ≥4×, ≥3×, or ≥2× the average diameter of the DLCS. In some system aspects, no part of a SLCS has a diameter ≥10, ≥7, ≥5, ≥4, ≥3, or ≥2 than the average diameter of the SLCS, DLCS, or both.

In aspects, the housing comprises access port(s) to the chamber, the access port(s) providing access for filling the chamber with PG. In aspects where the housing comprises 2 chambers the housing also can comprise 2 access ports, each accessing a separate chamber. Where the device or system comprises PG tank(s), such tank(s) can be connected to access port(s). Alternatively, access port(s) can comprise fittings (e.g., threading, seals, and the like) that sealingly engage extraneous PG tank(s) when PG gas administration/pressurization is required/desired. Access port(s) are typically selectively closeable & sealed to DOS PG loss if closed.

In aspects, pressurization of the chamber within the housing occurs primarily, generally only, or only through the filling the cylinder with a gas (e.g., $N_2$ gas).

The housing comprises or is formed of a barrier component (barrier), which forms the chamber(s).

In aspects, the interior of the barrier ("BC") forms chamber(s) comprising 2 IVSs and a SL. In aspects, an interior part of the SL ("SLIP") is closed to PG in the chamber(s). In aspects, the device comprises 2 chambers and a SLIP that lacks DOS PG. In aspects, the portion of the housing surrounding the SLIP comprises opening(s) in the barrier.

Examples of the organization of the interiors of horizontally oriented housings in view of these principles include BC-IVS1-chamber-SLIP-chamber-IVS2-BC or BC-IVS1-chamber1-SLIP-chamber2-IVS2-BC.

In aspects comprising 2 chambers, each chamber is substantially impervious to unintentional loss of gas or liquid. In aspects, liquid can be dispensed into one or both of such chambers via dispensation (dispensing) component(s) (DC(s)) for liquid dispensation in such chambers. Further, each chamber comprising DC(s) can comprise a liquid capture component (LCC). In aspects, only 1 of 2 chambers in a device comprises dispensing component(s) (DC(s)) and LCC(s). In aspects comprising 2 chambers, the 2 chambers can be of the same size, about the same size, or can be different sizes. In aspects, devices comprise a 1st chamber comprising DC(s) and LCC(s) (a dispensation chamber), a SLIP comprising no DOS PG (e.g., a SLIP that is open to the environment in part such as having one or more opening in the barrier, yet maintains the pressure within the $1^{st}$ and $2^{nd}$ chambers), and a $2^{nd}$ chamber comprising PG but lacking DC(s) & LCC(s).

The housing also can comprise LCC(s), DC(s) (DC(s)) (e.g., misting nozzles, sprayers, and the like), and component(s) for connecting the device to secondary component (s). Typically, at least a part of the DLCS will run along the exterior of the housing (i.e., on the outside of the barrier), inside the barrier, inside the chamber, or a combination thereof, though part of the DLCS can be free of any contact with the housing (e.g., where the DLCS comprises portions in contact with T1S and T2S). In aspects, the housing/DLCS comprise connection(s) to the SLCS.

The BC can have any suitable configuration and composition.

The BC can be, e.g., formed of one or more solid "sidewalls," above, below, and around the chamber(s). Typically, the BC is composed of material(s) substantially impervious to unintentional loss of TML or PG. In certain facets, the barrier of the housing is capable of maintaining more than ~80% of the gas held therein over OCPs of at least ~1 month, e.g., about ≥2, ≥4, ≥6, ≥8, ≥12, ≥18, ≥24, ≥30, ≥36, ≥48, or ≥ about 60 months. Typically, the BC is not DOS chemically reactive with the TML or the PG.

The MC moves, at most, the SL (complete track/path) inside the housing/barrier. The SL is typically oriented in a single direction/orientation. The SL orientation is typically coaxial with the orientation of the housing. The SL is smaller in its largest dimension (e.g., length), corresponding with its direction (e.g., a horizontal orientation), than the corresponding dimension of the housing (also the length thereof). In operation, the MC moves in alternating fashion, SMGAOSA or all the stroke length in opposing directions (back-and-forth along the SL with alternating dispensation of T1L & T2L). In aspects, the MC is configured to move along a path between the IVSs (ORTA voids).

Dispensing component(s) (DC(s)) will commonly be located within the interior of the housing, thus, e.g., dispensed TML is deposited into chamber(s). In aspects, TML is deposited on both slides of the SLIP. In aspects, TML is deposited on a single side of the SLIP. In aspects comprising 2 separate chambers, the TML (both T1L and T2L) is (alternatingly) dispensed in only one of the 2 chambers. In aspects, a movable component (MC) comprises only one contact surface and the dispensing component is oriented to dispense liquid at least mostly on one side of the contact surface.

In aspects, device/systems comprise visual aid component (s) (VAC(s)). In aspects, a VAC provides visual access to an interior space of a device component or system, e.g., a chamber or flow path, from the exterior of the device/system. In some aspects, such a visual aid component can be within a housing, within a housing barrier, within a flow line, or within any area of a device or system where visual access may be useful or beneficial. For example, in aspects the housing barrier or, e.g., a closure component of the housing, comprises one or more VAC(s) allowing visual access to the inside of the housing, e.g., to the chamber. AOA, VAC(s) can be present in one or more flow lines.

In aspects, a VAC is window comprised of any material capable of withstanding the pressures and temperatures to which the component with which it is associated is exposed (e.g., if a VAC is in a closure component of the housing, the VAC is capable of withstanding the pressures and temperatures to which the chamber of the housing is exposed) and which is non-corrodible by any TML or gas to which it may be exposed, while allowing for an operator to view the inside of the device from the exterior of the VAC. In aspects, such a window can be selectively openable, e.g., itself closed or coverable by a cover closure until intentionally opened by a user. In aspects, suitable material can be glass, a polycarbonate, acrylic or the like. In aspects, the visual aid component can alert the operator to unusual operating conditions, such as for example but not limited to a TML viscosity change, a clogged DC, a clogged LCC, or other visually identifiable condition.

As DEH, typically chamber(s) comprise IVSs on both sides of the SL. The IVS typically GCO, SCO, COE, or consists only of PG & TML in operation, or only contains atmospheric air if the device is open (i.e., the space lacks any physical structures). In other words, typically an internal void space is a space that is uninterrupted in all directions.

In aspects, each IVS has a dimension (e.g., length or a dimension corresponding to the orientation of MC travel) which is at least about 5%, ≥7.5%, ≥10%, ≥12.5%, ≥15%, at least about 17.5%, ≥20%, ≥22.5%, ≥25%, ≥27.5%, or ≥30% of that of the maximum dimension (e.g., length or corresponding dimension) of the largest housing chamber, housing, or both. In aspects in devices comprising 2 IVSs, the IVSs can be equal or about equal in area. In aspects, 2 IVSs of a device have different areas, typically due to different maximum dimensions (e.g., lengths). In aspects, the ratio of the area or maximum dimensions of 2 IVSs in a device is no more than ~3:1, ~2.5:1, ~2:1, ~1.5:1, ~1.33:1, ~1.25:1, ~1.2:1, or ~1.1:1.

In aspects, IVS(s) have a volume which is at least ~5%, such as ≥~7.5%, ≥10%, ≥12.5%, ≥15%, ≥17.5%, ≥20%, ≥22.5%, ≥25%, ≥27.5%, or ≥ about 30% of the total volume of the chamber(s).

In aspects, the MC comprises protruding member(s) ("PM (s)") that protrude through the above-described SLIP barrier opening(s) ("SLIPBO(s)"). In aspects, the protruding member(s) DOS enhance the safety of the device, longevity of the device, effectiveness of the device, or combination of any or all thereof.

SLIPBO(s) can comprise any suitable size or shape. In aspects, SLIPBO(s) (sometimes ORT as "slots"/"openings") have a first dimension, e.g., a width, that is less than a second dimension, e.g., a length. Typically, the maximum orientation of the SLIPBO(s) corresponds to the orientation of the housing (e.g., in a horizontally oriented housing/device, the SLIPBO is also primary horizontally oriented, facilitating movement of the MC in the same orientation as the housing/device). Typically the other dimension will be such that it will allow for efficient movement of the MC, but will not allow the MC to move significantly in any orientation other than the orientation of the device (e.g., will not allow the MC to move more than ~10%, ≥7.5%, ≥5%, ≥2.5%, or ≥ about 1.5% in an orientation other than the orientation of the device, such as an orientation perpendicular to the orientation of the device, thus, e.g., the MC is prevented from rotating within the housing). Typically, the ratio between the largest dimension of the SLIPBO(s) (e.g., length) and the second dimension (e.g., height) is at least about 1.5:1, ≥2:1, ≥2.5:1, ≥3:1, ≥4:1, or at least about ≥5:1. In aspects, the device housing comprises 2 SLIPBOs. In aspects, 2 SLIPBOs are positioned on opposite sides of a device housing.

According to specific exemplary facets, any one or more SLIPBOs (e.g., "slits"/"slots"/"openings") is/are an elongated slit or slot of less than ½ of an inch wide, e.g., less than ¼$^{th}$ of an inch, less than ⅛$^{th}$ of an inch, or less than 1/16$^{th}$ of an inch in width. As used here, the term "width" refers to the dimension of the SLIPBO perpendicular to the longest dimension of the housing in which it resides, perpendicular to the orientation of movement of the MC, or both. According to alternative facets, the opening is an elongated slit having a width wider than ~½ inch (~1.3 cm), such as ~⅝$^{th}$ of an inch (~1.6 cm), ~¾$^{th}$ of an inch (~1.9 cm), ~⅞$^{th}$ of an inch (~2.2 cm), ~1 inch (~2.5 cm), or wider, e.g., ~1.5 inches (~3.8 cm), ~1.75 inches, or ~2 inches (~5.1 cm). In aspects, the width of the opening represents less than ~50%, such as less than ~45%, ≤40%, ≤35%, ≤30%, ≤25%, ≤20%, ≤15%, ≤10%, ≤5%, ≤4%, ≤3%, ≤2%, or ≤ about 1% of the circumference of the housing (e.g., when the housing is in the shape of a cylinder), or ≥ about 50%, such as ≤45%, ≤40%, ≤35%, ≤30%, ≤25%, ≤20%, ≤15%, ≤10%, ≤5%, ≤4%, 3%, ≤2%, or ≤ about 1% of the circumference of the housing of the width of a side of the housing (e.g., when the housing is in the shape of a cube or rectangular box).

According to facets, the SLIPBO/opening is an elongated slit or slot having a length which is less than ~2 feet in length (less than ~61 cm), e.g., ≤ about 22 inches (≤~56 cm), ≤20 ~inches (≤~50.8 cm), ≤~18 inches (≤~45.7 cm), ≤~16 inches (40.6 cm), ≤~14 inches (≤~35.6 cm), ≤~12 inches (≤~30.5 cm), ≤10 ~inches (≤~25.4 cm), ≤~8 inches (≤~20.3 cm), or ≤ about 6 inches (≤~15.2 cm) in length. In aspects, the length of the opening represents less than approximately 50% of the overall length of the housing, e.g., ≤ about 40%≤, ≤35%, or ≤ about 30% of the housing length, such as ≤ about ~25%, ~20%, ~15%, ~10%, or less than ~5% of the housing length, such as ≤ about 4%, ≤3%, ≤2%, or ≤ about 1% of the overall length of the housing.

PM(s) (sometimes ORT as "pins") typically are composed of a material and have a design whereby the PM(s) can withstand an impact with the housing at velocities that exceed the intended maximum MC velocity (e.g., by ≥ about 10%, ≥25%, ≥33%, ≥50%, ≥75%, or ≥ about 100% (2×)). A pin/PM can comprise any shape or size capable of moving through an opening/slot (SLIPBO) in the housing (DEH). In aspects, PM(s) comprise a width (as used here, the term "width" is similar to that used to describe the SLIPBO in that it refers to the dimension of the PM(s) which is perpendicular to the longest dimension of the housing in which it resides, perpendicular to the orientation of movement of the MC, or both) that is at least generally or substantially the width of the opening within which it slides (SLIPBO) thus, e.g., the pin prevents the MC from being able to DOS bounce, jiggle, or rotate within the chamber. In aspects, the PM(s) have a width slightly narrower than the width of the SLIPBO (e.g., about 2% or less, e.g., ~1.5%, 1%, 0.5%, 0.25%, or 0.1% or less than the width of the SLIPBO).

In certain aspects, the PM(s) has a width that is the same in all directions (e.g., the PM(s) is/are cylindrical in shape).

In aspects, PM(s) AOA serve to limit the SL, by holding the MC back from further movement in any one direction.

In further facets, PM(s) can serve as a connector to other component(s) of a device/system allowing for the movement of the MC to be transferred to such other component(s). In aspects, PM(s) connect to movable connector(s) to cause dispensation of TML in an alternating manner with the movement of the MC & corresponding movement of the PM(s).

MGAOSA or all of the composition of the BC, PM(s), MC(s), and other components of the device/system (e.g., the DC(s)) is/are comprised of material(s) which cannot be corroded by water (i.e., non-water corrosive materials), the TML, or both (e.g., SMGAOA of SMGAOA of such component(s) are composed of material(s) or at least plated with material(s) that are non-corrodible by kerosene, turpentine, WD-40® or its equivalent, or any combination thereof). In aspects, material(s) that make up SMGAOA of SMGAOA of such component(s) has a yield strength of at least about 40,000 psi, such as at least about 45,000 psi, ≥50,000 psi, ≥55,000 psi, ≥60,000 psi, at least about 65,000 psi, ≥70,000 psi, ≥75,000 psi, ≥80,000 psi, or even more, such as at least about ≥85,000 psi or ≥ about 90,000 psi. In aspects, the material(s) that make up SMGAOA of SMGAOA of such component(s) has a tensile strength of at least about 60,000 psi, e.g., ≥ about 65,000 psi, ≥70,000 psi, ≥75,000 psi, ≥80,000 psi, ≥85,000 psi, or even more, e.g., ≥90,000 psi or ≥ about 95,000 psi. In certain exemplary aspects, one or more components of the device are comprised of a heat-treated stress relieved steel 41/40.

In some aspects, less than about half, less than 25%, ≤10% of any component(s) of the device/system are bound by welding.

In aspects, the device or device components comprise no detectable area of weakness or material stress. E.g., in aspects at least about 75%, at least ~80%, at least ~85%, at least ~90%, at least about 95% or even more, such as ~96%, ~97%, ~98%, ~99%, or even 100% of the barrier of the chamber has the same stress relief properties. As used here, the term "stress relief" refers to the properties of a component/device or part that reflect how the component/device or part responds to stress (e.g., fluidity or compression properties, of a material when heated and cooled). Differences in "stress relief" properties typically reflect changes in material composition, amount, or configuration, e.g., where a metal is welded vs. where it is not welded. In aspects there are no areas of the device which exhibit differing stress relief characteristics due to welding. In aspects, a drill and tap method is used for most, generally all, or all connections of components in the device/system. In aspects, heat-treated materials, e.g., heat-treated stress relieved steel 41/40 makes up some, most, generally all, substantially all, or all of the barrier, MC, or other components of the device, e.g., the components of the device outside of any LCS, viewing component (VAC), etc. In aspects characteristics of a suitable material used in such parts/components of devices/systems include but may not be limited to high yield strength and non-corrodibility (by any fluid, e.g., liquid or gas, of the device or system with which it may make contact). In some aspects, a suitable material may be a layered material, e.g., a layered material wherein one layer provides strength characteristics (e.g., a braided reinforcement layer) and another layer provides corrosion protection (e.g., a PVC layer).

In aspects, the protrusion facilitates the movement of additional mechanically linked moveable component(s) ("MLMC(s)") of the device. In aspects, the MLMC(s) comprise a moveable connector that engages part of the TMS that triggers dispensation of the TML, such as by pumping TML to the DC(s), through the DC(s), or both.

In aspects, the PM, e.g., "pin", acts as a safety mechanism that prevents (DOS reduces the likelihood of) the MC from traveling beyond the SL when the MC is traveling at maximum or near maximum velocity. In aspects, the PM/pin/safety component moves within the SLIPBO/opening with the movement of the MC. Typically, the pin travels to or close to the end of the opening/slot. In cases where the MC unexpectedly attempts to move beyond the SL in either direction, the pin travels the maximum length of the slot and makes contact with the end of the slit/slot/opening in the housing, thus e.g., the pin can travel no further in that direction, causing the MC to be stopped. Such AOTI are DFEH.

In aspects, the housing can further comprise one or more closure component(s) that facilitate selective opening/closing of the housing. In aspects, closure component(s) form an end of the BC. Such closures can be any type of closure serving to seal the housing such that the housing comprises a chamber within it that is substantially impervious to unintentional fluid (e.g., liquid) and/or gas loss. In aspects, one or more ends of the housing is sealed due to such an end being comprised of the same singular body of the housing walls (e.g., the boundaries of the housing in the opposite plane as then end of the housing). In aspects, the closures can be caps which can be attached to the housing by welding or similar type of sealing, by threading (e.g., the caps can be screwed onto or into the housing), or the like. Such attachment by any mechanism must be capable of withstanding at least the highest operating pressures of the device or system without compromise, preferably significantly more, e.g., at least about 10%, ≥20%, ≥30%, ≥40%, ≥50%, ≥60%, ≥70%, ≥80%, ≥90%, or ≥ about 100%, or even more, such as ~3×, ~5×, ~7×, or about 10× more pressure than the highest operating pressure of the system.

In aspects, closure component(s) can comprise VAC(s).

Except for any protruding member(s) (PM(s)), most, GA, SA, or all the MC resides within the housing. The MC has contact surface(s) that are exposed to dispensed TML and contact a portion of the dispensed TML in operation. In aspects, the MC will have two contact surface(s), e.g., where two sides of a chamber or two separated chambers each comprise DC(s). In aspects, the MC will only have a single contact surface, e.g., where only 1 of 2 chambers in the device comprises DCs.

Generally, the MC can be any kind of structure, device, etc., capable of moving in a first and an opposite second direction when acted on by pressure changes induced by dispensation of T1L and T2L into the chamber(s). In aspects, the movable component ICA a plunger or a piston (e.g., a piston that ORTA a "working piston").

In aspects, the MC GCO, SCO, CEO, or consists of a single component with a uniform composition, comprises no subcomponents that move independently of one another, or both. In aspects, the portion of the MC that travels within chamber(s) GCO, SCO, CEO, or consists of a single component with a uniform composition and has no subcomponents that move independently of one another.

In aspects, the MC has essentially or fundamentally (e.g., fundamentally as used here meaning well understood by POOSITA to be similar or equivalent based on function) the same shape as the inner diameter of the housing (e.g., both are cylindrical or rectangular). In aspects, the diameter of at least part of the MC (e.g., the ends of the MC) and the inner diameter of the housing, e.g. the diameter of the chamber, differ by no more than about 0.5%, about 0.4%, about 0.3%, about 0.2%, about 0.1%, or even less, such as by no more than about 0.09%, 0.08%, 0.07%, 0.06%, 0.05%, 0.04%, 0.03%, 0.02%, or no more than about 0.01%. Accordingly, the MC in aspects creates a substantially impassible barrier with respect to TML or PG, e.g., an at least substantially or entirely impassible barrier, thus, e.g., the device comprises 2 separate chambers, as DEH. In other aspects, the diameter of at least part of the MC is such that the device comprises a single chamber in which PG can flow from one side of the SL to the other (around the MC and between the outer diameter of the MC and the barrier). In aspects, flow between two side(s) of a chamber is created by flow passage (s) in the barrier, created by, e.g., inclusion of a narrower diameter of part of an MC, passages in an MC, or a combination of any thereof. In aspects comprising flow passages in a barrier, outside of an MC, interior of MC, or combination thereof, such passage(s) can be restricted so that such devices can still comprise a SLIP that comprises openings exposed to the environment and closed to PG.

In aspects, less than about 1%, such as less than ~0.9%, less than ~0.8%, less than ~0.7%, less than ~0.6%, less than ~0.5%, less than ~0.4%, less than ~0.3%, less than ~0.2%, or, e.g., less than ~0.1% of a volume of gas on either side of the MC is able to pass to the opposite side of the movable component during a stroke of the MC (e.g., during a movement of the movable component its maximum distance in either direction).

Typically, in SMGAOA of the MC there is a slight enough difference in diameter between the MC and the inner diameter of the housing (BC) whereby the movable component can slide freely with minimal friction in response to T1LΔT2L changes in pressure. In aspects, movement of the MC encounters relatively little contact with the interior with the housing and associated friction during movement that DOS reduces the maximum velocity of the MC, DOS reduces the maximum work production of the device, or both DOS reduces the maximum velocity of the MC and reduces the maximum work production of the device. For example, in aspects, such friction reduces MC movement, velocity, or both by less than about 20%, such as ≥ about 15%, ≥10%, ≥5%, ≥4%, ≥3%, ≥2%, or less than about 1% or even less. In certain aspects, the time for a MC to complete a SL is reduced by less than about 20%, such as ≥ about 15%, ≥10%, ≥5%, ≥4%, ≥3%, ≥2%, or less than about 1% or even less due to friction encountered between the MC and the BC.

In aspects, the MC GCO, SCO, CEO, or consists of a component having a uniform diameter apart from any protruding member (PM) of the MC. In certain facets, the movable component has a diameter which is substantially the same, e.g., substantially identical, across MGAOSA or all its length. That is, in aspects the MC can comprise a diameter wherein the diameter does not vary by more than about 10%, more than about 8%, more than about 6%, more than about 4%, or more than about 2% across its length, or even less such as the diameter can vary by no more than about 1% across its length. According to certain aspects, a contact surface (CS) of the movable component is relatively flat, with no purposeful shape modification of the contact surface. In certain further aspects, the CS comprises no physical connection to any other component of the system, such as for example, comprises no piston rod or the like. In aspects, the CS lacks contact with any solid component. This is beneficial as it increases the surface area of the CS capable of being impacted by a changed in pressure of the chamber within which it resides.

In aspects, the system comprises a MC which moves back and forth the in alternating fashion in response to pressure differentials created on either side of the MC by the alternating dispensation of a TML. With each movement in a first direction caused by dispensation of a TML into at least a first chamber, the MC encounters a back pressure applied by the PG in the second chamber (or, e.g., the chamber being compressed by the movement of the MC). In aspects, that back pressure represents approximately 40-60%, such as approximately 50%, of the otherwise maximum distance the MC could move in response to a temperature differential absent a backpressure. In aspects, the amount of TML released during each dispensation into a first chamber, the timing of TML dispensation (e.g., length of time TML is dispensed) in a first chamber, the size of the CS(s) of the MC exposed to a first chamber, or other device characteristics is/are selected such that it/they is/are suitable for addressing the loss of approximately 50% of the otherwise available stroke length caused by the PG back pressure exerted by the second chamber, on the opposite side of the MC, maximizing the maximum work production of the device while conforming to the restrictions in device and/or system design provided by, e.g., the environment in which the device and/or system operates. In aspects, such care in design affords the MC movement of a maximum stroke length while providing a balance in system efficiency.

According to aspects, at least about 10%, e.g., ≥20%, at least about 30%, ≥40%, ≥50% or more, ≥60%, ≥70%, ≥80%, ≥90%, or even more of the liquid dispensed into a chamber does not make contact with the corresponding contact surface (CS) of the MC. In aspects, any liquid making contact with a CS of the MC does not do so prior to losing (in the case of dispensed TML hotter than the PG into which it is dispensed, when dispensed) at least about 40%, ≥~50%, ≥~60%, ≥~70%, ≥~80%, ≥~90%, or at least about 95% of the T1L temperature. In aspects, any liquid making contact with a CS does not do so prior to absorbing at least about 40%, ≥~50%, ≥~60%, ≥~70%, ≥~80%, at least about 90%, or at least about 95% of the temperature of the PG in cases where dispensed TML is colder than the PG into which it is dispensed.

According to some aspects, the movable component (MC) is capable of completing at least about 60, ≥100, ≥200, ≥300, ≥400, at least about 500, ≥600, or more, such as at least approximately 700, ≥800, ≥900, or ≥ about 1000 strokes per minute in peak operation of the device, a "stroke" being the maximum distance the MC can travel in one direction.

In aspects, SMGAOSA or all the DC(s) are outside of the SL (e.g., in the IVS(s)). In aspects, SOM of the DC(s) are within the SL.

In aspects, the MC is coupled with a power-generating device/system, such that movement of the MC generates or can generate power (e.g., electricity). In aspects, the energy generated by the MC's work can be transferred to associated components/systems via an energy/power take off mechanism, for conversion to electrical energy or other form of energy. In AOTI, movement of the MC can generate power or electricity directly, e.g., where at least part of the housing operates as a linear electrical generator.

In aspects, a device/system comprises a protruding member (PM)/pin as DEH that acts as a safety mechanism and AOA comprises selectively operable or automatic/automated safety feature(s) ("SOOASF(s)"). In aspects, SOOASF(s) comprise automatable shut off valves or switches, typically linked to sensor(s), where, e.g., reaching or crossing a threshold triggers the automated activity of the SOOASF(s). In aspects, SOOASF(s) are linked to programmable processing unit(s) that direct operation of such feature (s) upon occurrence of an event that meets criteria in preprogrammed instruction(s) stored/executable by such PU(s).

The devices and/or systems of the present invention comprise a temperature modulation system. The TMS modulates the temperature of the PG, thereby changing temperature & pressure in the chamber(s). The TMS effectuates this through changing temperature of parts of the TML by contact with T1S & T2S and through the alternate dispensing of T1L & T2L. Typically, a TMS comprises TML(s), DC(s), DLCS, LCC(s), and switches, such as SS(es), fluid switch(es) (T1L/T2L switch(es)), or both.

According to aspects, the TMS comprises one or more liquids having DOS different average temperature(s); typically, an average temperature difference of ≥ about 1° C., e.g., ≥2, ≥3, ≥4, ≥5, ≥7, ≥8.5, or ≥ about 10° C. during operation. Typically, a device will operate with a single type of liquid that has two portions having a first and a second average temperature, respectively (T1L and T2L) that create the temperature differential that powers the device. In aspects, if a sufficient temperature difference is present between the $1^{st}$ & $2^{nd}$ portions, alternating dispensation of liquid into the pressurized gas present in the chamber of the housing creates a temperature change in the pressurized gas and hence a pressure differential between 2 chambers separated by the MC, causing the MC to repeatedly move from a 1st position located at an end of the SL to a $2^{nd}$ position wherein the pressure of the gas is relatively lower than the 1st position upon TML dispensation. The first and second portions of the TML are generated by exposing parts of the TML to T1S & T2S, respectively. The $1^{st}$ & $2^{nd}$ portions are maintained sufficiently separate to maintain a sufficient temperature difference to power the device during MGAOSA or all intended periods of operation (e.g., the portions are not in contact or located in near enough proximity to effectuate any DOS transfer of temperature (heat) between the first and second portions).

The TML typically has a boiling point and freezing point which allows for the liquid to remain a liquid under normal device operation. In aspects, he TML AOA typically has a viscosity of about 0.05 cP-about 3.5 cP at 300 deg K and atmospheric pressure, e.g., ~0.05 cP-~3 cP, ~0.05-~2.8 cP, ~0.05-~2.6 cP, ~0.05-~2.4 cP, ~0.5 cP-~2.2 cP, or about 0.5-~2 cP, such as for example ~0.6 cP-3.5 cP, ~0.7-3.5 cP, or ~0.8-3.5 cP at about 300° K and atmospheric pressure, as in e.g., about 0.8 cP-about 3.4 cP, ~0.8-3.3 cP, ~0.8-3.2 cP, ~0.8-3.1 cP, or ~0.8-about 3 cP, or ~1-~3 cP at ~300° K and atmospheric pressure.

In aspects, the specific heat of the liquid is between about 1.3-4.7 kJ/kgK, e.g., ~1.35-4.65 kJ/kgK, ~1.4-4.6 kJ/kgK, ~1.45-4.55 kJ/kgK, ~1.5-4.5 kJ/kgK, ~1.55-4.45 kJ/kgK, or ~1.6-4.4 kJ/(kg K).

In aspects, the TML has a surface tension of ~18-80 dynes/cm, e.g., ~19-78 dynes/cm, ~20-77 dynes/cm, ~20-77 dynes/cm, ~21-76 dynes/cm, ~22-75 dynes/cm, ~22-75 dynes/cm, ~23-75 dynes/cm, ~24-75 dynes/cm, or ~20-40 dynes/cm, ~20-35 dynes/cm, ~21-38 dynes/cm, ~22-36 dynes/cm, ~23-34 dynes/cm, or ~24-32 dynes/cm.

In aspects, the freezing point of the TML is between ~185-300° K, e.g., ~190-about 295° K, ~195-290° K, ~200-285° K, ~200-280° K, ~205-277° K, ~208-275° K, or ~208° K-235° K.

In aspects, the boiling point of the TML is about 350-600° K, such as ~355-595° K, ~360-590° K, ~365-585° K, ~370-580° K, or between about 373° K-about 575° K. In aspects, the boiling point of the TML is between about 400-575° K, such as between ~405-575° K, ~410-575° K, ~415-575° K, ~420-575° K, or between about 422-575° K.

In aspects, the TML is an aqueous liquid, e.g., water. In aspects, the TML is a nonaqueous liquid. In aspects, the TML PC, GCO, SCO, CEO, or consists of hydrocarbons, e.g., TMLs can PC, GCO, SCO, or CO of 4-30 or 5-30 carbon hydrocarbon compound liquids. In aspects, the TML is PC, GCO, SCO, CEO, or consists of organic compounds and can be classified as an oil. In aspects, the TML is turpentine or another oil that PC, GCO, SCO, or consists of terpenes. In aspects, the TML is kerosene or another oil that PC, GCO, SCO, or consists of one or more hydrocarbons of similar sizes as those typically found in kerosene. In aspects, the TML PC, GCO, SCO, CEO, or consists of a low vapor pressure aliphatic hydrocarbon (e.g., kerosene in combination with other materials such as, for example but not limited to a petroleum base oil (e.g., a paraffin), mineral oil, other aliphatic hydrocarbons, alkanes, isoalkanes, cyclics, and aromatics, such as for example C9-C11 n-alkanes, isoalkanes, cyclics, and aromatics). In aspects the TML can comprise, e.g., as principal components, C9-C14 alkanes and mineral oil. According to certain aspects, the liquid is selected from the group comprising turpentine, kerosene, or a formulation sold under the brand WD-40® (WD-40 Company, San Diego, Calif.), or an equivalent thereof (a liquid having about the same viscosity, about the same lubricity, or both, as WD-40® (the lubricity properties of WD-40® as described in, e.g., US20110114537). In aspects, the TML comprises, materially comprises, or primarily comprises a liquid that is classified in the art as a lubricant. In aspects, the lubricant is composed of organic compound(s). In aspects, a lubricant can be but may not be limited to a petroleum fraction or mineral oil; a synthetic oil (e.g., Super Lube® Synthetic Lightweight Oil); PTFE, molybdenum, or a biolubricant (e.g., a vegetable oil). In aspects, the TML PC, GCO, SCO, CEO, or consists of an oil that is suitable for atomization in ~0.5-5 micron particles, e.g., ~1-3 micron droplets, and spraying as a mist, and typically have a relatively low wax content (e.g., naphthenic oils, low wax ISO 100 paraffinic mineral oils or similar synthetic oils such as ISO 68 PAOs and ISO 68 or 100 diesters). In aspects, MGASAOA of the TML is not converted to gas during normal operation.

The TMS typically comprises a recirculation system that captures and recycles dispensed TML, returning such TML to the DLCS. In aspects, the DLCS is generally, substantially, essentially, or completely free of PG. The device typically comprises LCC(s) that collect TML and returns the collected TML to the DLCS for recycling. In aspects, ≥~90%, ≥95%, ≥97%, or ≥~99% of the TML volume is retained after sustained OCPs, e.g., ≥ about ≥3, ≥6, ≥9, ≥12, ≥18, ≥24, ≥30, ≥36, ≥48, or ≥ about 60 months.

In aspects, the device and/or system is capable of maintaining optimal average work and/or energy production when the portions of liquid provided by a liquid conducting system (LCS) have an average temperature differential as low as about 10° C., e.g., ~9° C. or less, ≤~8° C., ≤~7° C., ≤~5° C., ≤~4° C., ≤~3° C., ≤~2° C., or about 1° C. or less.

In aspects, the average temperature of T1S, T2S or both DOS changes over MGASAOA 24-hour periods in OCPs (e.g., when the temperature inputs are environmental locations, such as a lake and air). In such aspects, the average temperatures of T1S and T2S can change in such a manner that T1S is warmer than T2S during portion(s) of a 24 hour period and T1S is colder than T2S input during the other portion(s) of the same 24 hour period. This can occur, for example, when one temperature input is a body of water and a second temperature input is a body of air; e.g., during the day the air is warmer than the water however during the night the air is cooler than the water.

Typically, where T1 and T2 are equal or at a near equal threshold temperature difference (e.g., less than about 2, 1.5, 1.25, or 1° C. different) the MC will fail to complete the SL and eventually cease moving for at least some period of time. In aspects, as T1 & T2 begin to differ again, approaching or exceeding the threshold, the MC will begin to move and eventually move the entire SL. In aspects, the device or system can comprise a means for injecting TML to reinitiate movement of the MC, by operation of a pump using stored or extraneous power. In aspects, injection of either T1L or T2L can be manually selected for restarting the device or system. In aspects, the device or system comprises an automated control for selecting either T1L or T2L for restarting the device or system. In certain facets, after the device/system has ceased operation due to a lack of sufficient temperature differential between T1S and T2S, injection of either T1L or T2L once a sufficient temperature between T1S and T2S has been reestablished is capable of restarting the system.

In aspects, a device or system comprises the ability to store a liquid having a first temperature, e.g., a "warm" fluid, and a liquid having a second temperature, e.g., a "cool" fluid. In aspects, such stored liquid can be used in operation, e.g., to restart a system after having been inactive or to continue operation of a system during a period of time during which the T1ΔTL between a T1S and a T2S is insufficient to support normal operation.

In aspects, T1S & T2S are environmental inputs and the device is operable, on average, at least 10 of every 24 hours, e.g., ≥12 of each 24 hours, ≥14 of every 24 hrs., ≥16 of every 24 hrs., ≥20 of each 24 hours, or ≥22 of every 24 hours, or ≥~50%, at least about 60%, ≥70%, at least about 80%, at least about 90%, or even more of a typical 24 hour period.

In aspects, the DLCS (or DLCS & SLCS) are generally composed of piping or tubing or similar liquid conduits, e.g., a helical, spiral, or horizontally or vertically oriented liquid conduits. The liquid conduit(s) can be made of any suitable material that is non-reactive with the TML and impervious to DOS TML loss over extended periods of time and at operating pressures. In aspects, the conduit(s) is/are a tubing, e.g., a flexible tubing. In aspects such tubing can comprise one or more fittings or connectors capable of connecting two or more sections of tubing and/or connecting the tubing to one or more other components of a device or system. In aspects such a flexible tubing can comprise acrylonitrile butadiene styrene (ABS); a thermoplastic polymer such as a polycarbonate material; a polyethylene (PE) material such as, e.g., linear low-density polyethylene (LLDPE), low-density polyethylene (LDPE), medium-density polyethylene (MDPE), high-density polyethylene (HDPE), high molecular weight (HMW) high density polyethylene (HDPE); polypropylene (e.g., homopolymer, copolymer); polystyrene (e.g., high impact polystyrene (HIPS), crystal styrene); polyurethane (e.g., polyester, polyether); polyvinyl chloride (PVC), e.g. rigid PVC or flex PVC; synthetic rubber (e.g., thermoplastic vulcanizates (TPV), thermoplastic polyurethane (TPU), thermoplastic elastomer (TPE), olefin block copolymer (OBC); nylon, vinyl, or any such similar or equivalent plastic tubing materials having suitable compatibility and design capability characteristics. In aspects, a plastic used can comprise one or more plasticizers added to improve flexibility.

In aspects, the conduit(s) is/are a piping, e.g., a piping comprising any of, alone or in combination, straight, curved, or elbowed sections. In aspects the piping can be made of a non-TML-corrodible material (relative to the TML and In aspects relative to any environmental elements, e.g., water, sun, waste liquids or waste gases), e.g., a rigid plastic or a metal. In aspects, such piping can comprise a plastic described above or a similar or equivalent plastic having a rigid structure. In aspects, such piping can comprise a metal, e.g., nickel, chromium, molybdenum, manganese, silicon, copper, or alloys/blends, e.g., steel, such as heat treated stress relieved steel 41/40, or any combination of alloys/metals providing suitable qualities for the DLCS(s) and SLCS(s) DEH. In aspects, pipe(s) can be made of stainless steel.

In aspects a DLCS or a SLCS may be comprised of a single material. In aspects a DLCS and an SLCS in a single system may be comprised of the same material, while in alternative aspects a DLCS and an SLCS of the same system can each alone comprise two or more materials or considered together can comprise two or more materials. In certain aspects, one or more sections of a DLCS or a SLCS can comprise tubing or piping of a different material than another one or more sections of the DLCS or SLCS. For example, in certain aspects, (a) section(s) of a SLCS passing through T1S or T2S can comprise a material wherein heat transfer is different relative to sections of a SLCS not passing through T1S or T2S. For example, a portion of a SLCS passing through T1S or T2S can comprise a material wherein heat transfer is increased relative to sections of a SLCS not passing through T1S or T2S, thus e.g., as a portion of TML passes through the section of a SLCS exposed to T1S or T2S, it is effectively and sufficiently heated or cooled during passage through the section, and when traveling through a section of the SLCS between T1S or T2S and the device, the material of the DLCS is capable of reducing heat gain or loss, maintaining the temperature of the TML within at least about 50% of the temperature established by exposure to T1S or T2S, such as within ~50%, ~45%, ~40%, ~35%, ~30%, ~25%, ~20%, ~15%, ~10%, ~5%, or even within about 1% of the temperature established by exposure to T1S or T2S. In aspects, the material of the DLCS between T1S and/or T2S and the device is capable of preventing heat loss or gain by the TML of more than about 50%, ~40%, ~30%, ~20%, ~40%, ~5%, or even by more than about 1%.

The dispensing component(s) (DC(s)) can be any suitable type of DC(s) for dispensing droplets in the form of a spray, mist, or the like, of the TML, into the PG in the chamber(s). In aspects, dispensation of liquid as a mist is accomplished through a DC embodied as a nozzle. As used herein, the term "nozzle" refers to a device designed to control the direction or characteristics of a liquid flow as it exits an enclosed space. Such a nozzle can be any device comprising such characteristics and can assume any shape capable of accomplishing its required task of exposing liquid to the gas in such a manner so as to very quickly modify the temperature of the gas. Specific characteristics of such nozzles and the characteristics of the liquid dispensed therefrom are DFEH.

In aspects, the volume of TML dispensed into the PG can modify the temperature of the PG into which it is dispensed sufficiently to cause a PG pressure differential and hence movement of the MC. In aspects, the volume of TML dispensed into the PG is capable of sufficiently and adequately (e.g., quickly as is described elsewhere herein) modifying the temperature of the PG to approximately three quarters (¾), or 75%, of the temperature of the TML. In aspects, while modifying the temperature of the PG to a temperature closer than 75% of that of the TML can continue to maintain operability of the system, heating or cooling the PG beyond that of ¾ of that of the TML can decrease system/device efficiency; e.g., more energy can be consumed in the process of narrowing the temperature differential between the TML and the PG than may be obtained from the work produced by such a reduction in temperature differential. In aspects, the device/system can be operated when the volume of TML dispensed into the PG modifies the temperature of the PG to less than approximately ¾, or 75%, of the temperature of the TML. In such circumstances, the device/system may produce less work than a system in which the PG is raised to close to ¾ of that of the TML.

According to certain aspects, the device and/or systems described herein lack a powered active cooling system other than the TML. In aspects, MGAOSA or all cooling of PG during operation is attributable to the operation of the TMS (dispensing of TML).

In aspects, devices comprise liquid switch(es), sometimes referred to as a T1L/T2L switch, that cause alternating dispensation of T1L and into the PG. A T1L/T2L switch can be any mechanism capable of changing or controlling the TML that is to be dispensed on the next operation/actuation of the DC(s), such as a mechanical or mechanically driven switch, a valve, and the like. Such switch(es) can operate automatically in response to sensors, timers, programmable electronic processors, or combinations thereof.

In aspects, operation of a T1L/T2L switch is mechanically tied/linked to movement of the MC (directly or indirectly). E.g., an indirect mechanical connection between a T1L/T2L switch and an MC is embodied in 1 set of exemplary figures provided and is described in detail EH. In such an embodiment, movement of the MC in one direction causes dispensation of a first portion of liquid having a first temperature (e.g., T1L), and movement of the MC in a second direction causes dispensation of a second portion of liquid having a $2^{nd}$ temperature (e.g., T2L).

In aspects, devices comprise sensor(s). In aspects, the sensor(s) directly or indirectly control operation of one or more selectively operable component(s) of the device. In aspects, sensor(s) comprise a temperature sensor (e.g., a thermocouple), a pressure sensor, a motion sensor, a flow, volume, humidity, or sound sensor, light sensor, power sensor, or combinations thereof.

In aspects, devices/systems comprise dispensation enclosure(s) (which may in some places herein be referred to as a dispensation housing but which should be differentiated from the housing of the device comprising the MC), which receives TML from the DLCS (or SLCS) for selective or automatic release to a DC. In such aspects, the dispensation enclosure typically capable of holding less than about 10 gallons of TML (e.g., T1L and T2L) while maintaining their separation, such as <~8 gallons, ~6 gallons, ~4 gallons, ~2 gallons, or <~1 gallon. In aspects, devices comprise 2 dispensation enclosures, 1 for relatively warmer temperature TML (e.g., T1L) and another for relatively cooler temperature TML (e.g., T2L). In aspects, the maximum volume of two such first and second chambers within a dispensation enclosure can be relatively equivalent, such as for example having a total maximum volume within ~20%, within ~15%, within ~10%, within ~5%, within ~4%, within ~3%, within ~2%, or within ~1% of each other. According to certain alternative aspects, the maximum volume of two such first and second chambers within a dispensation enclosure can differ from one another, such as for example if within one such chamber a device or system component is present which is not present in a second such chamber. This can be the case, for example, if a T1L/T2L switch separates the two chambers and a physical component exists on one side of the T1L/T2L fluid switch (e.g., a T1L/T2L switch driving device), passing through the area defined by one such chamber but not the other. Such an embodiment is exemplified in the figures and DEH. Other similar designs are contemplated such that chamber size can maintain substantial equivalence in embodiments wherein a dispensation enclosure comprising such chambers are present. For example, a T1L/T2L switch could be designed to receive motion from, e.g., a T1L/T2L switch driving device (also referred to herein as a fluid switch driving device), from the side of the T1L/T2L switch, much like the safety component or dual-purpose safety component (protruding member (PM)) extends from the side of the MC and extends through a SLIPBO.

According to certain embodiments, the device and/or system does not comprise such a dispensation enclosure.

In aspects, when ≥2 dispensation enclosures are in the device, movement of the MC can drive the dispensation of TML from the dispensation enclosures via a mechanically linked T1L/T2L switch. Such an embodiment is described in the figures provided and discussed EH.

In aspects, the device comprises pump(s) that pump TML through one or more parts of the TMS. In aspects, pump(s) facilitate the alternating dispensation of T1L and T2L, selectively, automatically, or both. In some aspects, a plurality of pumps, e.g., 2 or more pumps can operate to, for example, push TML through one or more DLCS or SLCS flow lines. In some aspects, such a plurality of pumps can operate in series or in parallel. In some aspects, only one pump is present within a DLCS or SLCS flow line. In aspects, one pump is used within one DLCS or SLCS while two or more pumps are used in another DLCS or SLCS. In aspects, pump(s) mostly, generally, substantially only, or only push(es) TML as opposed to pull(ing) TML (e.g., by vacuum) through a DLCS or SLCS. In aspects, a sufficient volume of liquid is collected by the LCC after each complete dispensation of T1L or T2L, or also or alternatively, after any number of completed T1L and/or T2L dispensations, and flows into a liquid collection line such that in at GAOA times during an operation cycle period, there is enough of a force of liquid flowing into the pump for the pump (a) to DOS maintain effective operation; (b) in most cases, generally all cases, or at least substantially cases, in operation, mostly, generally only, substantially only, or only pump(s) TML, rather than PG; or (c), both (a) and (b).

Devices can comprise any suitable DC(s) (sometimes ORT as a dispenser). DC(s) can comprise nozzles, sprayers, misters, vents (e.g., project vents), and the like that expel, propel, spray, mist, or otherwise dispense TML in droplet/mist form into the PG in any suitable manner. DCs typically comprise 1 or outlets. In aspects, the DC comprises one or more manifold(s) or "tree(s)" comprising a plurality of outlets, e.g., nozzles or vents. In aspects, T1L and T2L are dispensed through the same DC or parts of a DC. In aspects, T1L and T2L are dispensed through different DCs or different parts of a DC. In aspects comprising dispensation enclosure(s), DC(s), or parts of a DC, can receive stored TML from the dispensation enclosure(s) and dispense it through DC(s)/part(s) used for dispensation of T1L, T2L, or both, or that are dedicated to only dispensing dispensation enclosure TML. In aspects, MGAOSA or all of the DCs/DC part(s) are oriented to dispense TML as a mist into the PG in an upward direction, so as to reduce the risk of uncontrolled release of TML (e.g., via dripping) and to maintain control over the dispensation of TML.

In aspects, dispensation of a TML using a DC comprising (a) manifold(s) or (b) tree(s) DOS aids in reducing the time for the dispensed TML to sufficiently modify the temperature of a PG into which it is dispensed so as to affect/effectuate movement of the MC, relative to the time it takes using a single dispenser dispensing TML as a mist having comparable droplet characteristics and dispensed in a comparable volume. In aspects, distributing the dispensation of TML as a mist throughout the chamber, e.g., throughout the pressurized gas, using one or more DC(s) in the form of a manifold or tree comprising multiple outlets DOS increases the volume of PG contacted by the TML, such contact allowing for heat exchange between the TML and the PG.

In aspects, a dispensing component (DC) can receive liquid from for example, a liquid dispensation enclosure, a liquid conducting system (LCS), or another interim TML holding area (e.g., a storage tank or the like which does not comprise a T1L/T2L switch, is not mechanically linked with a T1L/T2L switch, is not in contact with a T1L/T2L switch, or a combination thereof). According to certain common embodiments, a DC can be in operable communication with a LCS, such that at least one portion of liquid (e.g., T1L or T2L) from a LCS is accessible to a DC, either directly (e.g., a direct connection), or indirectly (e.g., via a dispensation enclosure).

In aspects, only one DC is active at a time; in aspects, only one portion of TML (T1L or T2L) is dispensed at a time, e.g., in aspects where DC(s) is/are only present on a single side of the MC. In such an embodiment, dispensation of T1L and T2L occurs in alternating sequence. In certain alternative aspects, two or more DCs can be active at a time; for example, T1L can be dispensed on one side of the MC and substantially, approximately, essentially, or entirely simultaneously (e.g. within a fraction of a second of one another) T2L is dispensed into the PG on the opposite side of the MC.

In aspects, DC(s) comprise 3 or more TML outlets, e.g., ≥4, ≥5, ≥6, ≥8, ≥10, ≥12, ≥15, ≥20, ≥25, ≥35, ≥50, ≥75, ≥100, ≥150, ≥200, ≥250 or 300 or more outlets. E.g., DC(s) can comprise 2-500, 2-200, or 2-100, 2-50, or 2-20 dispensers; 3-600, 3-300, 3-90, or 3-30 dispensers; 5-1000, 5-750, 5-500, 5-250, or 5-50 dispensers; or 10-1000, 10-500, or 10-100 dispensers, e.g., 20-800, 20-600, 20-400, 20-200, or 20-100 outlets.

In aspects, DC(s) is/are present in the chamber of the device housing. In one aspect, DC(s) are present on each side of the MC within the chamber. In aspects, DC(s) are only present on 1 side of the MC.

In aspects, a dispensation component (DC) can access a chamber via an access point in the housing whereby primarily, generally, substantially, or entirely no part of the DC projects into the chamber; e.g., in aspects the DC can be flush with the barrier of the chamber. In certain alternative aspects, a DC can project into a chamber, such that it resides to at least some extent inside of the barrier of the chamber. In aspects, SMGAOA of DC(s)/DC components are positioned outside of the SL. In aspects, some or most of the DC(s)/DC components are positioned in the SL.

According to facets, injection of TML takes place in the form of a fine mist, e.g., as a cloud of droplets, such that the resulting temperature change of the PG into which the mist is dispensed, and corresponding pressure change within the chamber comprising the PG, can be as quick as possible, yet consumes the least amount of energy possible.

In aspects, TML mist comprises droplets having an average size, of between about 25 μm and about 150 μm, such as ~30-90 μm, ~35-70μm, or ~40-80 μm. In aspects, droplet size of a mist can also be described by Volume Mean Diameter (VMD). The VMD refers to the midpoint of droplet size (median), wherein half of the volume of spray is in droplets smaller, and half of the volume is in droplets larger, than the median. A VMD (DV0.5) of 400 μm, for example, indicates that half of the volume of spray is in droplets having a size smaller than 400 μm. A DV0.1 value indicates that 10% of the volume of spray is in droplets smaller than a given value, while a DV0.9 value indicates that 90% of the volume of spray is in droplets smaller than a given value, while 10% is larger than the given value. According to aspects, the TML has DV0.9 values of ~70 μm; e.g., about 90% of the volume of the spray is in droplets having a size smaller than ~70 μm. In aspects, the VMD (DV0.5) of the TML is about between ~30-70 μm, such as between about 40-about 60 μm, as in about 50 μm.

According to certain aspects, the mist is dispensed in sufficient volume to cause a sufficient change in temperature of the PG into which it is dispensed, and a resulting pressure differential on opposing sides of the MC causing DOS movement of the MC to begin within about 1 second of the dispensation of the TML, e.g., within ~0.9 seconds, ~0.8 seconds, ~0.7 seconds, ~0.6 seconds, or ~0.5 seconds. In aspects, the device is adapted such that most, GASA or all dispensations during operation cause the MC to DOS move within less than about ~0.4 seconds, e.g., ≤~0.3 seconds, ≤~0.2 seconds, or ~0.1 second, such as within about 0.05 seconds, ~0.001 seconds, ~0.0005 seconds, or within even ~0.00001 seconds.

According to some facets, the droplets of the mist dispensed by one or more dispensing components (DCs) have a DV0.9 value of about 70 μm, are dispensed in sufficient volume so as to affect a sufficient temperature change within the chamber to cause movement of the MC within about 0.1 seconds of the dispensation of the mist, or both the droplets of the mist dispensed by one or more DCs have a DV0.9 value of about 70 μm and are dispensed in sufficient volume so as to affect a sufficient temperature change within the chamber to cause movement of the MC within about 0.1 seconds of the dispensation of the mist.

In aspects, the pressure within the TML in the DLCS and the pressure of the PG in the chamber are at least about the same in RFOS. In aspects, the pressure of the pressurized chamber and the pressure of the temperature modulation system (TMS) vary by no more than about 20%, such as ≤ about 17.5%, ≤~15%, ≤~12.5%, by ≤~10%, by ≤~7.5%, by ≤~5%, or ≤~2.5%, such as by ≤ about 1% during regular operation.

According to some facets, some amount of dispensed liquid does not contact the contact surface (CS) of the movable component (MC). In aspects, at least about 10%, ≥~20%, ≥~30%, ≥~40%, ≥~50% or more, such as ≥~60%, ≥~70%, ≥~80%, ≥~90% or even more, such as ~95% of the dispensed TML does not contact the CS of the MC. According to certain aspects, at least about 50%, ≥~60%, ≥~70%, ≥~80%, ≥~90%, or even more, such as ≥~92%, ≥~94%, ≥~96%, ≥~98%, ≥~99%, or ≥~99.5% of the TML does not contact the CS of the MC prior to exchanging at least about 50%, ≥~60%, ≥~70%, ≥~80%, ≥~90%, or at least about 95% or even more of its heat.

In aspects, the volume of TML required to heat or cool the PG increases as the pressure of the gas increases. Accordingly, In aspects, the operating pressure of the devices and systems described herein can dictate the volume of TML required to be dispensed to effectuate a change in temperature of the PG sufficient to cause MC movement, and such considerations are incorporated into device and/or system design. In aspects, a sufficiently high operating PG pressure can require dispensation of a TML volume sufficient to cause MC movement which is significant, and can become a limiting factor in selecting the operating pressure of the device/system during device/system design (e.g., the energy required to dispense such a volume quickly becomes too high to be suitable and/or is too high to operate a suitably efficient device/system).

In aspects, the DC(s), e.g., a manifold DC, is extend(s) over at least ~25% of the length of at least one IVS, and typically at least ~50%, ≥~65%, or ≥~75% the length of the IVS. In aspects, the DC(s)/DC component(s) extend over ~50% of a chamber's length, e.g., over 66.6% of a chamber, ≥~75% of a chamber, e.g., ≥90% of a chamber length.

In aspects, a DC, e.g., a manifold DC, in operation dispenses a TML mist that fills (occupies as droplets) at least 30% of the IVS, e.g., ≥50%, ≥66.6%, ≥75%, or ≥85% or 90% of the IVS volume. In aspects, a DC, such as a manifold DC, in operation dispenses a TML mist that fills (occupies as detectable droplets) at least 30% of the chamber volume, e.g., ≥50%, ≥66.6%, ≥75%, or ≥85% or ≥~90% or more of chamber volume.

In aspects, TML spray/mist makes contact with the majority of the volume (e.g., ≥~50%, ≥~60%, ≥~70%, ≥~80%, ≥~90%, or ≥~95%) of PG held within the IVS, chamber, or both.

In aspects, there is a DOS gap in time, e.g., a delay, pause, or a separation in time) between MGAOSA or all occurrences of TML dispensation (e.g., between any two dispensations of a TML), referred to herein as a dispensation gap. A dispensation gap is the period between the end of a dispensation of a first TML and the start of the dispensation of a second TML. In aspects, during the dispensation gap, the MC completes at least ~50%, ~75%, ~95%, or about 100% of the SL before MGASAOA TML dispensations during operation. In aspects, a dispensation gap occurs in MGAOSA or all strokes of a MC in operation. In aspects, a dispensation gap is ≥~0.1, ~0.25, ~0.5, ~0.75 seconds, ~1 second; ≤~0.2 seconds; ≤~2 seconds, ≤~1.5 seconds, ≤~1 second, ≤~0.75 seconds, ≤~0.5 seconds; ≤~0.25 seconds; or CT. In aspects, configuring the device to include a dispensation gap of a specific duration enhances the amount of work performed by the device.

In aspects, an MC completes an SL prior to the dispensation of a TML which results in the MC reversing direction. In aspects, a TML may be dispensed during a stroke period, wherein the MC has not yet completed a full SL. In aspects, one or more stroke periods of any operating cycle period (OCP) may comprise no dispensation of a TML and one or more stroke periods of the same OCP may comprise dispensation of a TML.

In aspects, an OCP can comprise one or more gaps in time between the completion of an SL by an MC and the dispensation of the next TML. This gap in time occurs during a dispensation gap. In aspects, an OCP can comprise dispensation gaps in which such a gap between completion of an SL by an MC and dispensation of the next TML occurs and can comprise dispensation gaps in which no such gap between completion of an SL by and MC and dispensation of the next TML occurs.

In aspects, dispensation occurs when the MC reaches a minimum (triggering) stroke length. That is, in aspects, the means for modulating temperature, e.g., a temperature modulation system (TMS), does not create a new or modified temperature differential in the chamber sufficient to cause the MC to move in the next direction, until the MC has first reached a minimum/triggering SL in a first direction. In aspects, such a minimum SL is at least ~60%, e.g., ≥~65%, ≥~70%, ≥~75%, ≥~80%, ≥~85%, ≥~90%, ≥~92%, ≥~94%, ≥~96%, or at least about 98% of the entire SL. In certain aspects, such dispensation is automatically controlled, e.g., by incorporation of one or more timing devices (e.g., which may be an element of an OCC). In aspects, an OCC comprises programming which defines a dispensation gap upon the completion of which an OCC directs the dispensation of TL1 or TL2, e.g., by directing the engagement of one or more pumps and/or one or more valves. In aspects, such a programmed dispensation gap value can be slightly longer, e.g., ~0.001% longer, ~0.01% longer, ~0.05% longer, ~0.1%, ~0.3%, ~0.5%, ~0.7%, ~0.9%, or ~1% longer or more than the actual time it takes for an MC to complete a stroke length after dispensation of a first TML to ensure that the MC completes a full SL (stated another way, a programmed value can be slightly longer, e.g., ~0.001%-~1% longer, than a stroke period). In aspects, dispensation of T1L and T2L is programmed into CPU/PU(s) such that the MC completes a full SL ≥~50%, ≥~60%, ≥~70%, ≥~80%, ≥~90%, ≥~95%, or for example in aspects ~100% of the time before the next dispensation of a TML occurs.

In certain facets, the dispensation gap is created as a function of a delay between the mechanical cooperation, either directly or indirectly, between two or more different system components. According to certain aspects, such a dispensation gap can be created as a function of a delay between the movement of the MC and the interaction of two or more other mechanical elements of the device. E.g., in aspects the PM(s) connected to an MC engage a MLMC, e.g., a movable connector that further engages one or more motion receiving element(s) (MRE(s)) that, when engaged, dispenses another portion of TML into the chamber; such mechanical engagement automatically introducing a dispensation gap by mechanical engagement. Such an embodiment is illustrated in the figures and the described in detail in connection therewith EH.

In aspects, a dispensation gap can be governed by processor(s) that control operation of component(s) automatically (e.g., based on preprogrammed time intervals), selectively, or automatically in response to sensed conditions. For example, in one such embodiment, when the temperature of a chamber reaches a predetermined temperature, or the pressure of a chamber reaches a predetermined pressure, a sensor present in that chamber relays the temperature or pressure data to a processing unit wherein the processing unit receives such data and effectuates the dispensation of the next portion of liquid (T1L or T2L) into the chamber. As another example, in one such embodiment, a first portion of liquid (e.g., T1L) is dispensed into the chamber, a preprogrammed length of time is allowed to pass, as monitored by a processing unit, the completion of which effectuates the dispensation of T2L into the chamber.

In aspects, devices/systems comprise ≥1 pump(s). Pump(s) can be components of a device (e.g., a part of a TMS). In aspects, multiple pumps can be present and part of either the device or the system.

According to aspects, pump(s) can be present as a component of a liquid dispensation enclosure (that facilitates dispensation of T1L or T2L). In aspects, pump(s) can be actuated by a mechanical connection to a MC. E.g., in one embodiment described below, a T1L/T2L switch mechanically connected indirectly to the MC serves as both the T1L/T2L switch and as a pump for dispensation of T1L/T2L in alternating fashion through DC(s).

In aspects, a TMS comprise pump(s) which operate independently from a liquid dispensation enclosure. In aspects, pump(s) are not connected to the MC, mechanically linked to the MC (directly or indirectly), or both. In aspects, pump(s) selectively drive TML through the TMS, through DC(s), or otherwise through the device/system. In aspects, operation of such pump(s) sometimes, most of the time, generally all of the time, or only is powered by extraneous or stored power. In aspects, pump(s) are controllable programmatically (e.g., by a processing unit ("PU") capable of receiving data, analyzing data, and controlling operation of pump(s) based on preprogrammed instructions stored and executable by the PU). In aspects, the device and/or system comprises temperature sensor(s) that detect the T1ΔT2 in part(s) of the device/system and controller(s) (e.g., PU(s)) that receives inputs from temperature sensor(s) and that controls the operation of the one or more pumps based upon such inputs. In AOTI, devices or systems operate such that the device and/or systems automatically stop pumping liquid to a DC when the T1ΔT2 approaches, meets, or exceeds (e.g., falls below) predetermined threshold(s); automatically begins pumping liquid to a DC when the T1ΔT2 approaches, meets, or exceeds predetermined threshold(s); or both.

Pump(s) generally can be any suitable type of pump for moving/conducting TML through the device/system, typically over prolonged periods of use (e.g., ≥6, ≥12, ≥18, ≥24, ≥30, ≥36, ≥48, or ≥60 months) with low rates of failure (e.g., failure rates of less than ~5%, ≤~4%, ≤~3%, ≤~2%, ≤~1%, ≤~0.5%, ≤~0.25%, or ≤~0.1%). In aspects, a device/system comprises pump(s) capable of pumping SMGAOA TML through a significant distance, such as e.g., from a point of collection from a liquid capture component (LCC) of the device housing to DC(s) (through the DLCS or DLCS & SLCS).

In aspects, TML passes through temperature input(s)/source(s) (T1S & T2S). In aspects, a single pump pumps MGAOSA or all TML captured by an LCC back to DC(s). In aspects, the device or device & system comprise(s) 2 separated parts of a TMS (1 for T1L and another for T2L). In aspects, a device/system comprises means for routing a portion of TML collected by the LCC to the T1L part ("T1LP") (ORT as a "first path") of a DLCS or combined DLCS & SLCS ("CDSLCS") and an approximately equal portion of dispensed TML to a 2nd part ("T2LP") (ORT as a "second path") of a DLCS/CDSLCS.

The T1LP comprise(s) T1S input(s) and the T2LP comprises T2S input(s) or sources (collectively, T1S & T2S, respectively). The input(s) can be any suitable inputs. Typically, the inputs provide for indirect contact of the TML inside the DLCS or CDSLCS with the sources of temperature that generate T1 and T2 (e.g., a lake & an air mass, a heat exhaust and a cold exhaust, etc.). E.g., in aspects a T1S is, e.g., a location where the tubing that makes up the DLCS or CDSLCS passes through a source of T1 (and the same is true for T2S). In aspects, the material of the LCS, the configuration of the LCS, or both, is adapted at the input(s)/source(s) to provide for better temperature transfer between the source of T1/T2 and the TML in the LCS.

In aspects, multiple pumps are used to pump TML through the system. In aspects, 1 pump can selectively, automatically, or regularly pump TML through at least part of T1LP and a $2^{nd}$ pump can selectively, automatically, or regularly pump TML through another part of T2LP. In AOTI 3, 4, or more pumps are in the device/system. E.g., in one aspect, a $3^{rd}$ pump selectively, automatically, or regularly drives TML through DC(s). In AOTI, at least 1 pump is not actuated to dispense TML from any DC by a mechanical connection to the movable component (MC).

In aspects, pump(s) use relatively small amounts of energy. According to certain embodiments, the energy to operate pump(s) is at least about 50%, such ≥~55%, ≥~60%, ≥~65%, ≥~70%, ≥~75%, ≥~80%, ≥~85%, ≥~90%, ≥~95%, or in aspects even up to ~100% or 100% on average generated by the operation of the device. In certain facets, the energy to operate the pump(s) during an OC/OCP is at least ~75%-~100% on average generated by the operation of the device.

Examples of suitable types of pumps that can be incorporated in device/systems include positive displacement pumps, centrifugal pumps, or axial flow pumps, e.g., a rotary-type positive displacement pump (e.g., a peristaltic, an internal gear, screw, shuttle block, flexible vane or sliding vane, circumferential piston, flexible impeller, helical twisted roots, or liquid-ring pump), a reciprocating-type positive displacement pump (e.g., a piston pump, plunger pump, or diaphragm pump), or a linear-type positive displacement pump (e.g., a rope or chain pump), or e.g. an impulse pump, velocity pump, steam pump, or valveless pump. According to AOTI, a device/system comprises rotary pump(s).

According to AOTI, pump(s) can be operated/actuated or otherwise controlled by a controller, e.g., a PU, receiving input from one or more means of sensing temperature or pressure change(s) (e.g., from one or more such sensors such as a temperature and/or pressure sensor). In aspects, one or more thermocouples aid in the detection of system status and participate in the initiation of a pump based on the status of the environment such a one or more thermocouples detects.

According to aspects, T1S or T2S have 2 average temperatures that fluctuate due to conditions, either regularly or in response to events. In aspects, T1S, T2S, or both, are environmental inputs, and, in such aspects can have average temperatures that fluctuate periodically throughout any 24-hour period. In aspects, T1S and T2S can reverse, e.g., T1S being warmer in the day and colder at night and T2S having the opposite temperature profile (colder by day and warmer by night). E.g., in aspects T1S and T2S are a body of water and a body of air.

According to aspects, the device and/or system can comprise a mechanism for allowing the system to reverse the flow from T1S and T2S to other parts of the system, such as the DC(s). In aspects, a device/system comprises a component/device that acts as a switch (a "source switch" ("SS")), that reverses the flow from T1S & T2S to other parts of the system/device. In aspects, the SS comprises a valve. In certain facets the valve can be positioned between DC(s) of the device and other parts/components of a TMS. An SS can be in a device, system, or both. In aspects, a source switch (SS) is positioned between (in terms of normal flow, spatially, or both) pump(s) and DC(s). This is exemplified in, for example, FIG. 2 herein. In aspects, a device/system comprises dispensation enclosures & SS(s) change the connection between the dispensation enclosures & other parts of the device/system In aspects, the housing comprises a liquid capture component (LCC). TML dispensed as a mist into PG, after having effectuated the temperature change, ultimately accumulates/collects, e.g., in the bottom of the chamber where it can be collected by LCC(s). An LCC can be any component capable of collecting collected TML. In aspects, the LCC is a liquid flow guidance mechanism such as a shaped section within or connected to a part of the barrier (e.g., wall) of the housing, e.g., a notch, groove, sloped area, or the like, which leads collected liquid to a port serving as a drain. In other aspects, the LCC comprises port(s) without any liquid guidance component(s).

In aspects, some or all the LCC is positioned within the chamber outside of the SL. In aspects, because the system is closed, and because device operation occurs under relatively uniform pressure throughout (e.g., the pressure of the gas and the liquid within the system are substantially equivalent unless/until acted upon by a TML), the liquid capture component (LCC) can in AOTI remain open to collect TML. In alternative aspects the LCC comprises a selectively or automatically, e.g., programmatically controlled, closure device/component.

In aspects, collected liquid exits the chamber via the LCC and flows through the TMS according to the volume of liquid within the TMS at the time of liquid collection. In aspects, if the volume of liquid is lower in the T1L/T1S side of the LCS, the drained liquid flows toward that side of the LCS. In aspects if the volume of liquid is lower in the T2L/T2S side of the LCS, the drained liquid flows toward that side of the LCS.

In aspects, devices comprise operation component(s) that allow selective operation of components of the device/system or selective operation of the device/system. In aspects, operation can be controlled by human input, while in alternative embodiments, devices/systems or components can be operated automatically via the incorporation of components capable of monitoring, processing, and acting in response to one or more device conditions (e.g., a PU comprising programmable instructions and means for receiving sensor input(s)). In aspects, devices/systems or components are operated utilizing human input, automatically under the control of PU(s), or both.

In aspects, systems/devices comprise sensor(s), as DEH. Sensors can comprise temperature sensor(s), pressure sensor (s) (e.g., of TML, PG, or both), motion sensor(s) (e.g., monitoring PG, MC, or both), flow sensor(s) or humidity sensor(s) (e.g., monitoring dispensed TML in a chamber), sound sensor(s), light sensor(s), power sensor(s), volume sensor(s), etc. In aspects, a sensor can be a thermocouple. In aspects, SMGAOA operation of components (e.g., DC(s) or pump(s)) is directed in response to a timer.

In aspects, SMGAOA sensor(s) of the device/system share data with processing unit(s) (PU(s)) comprising stored instructions for analyzing the data & controlling component (s) in response to criteria. PU(s) can be a component of the device or part of a system. In aspects, PU(s) analyze data from sensors in evaluating whether to initiate action(s) by other component(s) (e.g., pump(s), DC(s), etc.). E.g., data from a sensor in a chamber or part of a chamber on a 1st side of the SL and data from a sensor in the chamber/chamber part on the opposite side of the SL can be combined to evaluate T1ΔT2, the pressure differential, or both, and such combined data used by the PU to evaluate whether to initiate or stop action(s) by device component(s) (e.g., switch(es), pump(s), or DC(s)).

In aspects, sensors can be placed in liquid conducting lines (LCL(s)) of a LCS to monitor the temperature of portions of liquid (T1L and T2L) as they are modified by temperature inputs (T1S and T2S) of such systems. In aspects, sensors can be placed in LCL(s) of an LCS to monitor flow patterns. In facets, sensor(s) are positioned external to a device or system to measure, e.g., environmental conditions near a device/system.

According to AOTI, the device can comprise a component for mechanically linking or mechanically connecting movement of the MC to other component(s) of the device/system. As previously described, in aspects the MC can comprise a protruding member (PM) which can connect to one or more other device components movable by mechanical linkage to the MC (an MLMC), such as e.g. a movable connector.

In aspects, a movable connector participates in TMS, and in certain facets can serve to (a) transfer movement of the MC to one or more other components of the device, (b) facilitate a dispensation gap, advantageously allowing for the MC to complete a primarily, generally, substantially full or full SL prior to reversing direction, (c) participate in the conversion of the movement of the MC into useful work, or any combination of (a), (b), and (c).

In aspects, an MC is connected to a moveable connector, as DEH. A moveable connector can comprise/be any device/component suitable for carrying out such tasks. A moveable connector can have any suitable shape, configuration, and composition. In aspects, the movable connector can be a rod, an enclosed element such as a cylinder- or box-like structure, a ring, a hoop, or the like.

In certain embodiments, the movable connector is a component located outside of the housing and is connected to the PM which extends from the body of the MC through one or more SLIPBO(s). In aspects, movement of the MC is translated via moveable connector(s) to one or more other components of the device, either directly or indirectly, through physical or mechanical interaction. E.g., a moveable connector can be engaged with the MC and dispensation enclosure(s) as DEH. In aspects, the movable connector interfaces with the T1L/T2L switch, either directly or indirectly, thus, e.g., sufficient movement of the MC in alternating directions causes the T1L/T2L switch to alternatingly dispense liquid from $1^{st}$ & 2nd chambers of a single dispensation enclosure.

In aspects, a dispensation gap is caused, at least in part, by interaction of a movable connector with other components in the device. In one embodiment, the movable connector takes the shape of a loop, frame or a hoop that surrounds the housing, the PM extending through two SLIPBOs, and connecting to the MC on either side of the housing. In aspects, the hole in the movable connector allows for the movable connector to slide over another component of the device when the movable connector moves with the movement of the MC. In aspects, a portion of that movement is free movement in that the movable connector does not contact any other component of the device. In aspects, the component of the device that the movable connector slides over is a fluid switch driving device (FSDD) (aka T1L/T2L switch driving device, or FSDD) comprising two or more motion receiving element (MREs) separated by a space, the movable connector sliding over the FSDD between the two or more MREs, within the space that separates them. In aspects, during the portion of the movement of the movable connector that is free movement (e.g., movement that is free of contact with a MRE of the FSDD), the FSDD remains relatively stationary; e.g., it is unaffected by the movement of the movable connector as the movable component slides about it.

In aspects, MRE(s) PCSCOGCO, CEO, or consist of a material that is non-water or non-TML corrosive and has a yield strength of at least about 40,000 psi, such as ≥~50,000 psi, ≥~60,000 psi, ≥~70,000 psi, or ≥~80,000 psi, and comprises a tensile strength of at least about 60,000 psi, ≥~65,000 psi, ≥~70,000 psi, ≥~75,000 psi, ≥~80,000 psi, ≥~85,000 psi, or ≥~90,000 psi. In aspects, an MRE comprises a material which is non-water corrosive and is made of a material comprising a yield strength of ≥~40,000 psi and a tensile strength of ≥~60,000 psi.

In aspects, a motion receiving element (MRE) is a protrusion, a notch, an extension, or the like on the FSDD. In aspects, such a protrusion is a component connected to the FSDD. In alternative aspects it may be formed as one unit with the FSDD. In aspects, such a protrusion or extension is referred to as a lug. Upon this contact, further movement of the movable connector is transferred via the MRE(s) to the FSDD.

In aspects, when a movable connector moves a distance corresponding to the MC approaching the SL in the same direction, the movable connector makes contact with one or more MREs (e.g., one or more lugs) on the FSDD and further motion of the movable connector in that direction, and correspondingly further motion of the MC in that direction, causes the FSDD to drive dispensation of an amount of liquid (liquid portion) from a fluid dispensation enclosure into the chamber. In aspects, this mechanism is a dispensation-gap-generating mechanical component, as the dispensation does not happen immediately upon movement of the MC, only when the MC moves a sufficient distance to contact one or more MREs. (In other aspects, one or more control units can be a dispensation-gap-generating automated component as a control unit can programmatically determine the timing of dispensation of TML.) When the MC reverses direction, the movable connector moves along with it, sliding along the FSDD in the space between the at least two MREs, experiencing free motion during this time. When the MC approaches the end of the SL in the opposite direction, the movable connector contacts at least one other MRE or set of MREs of the FSDD. At that time, further movement of the MC and the related movement of the movable connector in the opposite direction, forces the FSDD in that same direction, leading to the FSDD driving the dispensation of another liquid portion from a fluid dispensation enclosure into the chamber. Movement of an MC can perform a variety of useful work. E.g., an MC can comprise a converter or mechanism for converting movement of the MC into other forms of work. In aspects, such a mechanism can be selected from a group comprising a rack mechanism, e.g., a rack and pinion mechanism; a roller mechanism, e.g., a roller pinion mechanism; a magnetic, hydraulic, piezoelectric, or any other such similar or equivalent mechanism KITA. In aspects, the MC provides means of connecting a device to a power source take off. In aspects, the converter comprises an electricity generating device.

In aspects, less than about 50%, such as ≥~45%, ≥~40%, ≥~35%, or less than ~30%, e.g., ≥~25%, ≥~20%, ≥~15%, or less than about 10% of the energy generated by the device is used in dispersing liquid, pumping liquid, or both. In aspects when the device is operating as a component of a system, less than about 50%, ≥~45%, ≥~40%, ≥~35%, or ≥~30%, such as less than ~25%, ≥~20%, ≥~15%, or even less than about 10% of the energy generated by the system is used in dispersing liquid, pumping liquid, or both.

In aspects, the devices and systems described herein produce at least about 2×, ≥~3×, ≥~4×, ≥~5×, ≥~10×, ≥~25×, ≥~50×, ≥~75×, or at least about 100× (100 times) the amount of energy consumed by operation when the T1ΔT2 or T1GΔT2G is at least 10° C. (e.g., such as ≥~10° C., ≥~12° C., ≥~14° C., ≥~16° C., ≥~18° C., or ≥~20° C.) upon each alternating dispensation of T1L and T2L. In aspects, devices and systems comprise means of converting work of the MC to produce energy.

In aspects, the work produced by the device can be further transformed to other types of energy, such as for example but not limited to electrical energy, hydraulic energy, pneumatic pressure energy, high temperature heat energy, and the like.

In aspects, the device can comprise a means of generating electricity. Such a means can comprise any means capable of generating electricity, such as but not limited to movement of the MC generating electricity directly such as the MC operating as a linear electric generator; the device comprising a means of converting movement of the MC to electricity; or for example the device comprising an off-take component such as a rack component of a rack and pinion mechanism, piezoelectric blocks, means of converting linear motion to rotational motion such as to drive a rotor, flywheel, or other such means KITA. Some such energy converter mechanisms have been previously described, e.g., as previously described as being a component of the movable connector; however such energy conversion mechanisms need not be a component of the movable connector but can be present in any part of the device or system capable of capturing work. In aspects, a PM of a MC can operate as a safety component and may not connect to a movable connector but may connect to, or operate in conjunction or cooperatively with, a power off-take device such as those described elsewhere herein. According to certain aspects, the movable component can be a linear generator and can serve directly as a power generation device. In one aspect a mechanism for transferring work from the device for conversion into usable energy is an electromagnetic motor. In aspects, a mechanism for transferring work from the device for conversion into usable energy is a rack, e.g., a rack and pinion system.

In aspects, the devices and systems described herein can produce significant work, such as e.g., at least ~2 to at least about 100 times the amount of energy consumed by operation when the temperature of the PG modified by the TMS is changed by at least 10° C. upon each alternating dispensation of TML. In aspects, the device and/or system within which the device is operating has an energy production capacity of at least about 5 kW, such as ≥~5 kW, ≥~6 kW, ≥~7 kW, ≥~8 kW, ≥~9 kW, ≥~10 kW, ≥~12 kW, ≥~14 kW, ≥~16 kW, ≥~18 kW, or for example at least about 20 kW. In aspects, the devices and systems described herein produce an average energy output of at least about 5 kWh, ≥~5.5 kWh, ≥~6 kWh, ≥~6.5 kWh, ≥~7 kWh, ≥~7.5 kWh, ≥~8 kWh, ≥~8.5 kWh, ≥~9 kWh, ≥~9.5 kWh, ≥~10 kWh, or even more, such as at least about 12 kWh, ≥~14 kWh, ≥~16 kWh, ≥~18 kWh, or at least about 20 kWh. In aspects, the devices and systems described herein are capable of producing such maximum energy output and average energy output when there is at least an about 1° C. difference between the temperatures of the first and second liquid portions, such as ≥~2° C., ≥~3 degrees Celsius, ≥~4° C., or ≥~5° C. differential between the first and second liquid portions.

According to certain aspects, the amount of energy the device or system is capable of producing is sufficient to operate an average automobile or average motorboat. In aspects, one or more devices or systems of OTI is capable of being connected to any one or more other devices and or systems OTI such that multiple devices or systems operate as a single energy production unit. In aspects, such a unit can be capable of generating enough power to meet the energy needs of larger devices, systems, or facilities or habitats, e.g., but not limited to, a small apartment, an average single family home, a duplex, an apartment building, a small town, a medium sized city, or their energy-requiring equivalents, or, e.g., to meet even larger energy needs such as that of a city.

In aspects, devices and/or systems are capable of being connected to one or more other types of energy production systems, such as nuclear, coal, wind, solar, hydro, or the like, to expand energy production capabilities. In aspects, the devices and systems described herein are one component of a multi-component power generation system.

In aspects, the devices and systems described herein are advantageous in that they can operate quietly, efficiently, and in an environmentally friendly manner (e.g., they contribute minimal, generally no, substantially no, or no waste which is detrimental to the environment such as air or water quality). In aspects, the devices and systems described herein may find utility in applications wherein other power sources are not feasible due to infrastructure, cost, space or sound limitations, or the like.

In aspects, the devices and or systems within which the device operates can generate electricity and the device and or system can further comprise one or more batteries for storing energy. Such energy stored in the battery can, in some facets, be used to operate components of the device or system such as, for example, pump(s), or can for example be used to supplement the energy production when, for example, the device or system produces a below average amount of energy and/or the device or system fails to operate or ceases operation due to an insufficient temperature differential between T1S and T2S and/or T1L and T2L.

In aspects, automated controls or human intervention can be utilized to restart a device/system when operation stops due to T1ΔT2 falling below a threshold or for other reasons.

In aspects, devices/systems comprise more than 2 temperature inputs, e.g., "T35", "T45", "T55", etc.; e.g., 3, 4, 5, or more inputs, such as environmental inputs, with different combinations of such input(s) contributing TML to the device/system (e.g., during parts of the day TML is sourced from 2, 3, or 4 depths of a body of water or during times TML is sourced from inputs associated with different activities/waste streams).

In aspects, multiple low temperature differential powered devices OTI can be connected or networked. In aspects, such networked systems can comprise device(s) having different operating parameter(s) allowing some of such device(s) to generate work while others may experience a period of non-operation.

In aspects, a device/system can be connected to unrelated power source(s)/system(s), e.g., a hydroelectric power generating system, wind turbine(s), solar power generating system(s), etc., and therewith providing coordinated energy sources. In aspect(s), devices/systems comprise energy storage devices/components, e.g., batteries, which in methods can cover periods where device(s) are not generating work/energy.

In aspects, a device and/or a system comprises a minimum power generation threshold, below which the device/system is deemed less optimal or unsuitable to continue to operate and is temporarily stopped. In aspects, such analysis, stopping or starting, is controlled by an electronic PU/CPU acting on preprogrammed stored instructions.

In aspects, the threshold of power production at which the device and/or system in which the device operates can be deemed unsuitable for operation can be the point at which the energy produced reaches a production level that is within at least about 0.5% of that value, such as no more than about 0.45% of that value, ≤~0.4%, ≤~0.35%, ≤~0.3%, ≤~0.25%, ≤~0.2%, ≤~0.15%, or for example ≤~0.1% or ≤~0.05% of the energy consumed by the device. In aspects, the energy consumed by the device is related only to pump(s) and/or pump(s) operation, e.g., pump pressure. In aspects, wherein the device comprises or is in a system comprising control unit(s) capable of automatically controlling the device/system, operation can be automatically stopped until such a time when the energy of the system/device produced is at least ~0.1%, 0.5%, 1%, 2%, 5%, 7.5%, 10%, 12.5%, 15%, or 20% greater than the amount energy consumed to operate the system or device.

Simplicity of design can be an aspect of certain devices/systems OTI. Accordingly, according to certain aspects, the device and/or systems of the present invention lack certain components.

In aspects, the devices and/or systems describe herein lack a "displacer", that is, any component referred to commonly as a displacer in Stirling engine-related technology or functioning in such a manner. In Stirling engine technology, a displacer is a component that operates as a special-purpose piston. In Stirling-type engines, a displacer works to move the gas (working gas) back and for the between the hot and cold exchangers. A displacer in this type of use is, as noted, a piston-like component which comprises space around its outermost edges so as to allow gas or air within the engine to easily move between heated and cooled sections of the engine. In Stirling engine technology, the displacer serves to control when the gas chamber is heated and when it is cooled: when the displacer is in a first position (e.g., near the top of a cylinder in which it resides), most of the gas inside the engine can be heated by an external heat source and allowed to expand. As pressure builds, the power piston, a separate piston in a Stirling engine, is forced upward. When the displacer is in a second position (e.g., near the bottom of a cylinder in which it resides), most of the gas inside the engine is allowed to cool and hence contracts, causing a pressure drop, and making it easier for the power piston to move downward and to compress the gas. In aspects, devices and or systems describe herein lack any component functioning or operating in such a manner or present to accomplish such a function.

In aspects, devices/systems OTI lack any cooling system/component other than the TML, and any cooling that occurs within the device/system takes place only by the means for modulating the temperature of the PG through the dispensing of the TML.

In aspects, the devices and systems OTI lacks rollers or other such mechanical means of reducing friction between the MC and the chamber within which it is positioned (e.g., between the MC and the barrier). In aspects, the devices and systems lack any wedges or similar or equivalent mechanical components other than the movable connector, FSDD, and MRE(s) for communicating movement of the movable component to other parts of the device. In some facets, the devices and systems lack a compression spring, flywheel, or other similar means of storing momentum required to maintain continuous operation of the device. In aspects, the devices and/or systems lack means of storing energy for use within the device to maintain operation other than optionally comprising battery(ies).

In aspects, the devices and systems described herein do not comprise a rotating mixer or means of forcibly mixing TML & PG upon dispensation of a TML into a PG, such mixing being only that which occurs by dispensation through DC(s). In aspects, the barrier (e.g., walls), of the housing of the device comprise(s) no flaps or movable parts, other than that which may be present as a valve. In aspects, the devices/systems of the present invention lack any baffle or fan component. In aspects, the device is non-buoyant; e.g., the device does not float when placed in water.

In aspects, device(s) are comprised in system(s) comprising secondary component(s) outside of the device(s).

In aspects, such secondary components can comprise, but may not be limited to, a LCS (a SLCS), an automated control system, gas tank(s), or any such component which may supplement or enhance the operation of the device or provide for added functionality, increased efficiency, or any one or more of the above.

In aspects, the system described herein is a substantially closed system ("substantially closed" being defined EH). In aspects, the closed system is pressurized such that the pressure is substantially uniform in both the gas and liquid portions of the system prior to operation. Such attempts to balance as much as possible the high pressure of the system (such pressures DFEH) provide for an increased operating efficiency of the system. Accordingly, less energy is required to dispense liquid as a mist into the PG; the dispensed TML is maintained at primarily, generally, substantially the same or the same operating pressure as the PG into which it is dispensed. In aspects, the system can maintain its pressure without the need for re-pressurization, for extended periods of time as DEH.

In aspects, secondary component(s) comprise power-generating device(s)/component(s) that receives energy from the device and uses it to generate power. In aspects, the power-generating device receives energy from the device and uses the received energy to generate electricity. Such a conversion can be any conversion methods or means as has been previously described. In aspects, the system is capable of receiving and relaying electricity generated by the device and optionally comprises a secondary component for generating electricity from work performed by the device.

In aspects, as DEH, the system has an energy production capacity of at least 10 kW, an average energy output of at least 7.5 kW, or an energy production capacity of at least 10 kW and an average energy output of at least 7.5 kWh. In aspects, the system is capable of generating the average energy output whenever there is a temperature differential of about 5° C. or more between the first temperature input (T1S) in contact with the first portion of liquid (T1L) of the LCS and the second temperature input (T2S) in contact with the second portion of liquid (T2L) of the LCS, or between the TML dispensed from the one or more dispensers of the device in alternating fashion. In aspects, the system is able to generate the average energy output whenever there is a temperature differential of about 1° C. or more between T1S and T2S, or between T1L and T2L dispensed from the one or more DCs of the device in alternating fashion.

According to embodiments, the system is capable of being connected with one or more additional devices or systems having the characteristics described herein, or to a power generating system unrelated to the systems described herein. In aspects, such an unrelated system could be, for example, a coal, nuclear, hydro, wind, solar, or other type of energy production system. For example, a system of the present invention can be connected to a solar production system or a wind-powered system or a hybrid engine of a vehicle. In aspects, such a connection facilitates the expansion of the total amount of power production.

According to aspects, secondary component(s), device component(s), or both, can be designed to be specifically mated to other device/system component(s). In aspects, such components can be designed to only be mated to the device of the present invention and not to other devices. In aspects, the device of the present invention is designed to be inoperable unless it mated with a secondary component designed to be mated with the device; for example, the device of the present invention can be designed so as to not be capable of mating with similar such devices, such as for example those made as counterfeit or genericized products. In aspects, such preferable mating between the device and secondary components of the system can be controlled by the presence of one or more indicators on a secondary component and the device which can communicate to the device or a component of a system (e.g., to a controller or PU) that the secondary component is suitable for use. In aspects, one such indicator is a radio frequency identification (RFID) tag or an identifier having similar characteristics. In aspects, secondary components can comprise an RFID tag which controls operability & non-operability of the device/system, the device and secondary component(s) designed to be paired with other component(s) comprising a compatible tag and only operable therewith.

In aspects, system(s) comprise SLCS(s) comprising T1S, T2S, or both T1S & T2S input(s) (or even more input(s)). In aspects, input(s) comprise environmental condition(s). Such condition(s) can be, for example, a surface (above ground) or subterranean body of water, a surface or subterranean body of air, or a subterranean location (e.g., a subterranean location not comprising a body of water or air).

In aspects, T1S, T2S, or other inputs comprise a waste stream, such as a waste stream from one or more processes otherwise unrelated to the system/device. In aspects, such a waste stream can be a relatively warm or hot waste stream (e.g., excess heat generated from a manufacturing process or energy production process, or e.g., from the operation of an engine such as an automobile engine) or a relatively cold waste stream, e.g., from a process which has extracted heat and cold waste is generated. In aspects, an LCS can comprise one or more temperature inputs which is a naturally occurring environmental condition and one or more temperature inputs which is a waste stream.

In AOTI, a device/system is operable when inputs (e.g., T1S & T2S) have a temperature differential of at least about a fraction of a degree, such as ≥~ a half of a ° C., ≥1° C., ≥~2° C., ≥~3° C., ≥~4° C., ≥~5° C., ≥~6° C., ≥~7° C., ≥~8° C., ≥~9° C., or, e.g., at least 10° C., over a period of at least 1, 2, 4, 6, 8, 10, 12, 15, 18, or 24 or more hours.

According to aspects, a liquid conducting system (LCS) of devices/systems comprise source switch(es) (SS(s)). In certain facets, the SS can be a valve. In aspects, the valve can be located between a connected LCS (aka SLSC) and at least one DC of a device. In aspects, such a SS allows system to be operable when the gradient of temperature difference between the first temperature and second temperature inputs, e.g. T1S & T2S, in contact with the first and second portions, e.g., T1L & T2L, of the LCS input reverse. In aspects, a LCS can comprise a SS for changing connection between dispensers of the device and the LCS, such that the $1^{st}$ portion of the liquid from the LCS can be switched to receiving the 2nd portion of the liquid from the LCS and a component of the device receiving the 2nd portion of the liquid from the LCS can be switched to receiving the $1^{st}$ portion of the liquid from the LCS.

According to aspects, the systems described herein can comprise a secondary component comprising an automated control system (e.g., PU(s)). In aspects, such an automated control system ("ACS") can facilitate the automated operation of the device and/or system or component(s) thereof, thus, e.g., manual intervention in operation is not necessary under most, generally all, or at least substantially all conditions/situations.

In aspects, an ACS may further comprise at least one PU, at least one automated control, at least one data processor, or any combination thereof whereby at least one component, action, function, process, state/condition, or result/output of the system/device or operation can be monitored and/or controlled without human intervention, or data collected resulting from monitoring of any at least two or more of a component, action, function, process, or result from the system or system operation can be processed into monitorable and/or actionable data. In aspects, any one or more such units or processors can be combined to form a unit which may be referred to as a central processing unit ("CPU"). In aspects, PU(s) or a CPU can operate cooperatively with sensor(s), such that data from the one or more sensors can be an input to such an ACS. According to certain aspects, a controller, e.g., a microcontroller can be present in the device/system and can turn motors of, for example, a pump, on and/or off at different times, providing a more nuanced control over such operation. In aspects, such controllers are under the control, at least part of the time, of PU(s)/CPU.

In aspects, such an automatic control system can aid in determining whether there is enough net gain to operate the system, performing ongoing calculations of net energy consumption and net energy gain facilitating continuous performance evaluation. In aspects, if a system fails to generate a sufficient amount of energy so as to either consume more energy than is produced or fails to produce at least as much energy as a predetermined threshold, the automated control system can direct the shut-down of the system until such time that conditions exist where sufficient energy can be produced to either produce more energy than is consumed in operation or to produce at least as much energy as a predetermined threshold; at which time, in aspects, the automated control system can direct the system to resume operation.

In aspects a secondary component of a system described herein can comprise PG tank(s). In aspects, such a one or more gas tanks may be utilized upon system start up to provide the system with a suitable amount of a pressurized gas, but due to the closed nature of the system may be used relatively infrequently thereafter, as has been described elsewhere herein. In aspects, the one or more gas tanks can comprise the gas used as the PG of the system, such as, e.g. $N_2$ gas.

Another AOTI are methods of transforming low temperature differentials into work using devices and systems DEH.

In certain embodiments, the invention is a method of transforming a temperature differential into work comprising: (a) providing (i) a liquid held within a closed system, (ii) an enclosed movable component (MC), and (iii) a pressurized gas (PG) held within the closed system divided into a first and a second volume separated by the MC such that the MC partially defines two void spaces (IVSs) each having a length that is at least 7.5% of the length of each of the first and second volumes; (b) exposing one portion of the liquid within the closed system to a first condition having a first temperature and a second portion of the liquid within the closed system to a second condition having a second temperature to cause a first portion of the liquid to have a first temperature and a second portion of the liquid to have a second temperature; (c) establishing a closed system pressure before regular operation wherein the pressure of the liquid having a first temperature and a second temperature is substantially the same as that of the pressurized gas; and (d) causing a first portion of the liquid and a second portion of the liquid to contact at least a first volume of the pressurized gas in alternating fashion in sprayed droplet form such that a difference in temperature between the first volume of gas and the second volume of gas is created, causing a pressure differential on opposing sides of the MC, and hence causing the MC to move, wherein the system maintains operability if the first and second conditions change, e.g., the warmer of the two conditions becomes the colder of the two conditions and the colder of the two conditions becomes the warmer of the two conditions. In aspects, such a method can be conducted using any one or more devices, systems, or devices or systems having the operational characteristics of the devices and/or systems described herein.

In aspects, at least one of the 1st or 2nd conditions, e.g. at least 1 of the T1S & T2S, is an environmental source/condition. In one aspect, the 1st & 2nd conditions are environmental sources/conditions. In aspects, the $1^{st}$ or $2^{nd}$ condition(s) is a body of air. In aspects, the $1^{st}$ or $2^{nd}$ condition(s) is a body of water. In aspects, ≥1 of the 1st and $2^{nd}$ conditions is a waste stream. In aspects, both are waste streams.

In aspects, the method is capable of continually producing power when the temperature differential between the first condition and the second condition is as low as about 15° C., such as low as ~10° C., ~8° C., ~6° C., ~4° C., ~2° C., or as low as about 1° C.

In aspects, the method is capable of continually producing power under circumstances wherein at least one of the first or second conditions is an environmental condition and the first and second conditions reverse their relative temperatures, e.g., conditions wherein the once warmer of the two conditions becomes the cooler of the two conditions and the once cooler of the two conditions becomes the warmer of the two conditions. In aspects, such a reversal of conditions can happen one or more or two or more times during a 24-hour period. In aspects, the method is capable of operating continuously for at least about 50% of a 24-hour period, such as at least about 55%, ≥~60%, ≥~65%, ≥~70%, ≥~75%, ≥~80%, ≥~85%, ≥~90%, or e.g., at ≥95% of a 24-hour period.

According to embodiments, the liquid (TML) contacts the pressurized gas (PG) by being dispensed as a mist into the PG. In aspects, the liquid is dispensed through one or more dispenser components (DC(s)) capable of converting the liquid from a flowing liquid into a mist. In aspects, the mist has a suitable droplet size so as to effectuate a temperature change of the PG into which it is dispensed and to create a T1ΔT2 across the chamber sufficient to cause movement of the MC upon each dispensation of the mist (e.g., within the times DEH).

In aspects, the droplets of the mist dispensed as part of the method comprise a Volume Median Diameter (VMD) of between about 25 μm and about 150 μm, e.g., between about 30-90 μm, or e.g., between about 40 μm and about 80 μm. In aspects, the droplets of the mist dispensed as part of the method have a DV0.9 value of between about 50-about 90 μm, such as between about 60-about 80 μm, or for example about 70 μm.

In aspects, the mist dispensed in the methods described herein is mist from a first portion (e.g., T1L) and a second portion (e.g., T2L) of liquid, alternatingly dispensed such that each makes contact a single volume of PG in alternating sequence on the same side of the movable component.

In aspects, the methods described herein comprise dispensation of a volume of TML into the PG capable of modifying the temperature of the PG into which it is dispensed sufficiently to cause a PG pressure differential and hence movement of the MC. In aspects, the volume of TML dispensed into the PG in such methods is capable of sufficiently and adequately (e.g., quickly as is described elsewhere herein) modifying the temperature of the PG to approximately three quarters (¾), or 75%, of the temperature of the TML. In aspects, while methods comprising modifying the temperature of the PG to a temperature closer than 75% of that of the TML can continue to maintain operability of the system, heating or cooling the PG beyond that of ¾ of that of the TML can decrease system/device efficiency; e.g., more energy can be consumed in the process of narrowing the temperature differential between the TML and the PG than may be obtained from the work produced by such a reduction in temperature differential. In aspects, the device/system can be operated by methods comprising a volume of TML dispensed into the PG which modifies the temperature of the PG to less than approximately ¾, or 75%, of the temperature of the TML. In such circumstances, the method may produce less work than a method in which the PG is raised to approximately ¾ of that of the TML.

According to certain embodiments, if an alternating cycle of dispensing first and second portions of liquid of a device or system of the methods described herein fails to repeat, e.g., failure of the MC to move a minimum distance (minimum stroke distance), failure of the method to produce a minimum amount of work, or both failure of the MC to move a minimum distance and failure of the method to produce a minimum amount of work, as may happen for example when the temperatures of T1L and T2L fail to have a minimum T1ΔT2, the method can comprise restarting the system by exposing one portion of the liquid (e.g., T1L) to at least a first volume of the PG. In certain facets, the exposure forces the MC to move a minimum distance, forces the method to resume production of a minimum amount of work, or forces both the MC to move a minimum distance and the method to resume production of a minimum amount of work.

In aspects, the exposure of one portion of the liquid to at least a first volume of PG can be by automated, manually controlled, or optionally automated or manually controlled means such that the MC is forced to move a minimum distance, the method resumes production of a minimum amount of work, or both the MC is forced to move a minimum distance and the method resumes production of a minimum amount of work. In aspects, the same one or more dispensing components (DCs) used to alternatingly dispense first and second portions of liquid can be used to dispense a TML, e.g., either T1L or T2L, to restart the system within the methods described EH. In aspects, a separate DC can be used to dispense a TML to restart the system. In aspects, a method OTI comprises an automated system restart, lacking human intervention, if a cycle fails to repeat. Per aspects, methods OTI comprise exposure of portion(s) of TML to at least a first volume of the PG which occurs in an automated fashion, without human intervention, when a minimum stroke distance, a minimum power output, or minimum stroke distance and minimum power output parameter fails to be met.

Methods described herein can be, in aspects, such that in use, the gas used in such a method substantially remains in the same relatively distinct location or locations within the devices and/or systems utilized in the method, thus, e.g., they do not pass from one relatively distinct location within a device or system to another. In aspects, in application of the method, gas is not forced to pass through a path comprising angles to move from one location to another, e.g., it does not pass through a tortuous route from one chamber, container, housing, or otherwise distinct location to another. In aspects, any movement or flow of gas within the closed system in regular operation is substantially in the same orientation.

According to certain aspects, the present invention comprises a method of energy production capable of producing at least about 5 kW of energy, such as ≥~6 kW, ≥~7 kW, ≥~8 kW, ≥~9 kw, or ≥~10 kW, of energy, such as ≥~12 kW, ≥~14 kW, ≥~16 kW, ≥~18 kW, or at least about 20 kW of energy. In aspects, such energy production capabilities can be even higher, such as for example at least about 40 kW, ≥~60 kW, ≥~80 kW, or ≥~100 kW can be produced by methods OTI.

In some facets, the present invention describes a method of energy production capable of producing an average energy output of at least about 3 kWh, such as ≥~3.5 kWh, ≥~4 kWh, ≥~4.5 kWh, ≥~5 kWh, ≥~5.5 kWh, ≥~6 kWh, ≥~6.5 kWh, ≥~7 kWh, ≥~7.5 kWh, ≥~8 kWh, ≥~8.5 kWh, ≥~9 kWh, ≥~9.5 kWh, or at least about 10 kWh or even more, such as an average energy output of at least 12 kWh, at least 14 kWh, at least 16 kWh, at least 18 kWh, at least 20 kWh, or even more.

In aspects, the methods described herein utilize devices and systems described herein which are pressurized, e.g., the gas, liquid, or gas- and liquid-containing portions of the system are pressurized, upon system start up. In aspects, to maintain operability, re-pressurization of the gas, liquid or gas- and/or liquid-containing components used in the methods described herein need occur no more than the earlier of a) the lifetime of the first expiring system seal (e.g., about 6 months, ~1 year, ~1.5 years, ~2 years, ~2.5 years, or ~3 years), or b) a point in time wherein the system loses at least about 5% of its pressure when the system is in continual operation, such as about once (1×) per month, 1× every ~2 months, lx every ~4 months, 1× every ~6 months, 1× every ~8 months, 1× every ~10 months, 1× every ~1 year, 1× every ~1.5 years, 1× every ~2 years, lx every ~2.5 years, or for example once every ~3 years.

In aspects, the methods described herein comprise operational steps which are mechanically linked. According to certain embodiments, the methods described herein comprise an energy production process wherein sufficient movement of the MC in either a first or a second direction causes dispensation of a portion of liquid in the form of a mist into at least a first volume of the PG, the movement of the MC in a first direction causing dispensation of the liquid having a first temperature (e.g., T1L) and the movement of the MC in a second direction causing dispensation of the liquid having a second temperature (e.g., T2L). In aspects, sufficient movement of the MC is movement of at least about 5%, such as ≥~6%, ≥~7%, ≥~8%, ≥~9%, or at least about 10% of the maximum distance it could travel in any one direction when the system is producing at least its average amount of power output (maximum stroke distance in any one direction). Alternatively, in aspects the methods described herein comprise operational steps which are not mechanically linked, such as for example aspects of the method wherein dispensation of the liquid is actuated by a mechanism not mechanically linked to the movement of the movable component (e.g., it is dispensed via automated control(s)).

In aspects, the methods of energy production described herein do not comprise any step involving the displacement of a PG, e.g., through the use of a displacer to move a gas from one distinct location within a device or system of the method to a different distinct location within a device or system of the method; do not comprise a step of using stored energy to sustain the method; do not comprise a step of actively cooling a component or system partaking in the method to maintain operability beyond that which occurs from the alternating dispensation of liquid; or any combination of any or all thereof.

In certain facets, methods OTI comprise use of one or more pumps, such as for example one or more rotary pumps, to initiate, maintain, or enhance the dispensation, e.g., spraying of TML, as droplets of liquid (e.g., a mist) into the PG; to conduct liquid through a temperature modulation system or a LCS; or any combination of any or all thereof.

The methods of work (e.g., energy) production described herein can in aspects comprise monitoring component(s), operation(s), or process(es) of a method. In aspects, the method comprises monitoring the temperature difference between the first volume of PG and second volume of PG and automatically pumping TML in response to pre-programmed conditions (e.g., differences in such temperatures). In aspects, a preprogrammed condition can be or can relate to one or more temperature(s), pressure(s), passage(s) of time, a repositioning or movement of a component, an energy demand, an energy supply, or any condition relevant to the conduct of the methods described herein.

In aspects, methods OTI comprise converting the movement of the MC into electrical energy. In aspects, the conversion of the movement of the MC into electrical energy is accomplished via a power off-take component which is a component of a device used in the method. In aspects, the conversion of the movement is accomplished via a power-off-take component which is a component of a system used in the method.

In aspects, devices/systems comprise automated component(s)/system(s). In aspects, devices/systems or components thereof comprise electronic operation control component (OCC(s)). In aspects, an OCC comprises an electronic control unit (ECU) for collecting data from one or more points in a device and/or system and for relaying data to other components of an OCC such as a processor unit. In aspects, the processor unit is a part of the ECU. In aspects, the ECU comprises at least one data collection unit (DCU), means for relaying temperature information data from the DCU, and a processor unit.

In aspects, an automated system comprises pressure sensor(s), means for relaying pressure sensor information to PU(s)/CPU, and the processor(s) comprises preprogrammed instructions for evaluating pressure data against standard(s) to determine if pressure problems exist in the device. In aspects, the OCC can address variables within a device or system such as both temperature and pressure. In aspects, processor(s) control component(s) (e.g., DC(s), pump(s), etc.). In aspects, processor(s) signal alarm(s) (e.g., audio, visual, or digital alarms sent to interface(s)).

In aspects, the DCU of an ECU of an OCC stores and executes instructions to receive data from one or more sensors. In aspects, the DCU stores and executes instructions to receive primary and secondary temperature data from one or more sensor(s) of the device that correspond to a first temperature and second temperature. E.g., a first temperature can be a temperature of a body of PG prior to having a TML applied and a second temperature can be a temperature of the same body of PG after having a TML applied and prior to the next dispensation of TML. In aspects, such collection or receipt of data can occur at preprogrammed measurement intervals during an operation cycle comprising periods of device operation and intervening periods (e.g., periods when the device and/or system is not in operation, such as for example during periods where T1ΔT2 is unsuitable for device or system operation). In certain aspects, such preprogrammed measurement intervals are timed intervals, e.g., intervals of ~1, ~2, ~3, ~4, ~5 seconds. In aspects such intervals are longer than ~5 seconds, such as intervals of ~6, ~7, ~8, ~9, ~10, ~15, ~20, ~25, or for example ~30 seconds or even longer, such as intervals of about every 45 seconds, ~1 minute, ~1.5 minutes, ~2 minutes, ~2.5 minutes, ~3 minutes, ~3.5 minutes, ~4 minutes, ~4.5 minutes, ~5 minutes, or even longer. In aspects such intervals are intervals of a fraction of a second, such as intervals ≥~0.9 seconds, ≥~0.5, ≥~0.1, ≥~0.09, ≥~0.05, ≥~0.01, ≥~0.009, ≥~0.005, ≥~0.001, ≥~0.0009, ~0.0005, ≥~0.0001 seconds, or less.

In certain aspects, the DCU of an ECU of an OCC can store and execute instructions to receive primary and secondary temperatures from sensors and each sensor can receive such data at the same or different intervals or in response to the same or different conditions. In aspects, processor(s) receive signal(s) from sensor(s) in relatively short intervals, e.g., intervals of ≥1 second such as when monitoring the temperature of a PG. In aspects, it may be sufficient to receive data in longer intervals, e.g., intervals of 30 seconds or 1 minute or more, such as when monitoring the temperature of a temperature input (such as T1S or T2S, or T1L or T2L).

In aspects, a DCU can store, and in aspects share, collected data with at least one data processing device, e.g., a processing unit (PU) as described EH. In such aspects the DCU works cooperatively with one or more other components for successful automatic operation of the automated systems DH. In aspects, one or more data collection unit(s) of the system can be (an) integral component(s) of one or more sensor(s).

In aspects the ECU, in addition to DCU(s), comprises a means for relaying data, such as pressure or temperature data from the DCU. In aspects, the means for relaying such, e.g., pressure or temperature data from the DCU can be any means of successfully sharing information data from one point to another including but may not be limited to parallel transmission, serial transmission (including synchronous or asynchronous transmission), wireless communication channel(s), or the like, and data may be represented as, e.g., an electromagnetic signal such as an electrical voltage, microwave, radio wave, or infrared signal or the like. In aspects, temperature information data can be encrypted. AOA, the temperature information data may not be encrypted.

In aspects, in addition to DCU(s) and at one least data relay mean(s), a device/system comprises an ECU comprising one or more processor units (PU(s)). In aspects, a PU is a part of a device/system OTI. In aspects the processor unit is located remotely from the device, such as at short or long distances from the device or system, e.g., within a matter of inches/centimeters, a matter of feet, within a matter of yards/meters, or within a matter of miles/kilometers, such as 1-5 miles (1.6-8 km), 1-10 miles (1.6-16 km), 1-25 miles (1.6-40.2 km), 1-50 miles (1.6-80.5 km), 1-75 miles (1.6-120.7 km), or 1-100 miles (1.6-160.9 km) or more, such as across cities, across counties, or across states, administrative divisions, provinces, or their equivalents, or even across countries.

In aspects the processor unit comprises at least one unit capable of receiving the data relayed from the DCU. In aspects the processor unit capable of receiving data relayed from the DCU is capable of receiving data received by parallel transmission, serial transmission (including synchronous or asynchronous transmission), wireless communication channel(s), or the like, and receiving data represented as, e.g., an electromagnetic signal such as an electrical voltage, microwave, radio wave, or infrared signal or the like. In aspects, the processor unit can receive and interpret encrypted data. AOA, the processor unit can receive, data that is not be encrypted.

In aspects, PU(s) further comprise means for storing and executing instructions relevant to the operation of the device/system or components thereof (e.g., a computer or device comprising microprocessor(s) that can run suitable software for receiving, analyzing, displaying, relaying, or acting on sensor input(s), e.g., comprising controlling the operation of component(s) of the system/device). In aspects, such instructions can be instructions for determining the relationships between the difference in two values to a predetermined threshold, e.g., a difference between a primary and secondary temperature (e.g., such a first action of the processor can be to mathematically calculate a T1ΔT2) and an intermittent off period threshold (e.g., such a second action of the processor can be to mathematically calculate the difference between the calculated T1ΔT2 and a predetermined threshold). In aspects such a threshold can be a pre-determined T1ΔT2 threshold at which it has been determined that operating the device or system is e.g., unsuitable, non-preferable, suboptimal, or impossible.

In aspects, when the device or system is in a non-operating state (e.g., upon system start up or after a pause in operation due to unsuitable operating conditions), PU(s) can execute stored instructions for initiating operation of DC(s) to reinitiate the device/system after conditions meet pre-programmed conditions and the instructions indicate that system re-initiation should occur. Such instruction can be, e.g., to operate one or more pumps, to dispense a volume of T1L or T2L into a volume of PG, or for example to both operate pump(s) and to dispense a volume of a TML.

In aspects, PU(s) can comprise stored instructions to automatically stop, via automated execution of such stored instructions, pumping liquid into a DC when the T1ΔT2 between the first portion (e.g., T1L) and second portion (e.g., T2L) of a TML falls below a predetermined threshold, and automatically begins pumping liquid to a DC when the T1ΔT2 between the first portion (e.g., T1L) and second portion (e.g., T2L) of a TML meets or exceeds a predetermined threshold, based on its analysis of the data collected/received and the stored instructions. In aspects, the T1ΔT2 threshold for device/system operation can be 1° C. as DEH.

In aspects, the processor unit operates one or more T1L/T2L switches, aka fluid switch(es), of the device (or AOA a T1L/T2L switch present in a system in which the device is one component) and the processor unit stores and executes instructions for operating a T1L/T2L (fluid) switch. In aspects, instructions for operating a T1L/T2L switch can comprise algorithms for calculating system status parameters and acting upon such calculations (e.g., calculating one or more T1ΔT2 values). In aspects, instructions for operating a T1L/T2L (fluid) switch can comprise receipt, analysis, and execution upon data related to time intervals, according to which the processor unit instructs the T1L/T2L (fluid) switch to dispense T1L or T2L based on timed dispensation intervals.

In aspects, PU(s) (ORT as "processor(s)") stores and executes algorithm(s) capable of establishing a dispensation gap (a gap in time between the completion of dispensation of TL1 and the start of dispensation of TL2) for primarily all, generally all, substantially all or all of the strokes of the MC during regular operation. In aspects, the processor controls operation of components or actions of one or more device and/or system components participating to create the dispensation gap, such as for example the processor can control TML dispensation timing (such as for example by controlling a T1L/T2L switch or the operation of one or more pumps), movement of the MC (e.g., directly or indirectly), movement of a movable connector, movement of a FSDD, and the like.

In aspects, the processor comprises means for storing, retrieving, and further processing any of the data received in an operating cycle of the device. In aspects such data could be received from a device or system described herein, including but not limited to T1L, T2L, T1S, T2S, timed intervals, pressure of PG in any specific location within a device or system, work or energy production, or the like and processing of any combination of such data. In aspects, such data could be received from an source not directly related to a single operating device or system, such as from a connected device or system (e.g., when devices or systems of the present invention are connected to increase power generation capabilities as DEH), or an external source, such as an external system or device waste generator, a weather station, an internet source, data provided via human input, external sensors such as environmental temperature, light, pressure, or other types of sensors, energy consumption reports or calculations (e.g., when a device or system is utilized to operate a device such as a car or a facility (e.g., a home or building) wherein energy is being drawn from the device or system as it is being produced), or other such data sources impacting or directing the operation of a device or system or otherwise providing context to an operator related to the environment in which the device or system is being operated.

Figure 12:
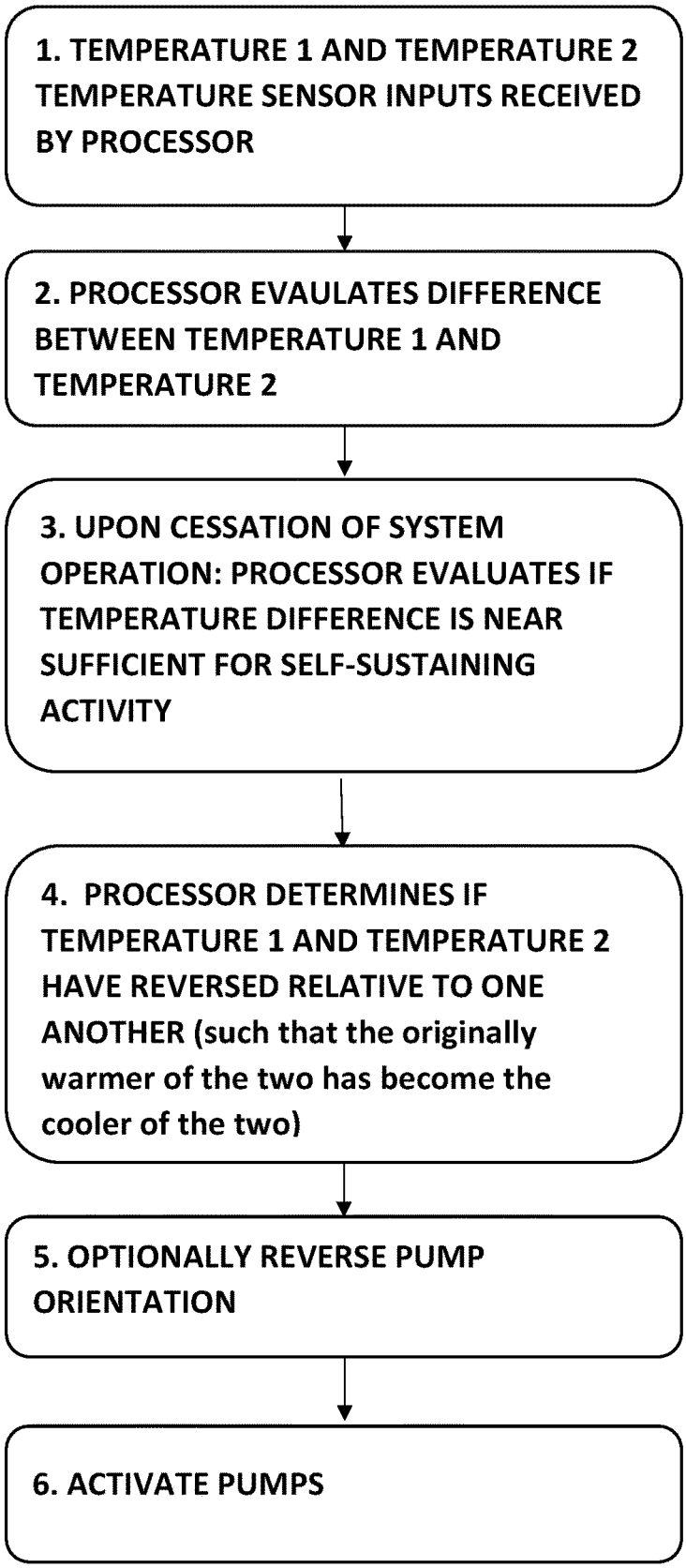
FIG. 12 is a flow chart illustrating one embodiment of the operation of the devices described herein using an electronic control system.

An exemplary automated system is illustrated by the flow chart of FIG. 12. In aspects, (1) $1^{st}$ & $2^{nd}$ temperature sensor inputs are received by a PU; (2) the processor evaluates the T1ΔT2; (3) upon cessation of system operation, the processing unit (processor) evaluates if T1ΔT2 is near sufficient for self-sustaining device/system activity; (4) processing unit (processor) determines if the first and second temperatures have reversed relative to one another, e.g., the originally warmer of the two has become the cooler of the two); (5) optionally reversing the orientation of one or more pumps; and (6) activating the pumps.

Figure 13:
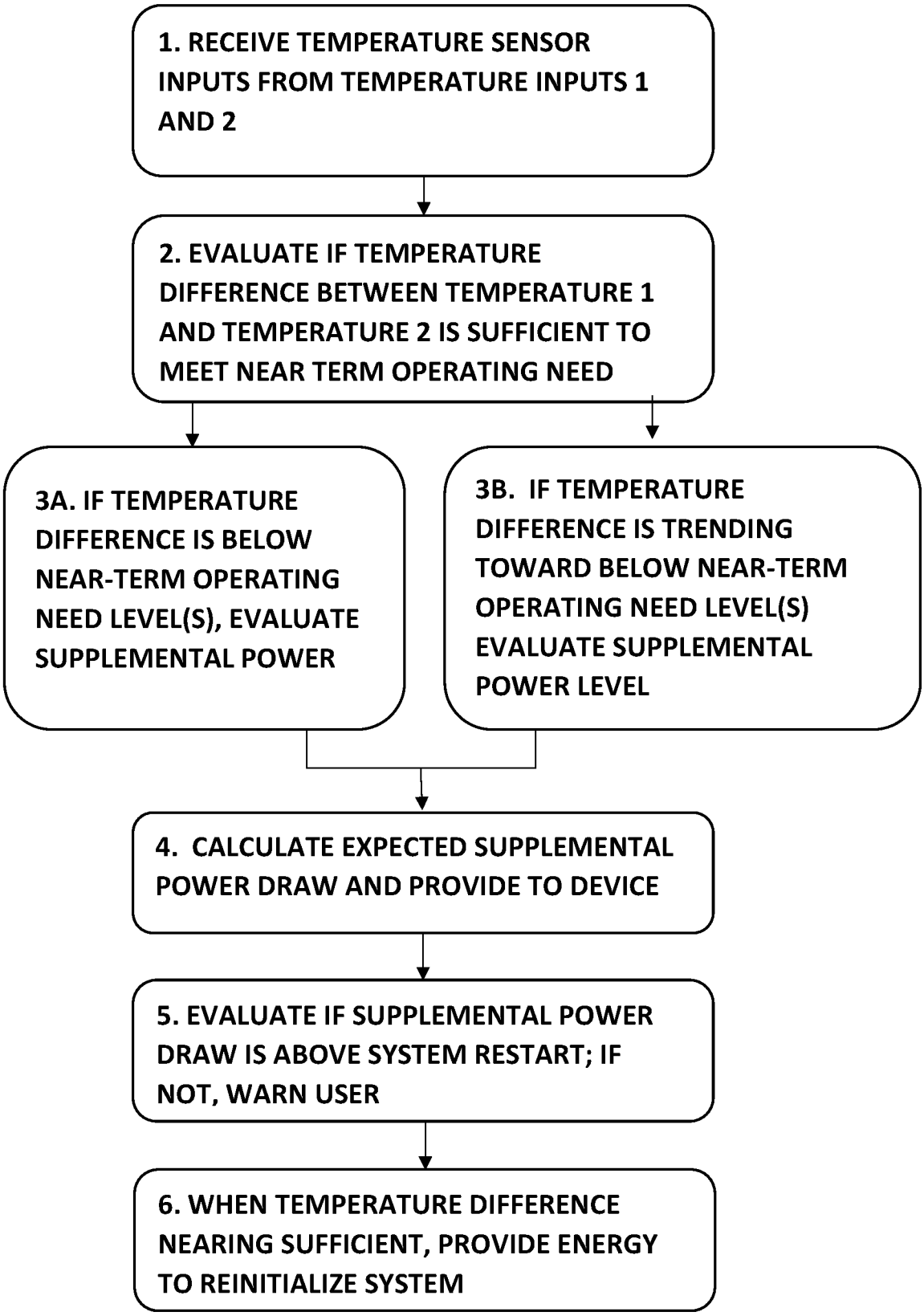
FIG. 13 is a flow chart illustrating one embodiment of the operation of a system comprising an associated powered device (e.g., a car waste heat system) and an electronic control processor.

FIG. 13 provides another exemplary embodiment of an automated control system (electronic control unit (ECU)) comprising an associated powered device. In this embodiment, the associated powered device is a car waste heat system. In this exemplary aspect, (1) the ECU receives temperature sensor inputs from first and second temperature inputs; (2) the ECU evaluates if T1ΔT2 is sufficient to meet near term operating needs; (3A) if T1ΔT2 is determined to be below near term operating need level(s), evaluating supplemental power or (3B) if T1ΔT2 is trending toward below near term operating need level(s), evaluating supplemental power levels; (4) calculating expected supplemental power draw and providing such calculated requirements to the device; (5) evaluating if the supplemental power draw is above system restart thresholds; if not, providing a warning to the user; (6) when the T1ΔT2 is nearing sufficient, providing energy to reinitialize/restart the system.

In aspects, an automated system comprises a device that comprises means for measuring movement of the MC, means for relaying the movement measurement data to the processor (e.g., processing unit), and the processor comprises instructions for evaluating the movement information to the expected movement of the moveable component based on the primary temperature and secondary temperature data.

In aspects means for measuring movement of the MC can be a motion detector, a mechanically operated switch, a motion-initiated boundary trigger such as a light or laser, a camera with associated visually-based distance calculation algorithms, or the like.

In aspects, the means for relaying the movement measurement data to the processor can be any means, such as data transmitted by parallel transmission, serial transmission (including synchronous or asynchronous transmission), wireless communication channel(s), or the like, and receiving data represented as, e.g., an electromagnetic signal such as an electrical voltage, microwave, radio wave, or infrared signal or the like. In aspects, the processor unit can receive and interpret encrypted data. AOA, the processor unit can receive, data that is not be encrypted.

In aspects, instructions stored by the processor (e.g., processing unit) for comparing or evaluating the movement information of the MC to the expected movement of the MC comprises utilizing the primary temperature and secondary temperature data. In aspects, expected movement of the MC is determined based on the T1ΔT2 of the PG pre- and post-TML dispensation, e.g., upon each operating cycle, or T1L and T2L. In aspects the actual movement of the MC is compared to such an expected movement, and if movement of the MC is not sufficiently comparable to that of the expected movement of the MC according to a predetermined threshold, the processor can in aspects provide an alert to or AOA direct the automatic shutdown of a device or system.

In aspects, the system comprises a viewable user interface that allows a human operator to observe the status of one or more of the temperature(s), pressure(s), or movement(s) monitored conditions of the device/system. In aspects, such an interface can provide the user with raw data, the results of data calculations, trend data, device or system alerts generated by the processor, related system or operational data, or any internal or external data selected for being viewable to a user via such an interface. In aspects the interface is a computer monitor (e.g., desktop or laptop monitor). In aspects the interface is a mobile device such as a smart device (e.g., a smart phone or pad device). In aspects data is presented via a software interface. In aspects data is presented via a web page or web-based application. In aspects data is presented via a locally stored application. In aspects, the user interface is an interactive interface component. In aspects, the interactive interface receives instructions from a user on changing operating parameter(s) of the device or component(s) (e.g., amount of dispensed TML; frequency of dispensation; forced operation of pump(s); dispensation gaps(s), modifying, adding, or deleting a gap in time between the completion of an SL by an MC before a TML is dispensed; or combinations of any or all thereof). In aspects, the interface may provide options for alerting the user to certain conditions and provide the ability for a user to respond to such alerts, e.g., to take action to resolve a suboptimal operating condition to resolve a mechanical issue, or the like, such as for example by directing the processor to take a specific action (e.g., to initiate a pump or to shut down the system).

In aspects, a complex comprising a system having any of the characteristics, features, and operational capabilities DEH is provided, in which the system/device comprises a power-generating device or component and a secondary power source, where the device/system and secondary power source provide power to an associated powered apparatus, structure, or network (e.g., an appliance, automobile/vehicle, building such as a house, facility, etc.). In aspects, the complex can comprise an electronic sensor network comprising a plurality of DCUs, such as a first, a second, and a third DCU, the characteristics of such DCUs being any one or more characteristics of a DCU DEH. In aspects, one or more DCUs store and execute preprogrammed instructions to receive inputs, such as pressure or temperature inputs. In aspects, such temperature inputs can be primary and secondary temperatures from one or more sensor(s) of the device corresponding to a first temperature and second temperature at preprogrammed measurement intervals during an operation cycle, such an operation cycle comprising periods of device operation and intervening periods. In aspects, one or more DCUs can collect the available energy in the second power source. In aspects, one or more DCUs collect the anticipated energy demand of the apparatus, structure, or network.

In aspects, the complex comprises means for relaying information signals from a plurality of DCUs, such as from a first, second, and third DCU. In aspects, means for relaying such information signals, e.g., pressure or temperature data, available energy in a second power source, or anticipated energy demand of an apparatus, structure, or network, from a DCU can be any means of successfully sharing information data from one point to another including but may not be limited to parallel transmission, serial transmission (including synchronous or asynchronous transmission), wireless communication channel(s), etc., and data may be represented as, e.g., an electromagnetic signal such as an electrical voltage, microwave, radiowave, or infrared signal, etc. In aspects, temperature information data can be encrypted. AOA, the temperature information data may not be encrypted. In aspects, one or more DCUs can relay information signals to one or more processors (e.g., to one or more processing units).

In aspects, the complex comprises an electronic programmable complex control unit (EPCCU). In aspects, the EPCCU receives the information signal(s) from one or more DCUs and stores data. In aspects the EPCCU executes preprogrammed instructions for directing energy from the system or a second power source to the apparatus, structure, or network. In aspects, which preprogrammed instructions are executed depends on the differences (calculated by e.g., a processor, e.g., a processing unit) between the primary temperature and secondary temperature, the energy needs of the apparatus, structure, or network, and the amount of energy in the second power source. In aspects, for exemplary purposes, if a T1ΔT2 is incapable of supporting sufficient power production to meet the needs of an apparatus, structure, or network, then for example the EPCCU could direct the initiation of a secondary power source, the bringing online of a second power production system, the shutdown of a device or system, or the modification of one or more modifiable operating parameters.

In aspects, the complex comprises a viewable user interface. In aspects the interface can be any interface that allows a human operator to observe the status of operational aspects of the complex, e.g., specifically the primary temperature and secondary temperature, the energy level of the second power source, the anticipated energy need of the apparatus, structure, or network, or a combination thereof. In aspects such an interface is a computer monitor (e.g., desktop or laptop monitor). In aspects the interface is a mobile device such as a smart device (e.g., a smart phone or pad device). In aspects data is presented via a software interface. In aspects data is presented via a web page or web-based application. In aspects data is presented via a locally stored application. In aspects, the user interface is an interactive interface component. In aspects, the interactive interface is capable of receiving instructions from a user on changing one or more of the operating parameters of the device (e.g., amount of dispensed liquid; frequency of dispensed liquid; forced operation of pumps; dispensation gap(s); modifying, adding, or deleting a gap in time between the completion of an SL by an MC before a TML is dispensed; or combinations of any or all thereof), changing sourcing of energy from the second power source, or a combination thereof. In aspects, the interface may provide options for alerting the user to certain conditions and provide the ability for a user to respond to such alerts, e.g., to take action to resolve a suboptimal operating condition to resolve a mechanical issue, or the like, such as for example by directing the processor to take a specific action (e.g., to initiate a pump or to shut down the system).

Another aspect of the invention is system(s)/method(s) for producing a device/system OTI. In aspects, such methods/systems comprise the use of an electronic processor unit for designing and in aspects also directing the fabrication of component(s) of such a system. In aspects, as described in FIG. 11, such a system comprises (1) the input of specific device parameters; (2) evaluating whether the inputs are sufficient as entered to provide the required power output; (3) identification of any adjustable variables; (4) either pausing device design to reconsider feasibility if no suitable adjustable variables are identified or alternatively determining variable adjustment constraints of variables identified; (5) determining variable adjustment preferences; (6) adjusting adjustable variable(s) based on adjustment preference or, e.g., cost; (7) repeating adjustment of adjustable variable(s) until desired power is achieved; and (8) directing device production and/or assembly.

In aspects, the invention described herein is a system for fabricating a low temperature differential energy device having any of the characteristics, features, or operational capabilities described herein, comprising entering a required work output for the device to be fabricated to a device design and fabrication processor (DDFP), entering a series of inputs into the DDFP, including characteristics related to device operation and design as well as any existing constraints related to such device inputs, and directing the DDFP to generate an estimated work output that the device is expected to produce based on the inputs.

In aspects the DDFP comprises means for receiving inputs from a user and preprogrammed instructions for analyzing the inputs. In aspects, such means of communicating electronic data can be any one or more means as described EH, e.g., as described for means of a DCU to relay information to e.g., a processing unit (PU).

In aspects, inputs related to the device design entered into the DDFP comprise chamber length; anticipated first temperature; anticipated second temperature; anticipated first gas temperature generated by dispensing first temperature modified liquid (temperature modification liquid, or TML) into the chamber; anticipated second gas temperature generated by dispensing second temperature modified liquid (TML) into the chamber; anticipated chamber pressure; anticipated chamber diameter; and anticipated time between TML injections. In aspects, the system further comprises entering constraints associated with any one or more of the inputs and directing the design and fabrication processor to adjust the variables associated with the inputs based on the constraints. In aspects, such exemplary constraints may be but may not be limited to a limit on the maximum or minimum first or second temperatures (e.g., as dictated by the temperature input sources, maximum or minimum gas temperatures possible from a TML, maximum chamber pressure, space or manufacturing limitation which limit the maximum chamber diameter, and the like.

In aspects, a DDFP system further comprises modulation of variables based on either preprogrammed or inputted criteria to generate a device design anticipated to provide the required work output. In aspects, such modulation can be one or more cycles of variable adjustment. In aspects, upon entry of the inputs, or upon one or more cycles of modifying or adjusting variables (as needed to reach a suitable device design) associated with the inputs based on the constraints also thereto entered, a suitable device design is obtained.

In aspects, a DDFP system further comprises the ability to cause, order, or otherwise initiate the fabrication of one or more components of the device based on the calculated variables. Such fabrication can be local or can be caused, ordered, or otherwise initiated at a distance, such as via communication of such a design to a remote manufacturing facility. In aspects, such fabrication can be directed directly by components of the DDFP system (e.g., PU(s)). AOA, such fabrication can be directed by a secondary facility, with the system providing instructive data or parameter data, such as the parameters for, e.g., component dimension(s).

For example, a DDFP can comprise a processor utilizing any suitable combination of the following eight inputs to generate component(s) of a device for a device with a total amount of work output (in Watts) or to design a device that will provide the total amount of work output: (1) stroke length of piston; (2) temperature of a first portion of liquid (T1L); (3) temperature of a second portion of liquid (T2L); (4) temperature of the gas as modified by the first portion of liquid (T1G); (5) temperature of the gas as modified by the second portion of liquid (T2S) (wherein the differential between the temperature of the first portion of liquid and the temperature of the gas after having experienced heat exchange with the first portion of liquid is the same as the temperature differential between the temperature of the second portion of liquid and the temperature of the gas after having experienced heat exchange with the second portion of liquid); (6) pressure of the system (PG pressure and TML pressure being at least approximately equal in the RFOS); (7) diameter of the movable component (e.g., piston); and (8) the injection time of the liquid into the gas. Such inputs can be entered into a user interface of a DDFP system and an automated calculation can be performed by data processing software.

In aspects, the CPU/PU(s) of such a DDFP system has preprogrammed instructions that allows the system to evaluate, reject, approve, or modify value(s) of such a calculation based on constraints provided by a user, cost of such modification(s), availability of component(s), regulatory requirement(s), or combinations of some or all thereof. In aspects, the PU(s)/CPU making such calculations is preprogrammed with scoring measurements (e.g., +/− point(s) for each possible change) or other calculations that provide the PU(s)/CPU with the ability to calculate and provide possible combination(s) of such variable(s), optionally with associated cost(s), component availability information, and the like, and optionally to further direct the manufacture of component(s) for such a device/system.

For example, in a system in which water is the liquid in the system and nitrogen is the PG, the following inputs can be provided to DDFP to arrive at an expected work/power output, which can be evaluated to evaluate a proposed device against desired output.

INPUT $\Delta L$ = [ . ] INCHES

INPUT $T_h$ = [ . ] K

INPUT $T_c$ = [ . ] K

INPUT $T_{h\ gas}$ = [ . ] K

INPUT $T_{c\ gas}$ = [ . ] K

Note: Ensure $T_h - T_{h\ gas} = T_{c\ gas} - T_c$

INPUT $P_i$ = [ . ] *PSI*

INPUT $D$ = [ . ] INCH

INPUT INJECTION TIME $t$ = [ . ] SECONDS $\Delta T = T_{h\ gas} - T_{c\ gas}$ = [ . ] K $\overline{T} = (T_{h\ gas} + T_{c\ gas})/2$ = [ . ] K $L_i = (2\Delta L\overline{T})/\Delta T$ = [ . ] INCHES $\forall_i = [(\Pi D^2)/4]Li$ = [ . ] INCHES CUBED $\forall_{im} = \forall_i\ (0.016, 387, 1)$ = [ . ] LITERS $P_{im} = P_i(6.894, 760)$ = [ . ] *kPa*

$n = [(P_{im})(\forall_{im})]/[8.31)(T_c)]$ = [ . ] MOLES $K = n(0.000, 006, 957, 5)$ = [ . ]

$\forall_{h_2 0m} = K[(T_{h\ gas} - T_{c\ gas})/(T_h - T_{h\ gas})]$ =

[ . ] METERS CUBED $\forall_{h_2 o} = \forall_{h_2 o m}\ (61, 023.744)$ = [ . ] INCHES CUBED $F = (\Pi D^2/4)P_i(\Delta T/T_{c\ gas})$ = [ . ] *Lbf*

$W = n(8.31)T_{c\ gas}\ \ln(T_{h\ gas}/\overline{T})$ = [ . ] JOULES

POWER = $W/t$ = [ . ] WATTS

A system utilizing inputs other than water may require modification to, e.g., account for the specific heat of the liquid utilized. Persons of ordinary skill in the art will be able, in numerous/most cases without application of undue experimentation, to use such variables in different orders to make calculations relating to component(s) by re-working such calculations and such variables can be preprogrammed into a CPU/PU to provide users with different starting points and outputs for designing the component(s) of devices/systems OTI.

DETAILED DESCRIPTION OF THE DRAWINGS/FIGURES

The figures and following description of aspects OTI provided in connection therewith are provided for the purpose of further illustrating examples of devices & systems OTI and the operation thereof. Such embodiments provided should not be construed as limiting (e.g., figures/components may not be drawn to scale; some elements are provided primarily for illustrating operation (e.g., status indicators 3 and 4, DEH), and several alternative embodiments are within the scope OTI (as also DEH).

Figure 1A:
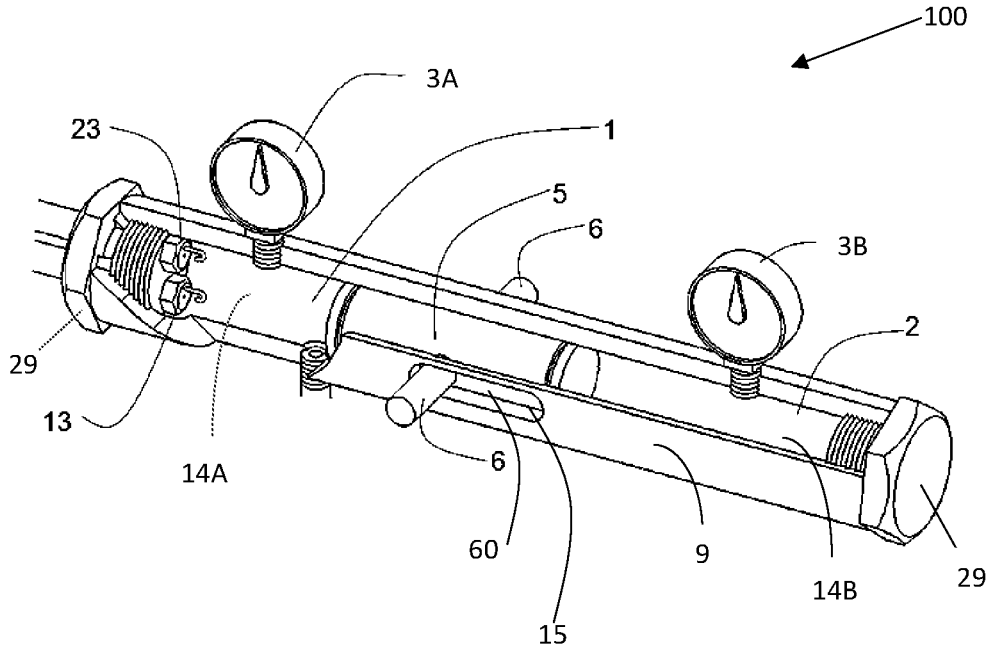
FIGS. 1A-1D illustrate a cylindrical chamber and related components of a device of the invention and when viewed in series illustrate the basic operating premise of the device (s) described herein.

FIGS. 1A-1D illustrate an exemplary device (100) of the invention and provide an overview of the operating principles of such a device, which will also apply to several other devices OTI. FIG. 1A specifically illustrates a housing component of a low temperature differential powered device ("LTDPD") OTI (100) (i.e., a device OTI), in the figures provided embodied as a cylinder (and herein in the description of figures referred to as "the cylinder"). Movable component (MC) (5), exemplified as a piston, is positioned within cylindrical housing (ORT as "cylinder") (9), such that it serves to separate the cylinder (9) effectively into two chambers, chamber 1 (1) and chamber 2 (2). Cylinder (9) can be closed on both ends by (a) housing cap(s) (29). Housing caps (29) aid in substantially sealing the housing from unwanted pressure or gas loss. Housing caps (29) can also provide an entry or connection point for other device components as described in, e.g., FIG. 8. Chambers 1 (1) and 2 (2) comprise an internal void space/internal void spaces (14A and 14B) which the movable component (5) does not enter as it travels its full stroke length (SL), as represented by the point at which a first end of the MC (5) stops within the cylinder as the safety component (6) travels a maximum distance in a first direction within SLIPBO (15), and the point at which a second end of the MC (5) stops within the cylinder as the safety component (6) travels a maximum distance in the opposite (second) direction within SLIPBO (15). Chambers 1 (1) and (2) are filled with a pressurized gas (e.g., $N_2$). Safety component (6) is attached to or formed as an integral part of the piston (5) and slides within slot (SLIPBO) (15) formed in the barrier (here, the wall of cylinder (9)). The inner portion of the stroke length of the MC (5) between chambers 1 (1) and 2 (2) comprising the SLIPBO represents an area where the surface of the MC (5) is exposed to air (the SLIP (60)).

In operation, piston/MC (5) moves when the pressure in chamber 1 (1) is sufficiently different from the pressure in chamber 2 (2), which occurs when a first or second portion of liquid (T1L or T2L) having a sufficient temperature difference (sufficient T1LΔT2L) from the temperature of the pressurized gas is dispensed. In embodiments, this occurs when either (a) T1L or T2L is dispensed into one of chambers 1 (1) or 2 (2), or, (b) a first portion of liquid having a first temperature (e.g., T1L) is dispensed into one chamber and a second portion of liquid having a different second temperature (e.g., T2L) is dispensed into the opposite chamber, typically at similar times, e.g., at least substantially simultaneously.

FIG. 1A illustrates a device having two dispensing components (DCs, aka "dispensers") (13) and (23) on a single side of the MC (5) (both positioned within chamber 1 (1)). As described, in some embodiments only one dispenser may be present, or, alternatively, a single DC can be present comprising multiple liquid outlets, such as a manifold of dispensers or a "tree" having multiple dispensers may be present (see, e.g., FIG. 8 and associated description below).

In the embodiment shown in FIGS. 1A-1D, status indicators (3) and (4) are provided primarily for the purpose of demonstrating operation of the device and to aid in understanding (such components often may not be present in a device in such a form). The status indicators (3) and (4) are pressure gauges. As discussed elsewhere, but not shown, other sensor(s) can be incorporated in a device/system (e.g., a temperature or pressure sensor measuring the state of the PG/TML). In aspects, no such indicator is present. Devices can have pressure sensors at, e.g., locations (3) and (4) such that the pressure within each of chambers 1 (1) and 2 (2) are known by the device and/or system at any given time.

As indicated by the status indicators (3) and (4) shown in FIG. 1A, the pressure in chamber 1 (1) and chamber 2 (2) is substantially the same, reflecting either the RFOS or the piston (5) completing a full stroke. The protruding member (PM) (6) (described as a "safety component" or "dual purpose safety component" in some figure descriptions) is positioned to the extreme left (as shown) within the SLIPBO (15) (sometimes ORTA a "slot") (15).

Figure 1B:
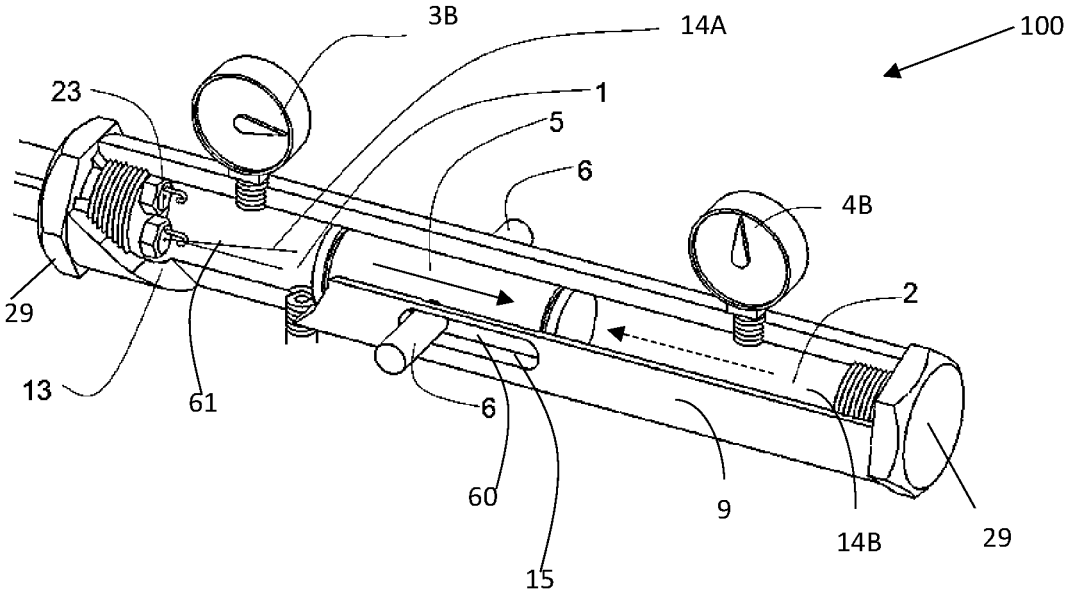

FIG. 1B illustrates the dispensation of a liquid (61) having a first temperature into chamber 1 (1) from first dispenser 1 (13) (a "hot" liquid). The hot liquid (61), upon dispensation as a mist, exchanges its heat with the PG of chamber 1 (1) and hence the temperature of the PG in chamber 1 (1) increases. As a result, the pressure increases in chamber 1 (1) as indicated by the status indicator (pressure gauge) (3B). Piston (5) then moves in a first direction (indicated by a solid arrow), toward chamber 2 (2), chamber 2 (2) also comprising PG and providing a back pressure (indicated by a dashed arrow).

Figure 1C:
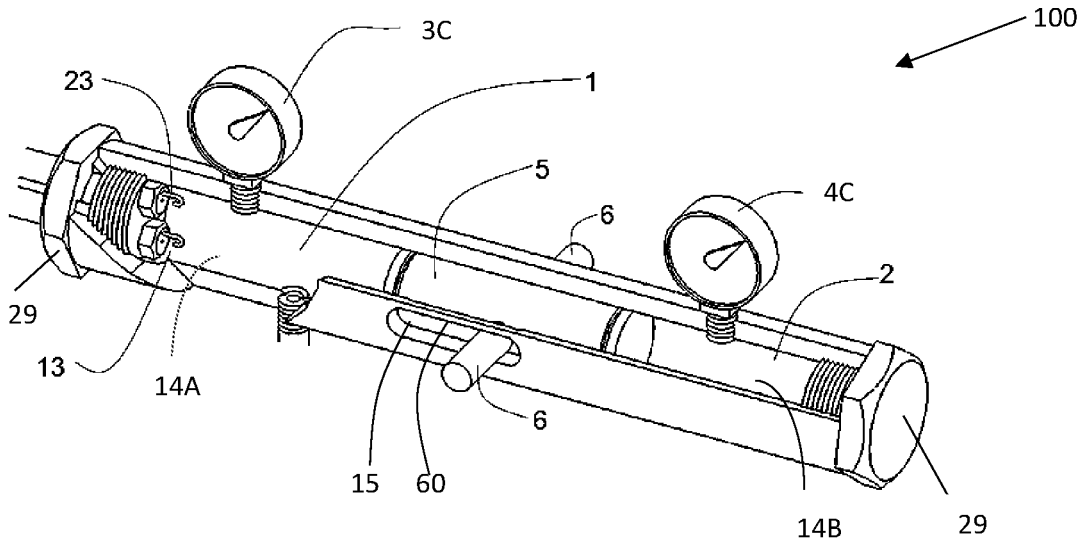

Piston (5) moves in the first direction until the pressure in chamber 1 (1) and chamber 2 (2) again reach a state of substantial equality as shown in FIG. 1C as indicated by status indicators (pressure gauges) (3C) and (4C) being substantially the same. Safety component (6) moves within slot (15) as piston (5) moves a stroke length. Safety component (6) prevents piston (5) from moving beyond an established stroke length in the event the system fails to operate under expected conditions.

Liquid dispensed as a mist from first dispenser 1 (13), ultimately collects within chamber 1 (1). Upon collection, the accumulated liquid drains from chamber 1 (1) through LCC (16). LCC (16) is positioned within chamber 1 (1), typically mostly or entirely outside of the distance traveled in a stroke length by the piston (5) such that the piston (5) does not interfere with LCC (16). The system operates at a pressure which is substantially the same throughout; hence liquid drained from chamber 1 (1) through LCC (16) is able to flow naturally to the part of the liquid conducting system (LCS) containing the lowest volume of liquid (LCS not shown).

Continuing the description of the system in operation, when suitable conditions are met, a second portion of liquid (second portion of TML) having a second temperature, lower than the first portion of liquid (e.g., lower than the "hot" liquid, or hot TML, previously dispensed) is dispensed in the form of a mist from a second dispenser, dispenser 2 (23) into chamber 1 (1) of cylinder (9).

In aspects, a suitable condition that triggers dispensation of the second liquid (a "triggering condition") can be piston (5) reaching a point where the pressure of the PG in chamber 1 (1) is substantially equal to that of the PG of chamber 2 (2). In aspects, a triggering condition is the PG in chamber 1 (1) reaching a predetermined pressure, the PG in chamber (1) reaching a predetermined temperature, or both. In aspects, a triggering condition is the PG in chamber 2 (2) reaching a predetermined pressure or the PG in chamber (2) reaching a predetermined temperature. In aspects, the triggering condition is the passage of a predetermined period. In aspects, the triggering condition is piston (5) substantially completing or completing a stroke (traveling the SL).

Figure 1D:
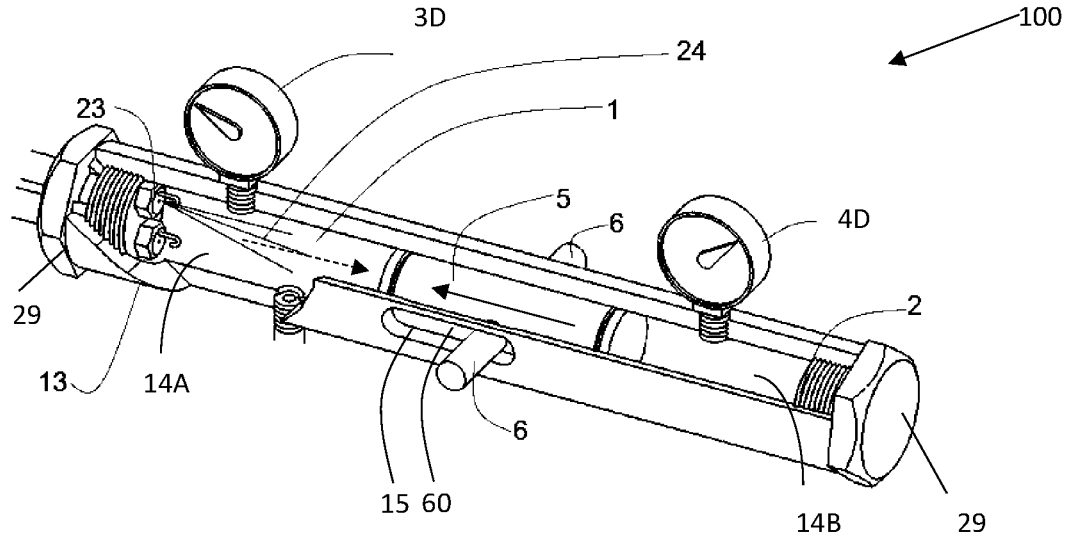

The second dispensed liquid can be referred to as the "cold" liquid; liquid that has a lower temperature than the temperature of PG within chamber 1 (1) and even further less than that of the first portion of liquid (the hot liquid). The dispensation of cold liquid as a mist through dispenser 2 (23) reduces the temperature of the PG held within chamber 1 (1) as the PG exchanges its heat with the liquid. Accordingly, the pressure of the PG in chamber 1 (1) is reduced as shown in FIG. 1D. As a result, piston (5) moves in a second direction (shown by a solid arrow), opposite that of the first direction, back toward its original starting position. In doing so, piston (5) moves toward chamber 1 (1), chamber 1 (1) still comprising PG and providing a back pressure (shown by a dashed arrow). Piston (5) moves until the pressure in chamber 1 (1) and chamber 2 (2) again reach a state of substantial equality, as shown in FIG. 1A. Safety component (6) moves within slot (15) as piston (5) moves a stroke distance in one direction. Safety component (6) again prevents piston (5) from moving beyond an established stroke distance in one direction in the event the system fails to operate under expected conditions. Any liquid (TML) dispensed as a mist which has accumulated in the chamber is collected by LCC (16) and returned to the LCS (not shown) as DEH. When (a) suitable condition(s) again exist, the cycle repeats. For example, the next dispensation of liquid can occur upon occurrence of a $2^{nd}$ triggering condition, which can be any triggering condition(s) discussed above in connection with a 1st triggering condition.

Thus FIGS. 1A-1D exemplify 4 stages of basic operation of exemplary device (100), with FIG. 1A illustrating a ready for operation state (RFOS); FIG. 1B illustrating the dispensation of a temperature modification liquid (TML); 1C illustrating the end of a $1^{st}$ stroke length wherein the pressures of chambers 1 (1) and 2 (2) re-equilibrate after movement of the MC (5), MC (5) having moved to a new position where the pressures of chambers 1 (1) and (2) are again substantially equal (but at a PG pressure higher than in the RFOS); and FIG. 1D illustrates that a $2^{nd}$ liquid dispensation results in a chamber pressure that is below equilibrium and hence causing movement of the MC (5) in a direction opposite the MC's initial movement.

FIG. 2 illustrates an exemplary device (200) comprising additional components. Specifically, additional components shown include pump (7), motor (8), liquid collection line (30), valve (41) and temperature input exposure lines (10) and (20) (forming a liquid conducting system (LCS)). Further, temperature inputs (42) and (43) (T1S & T2S, respectively) are shown for illustrative purposes only and are not drawn to expected scale.

Motor (8) selectively/automatically drives operation of pump (7). Pump (7) receives liquid drained from the cylinder and flowing through liquid collection line (30) and pumps it through temperature exposure lines (10) and (20). One portion of the liquid received from liquid collection line (30) is directed through valve (41) to temperature exposure line (10) and one portion is directed through valve (41) to temperature exposure line (20). Valve (41) can serve to split the two portions of liquid (T1L and T2L). Temperature exposure lines (10) and (20) each expose respective portions of liquid held therein to temperature first and second temperature inputs (T1S and T2S), respectively (42, 43). In an exemplary aspect, T1S & T2S are environmental inputs. During most of the day, T1S & T2S have an average temperature differential (T1ΔT2) that meets the established operational criteria of the designed system. For example, first temperature exposure line (10) can pass through a lake and second temperature exposure line (20) can pass through hot desert air. As described elsewhere herein, at two points during the day, the temperature of the two environmental temperature inputs can reverse relative to one another, such that a first, which was originally warmer than the second, becomes cooler than the second and the second, which was originally cooler than the first, becomes warmer than the first. A switch, e.g., a source switch, (not shown), within the system can be present to control for the reversal and hence allow for continuous operation during such periods. Such a switch can be present as part of a device or as a part of a larger system.

First and second temperature exposure lines (10) and (20) can be received by cylinder cap (29). Exposure lines (10) and (20) can connect to cylinder cap (29) by a threaded connection (not shown).

Motor (8) can be actuated by an operation control unit or components thereof, within the description of figures referred to as a logic controller (40). Such a logic controller (40) can in part receive data from one or more sensors or other means of detection of, e.g., a pressure sensor or a temperature sensor or a flow sensor, or the like (not shown). Such a logic controller can also direct function(s) of the system based on the input from sensor(s). FIG. 2 illustrates a logic controller in abstract form (not shown as specifically connected to the device/system). In aspects the logic controller can be a component of a device or a component of a system. In aspects, the logic controller can be positioned remotely from the device or system and receive data from one or more components of a device or system from a distance.

Figure 3:
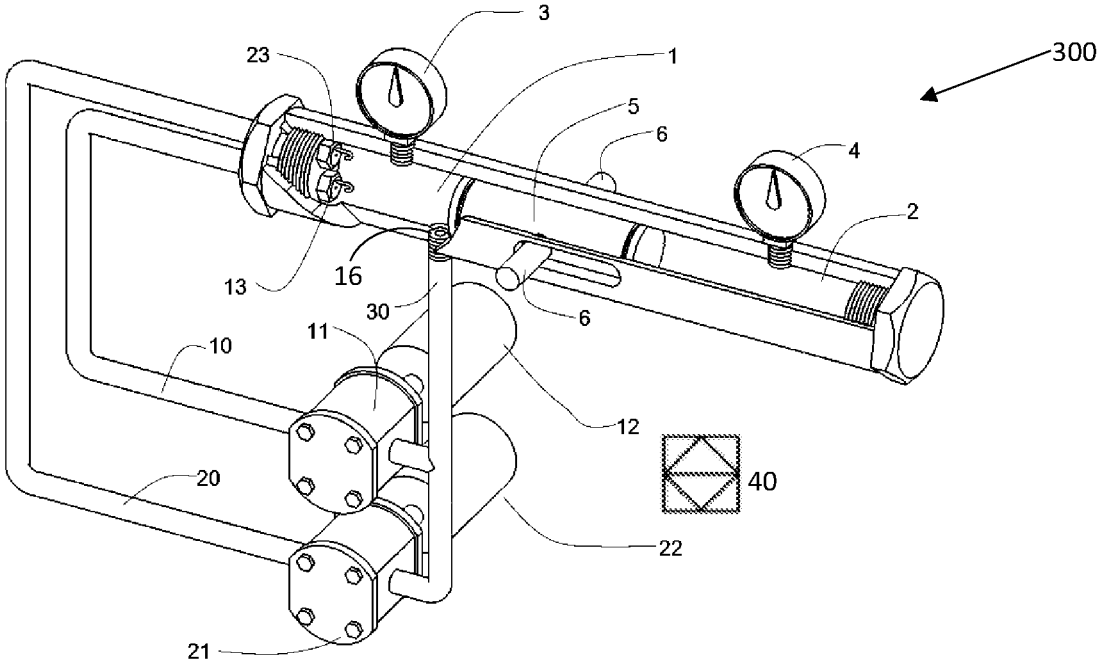
FIG. 3 illustrates another possible configuration of devices or systems described herein comprising two liquid conducting pumps.

FIG. 3 illustrates an alternative embodiment of a device (300) OTI. In this embodiment, liquid collection line (30) directs liquid collected from the LCC (16) (not shown in FIG. 3) to two pumps (11) and (21), each operated by motors (12) and (22), respectively. Liquid received by pump (11) from liquid collection line (30) pumps the liquid through a first temperature input exposure line (10). Liquid received by pump (21) received from liquid collection line (30) pumps the liquid through a second temperature input exposure line (20). Liquid passing through temperature input exposure lines (10) and (20) are each exposed to different temperature inputs (T1S and T2S (not shown)) and return liquid portions having different average temperatures (T1L and T2L) back to the device for reuse as dispensed spray.

Figure 4:
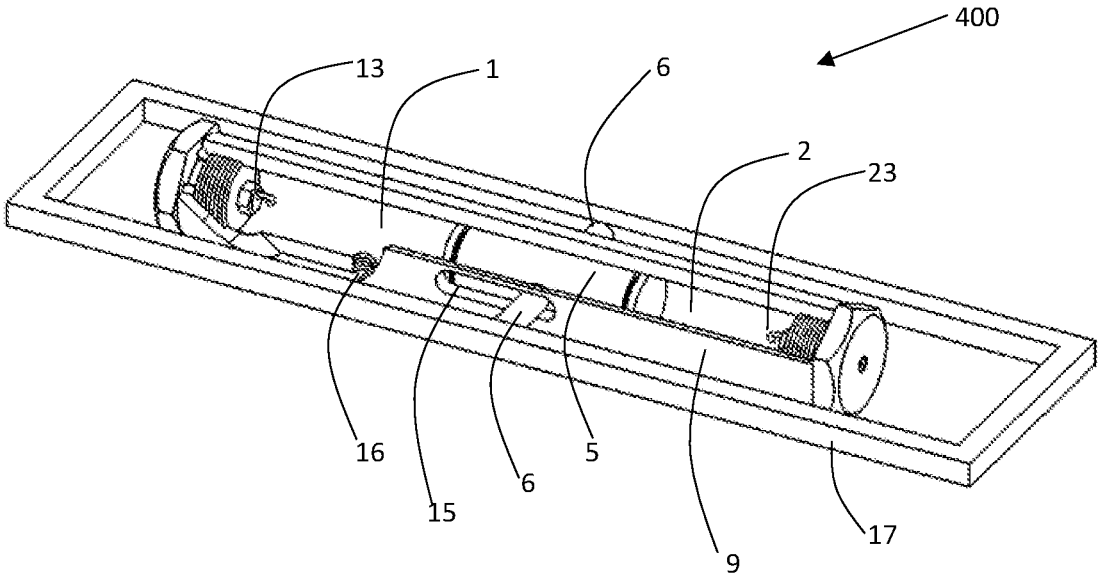
FIG. 4 illustrates one embodiment of the device described herein comprising a movable component connected to a movable connector.

FIG. 4 illustrates a cylinder component of a device (400) of one embodiment of the invention with dispensers (13) and (23) on opposite sides of the MC (5) and an attached movable connector (17). Dispenser 1 (13) is located within chamber 1 (1) and dispenser 2 (23) is located within chamber 2 (2). In this embodiment, a first temperature modification liquid (TML) having a first temperature can be dispensed from a first dispenser in a first chamber, e.g., dispenser 1 (13) in chamber 1 (1) while, generally, substantially, essentially simultaneously, or simultaneously, a second TML having a second temperature can be dispensed from a second dispenser in a second chamber, e.g., dispenser 2 (23) in chamber 2 (2).

In the embodiment of FIG. 4, the device comprises an attached movable connector (17). Safety component (6) in the embodiment shown in FIG. 4, serves a dual function, and can be referred to as a dual function safety component. As piston (5) moves, safety component (6) slides within slot (15) of the cylinder (9). Safety component (6) prevents the piston from traveling beyond an expected stroke length if the system is operating under unexpected conditions. In this embodiment, the safety component (6) also serves to connect the MC (5) to the movable connector (17). As the piston (5) moves in response to the described pressure change in chamber 1 (1), safety component (6) slides within the slot (15) to the right of the illustration as shown, and accordingly the movable connector is moved to the right as well. Upon occurrence of a triggering event (example of which are discussed above), a portion of liquid having the warmer temperature is dispensed into chamber 2 (2) through dispenser 2 (23), and the portion of liquid having the cooler temperature is dispensed into chamber 1 (1) through dispenser 1 (13). The resulting temperature changes in chamber 1 (1) and chamber 2 (2) change the pressure in chamber 1 (1) and chamber 2 (2), and, accordingly, the piston (5) moves in response back toward chamber 1 (1). Safety component (6) concurrently moves within slot (15) in the cylinder along with the piston (5). Because safety component (6) is connected to the movable connector (17), the movable connector (17) moves with the piston (5).

Figure 5:
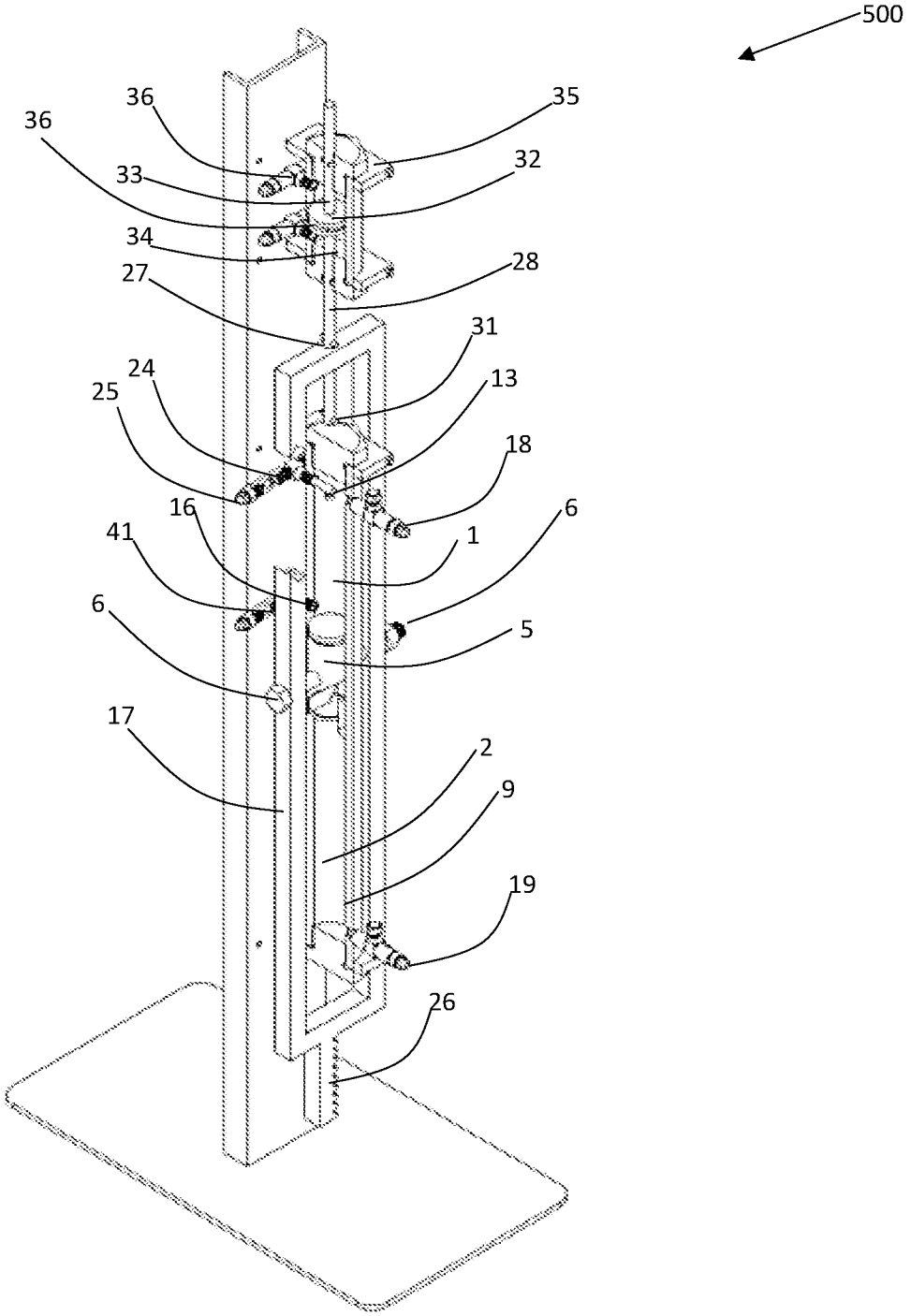
FIG. 5 illustrates one embodiment of the device described herein wherein liquid dispensation is mechanically connected to movement of a movable component.

FIG. 5 illustrates an exemplary device (500) similar to the device described in FIG. 4 however is illustrated with additional components. A cutaway view of cylinder housing (9) of the device is provided near the position of the piston (5) to show the interior of the cylinder (9). Slot (15) within the barrier, or wall, of the cylinder (9), through which the safety component (6), here serving a dual function as both a safety component and also as a connector to a movable connector (17), which is connected to piston (5). Moveable connector (17) slides upon movement of the piston (5). Gas fill valve 1 (18) and gas fill valve 2 (19) allow PG to be filled into chambers 1 (1) and 2 (2) respectively. A single dispenser, dispenser 1 (13) is illustrated as positioned within chamber 1 (1) and is capable of dispensing liquid as a fine mist. Dispenser 1 (13) is attached to a T-valve (24). A first side of dispenser T-valve (24) is connected to a flow line (25) (the connecting location of flow line (25) to dispenser T-valve (24) is shown, however flow line (25) itself is not shown however line shown) leading to/from a filling/dispensation port (36) and receives a first TML from the dispensation enclosure (35), e.g., from 1 of 2 chambers (33 or 34). A second side of a dispenser T-valve (24) is connected via a flow line (25), not shown, leading to/from a filling/dispensation port (36) and receives a second TML from the dispensation enclosure (35), e.g., from the 2nd of 2 chambers (33 or 34).

Continuing the description of the embodiment of FIG. 5, the flow lines (25) provide a first or second portion of liquid (TML) having a first (e.g., T1L) or a second (e.g., T2L) temperature to be dispensed via dispenser 1 (13) as a mist into a PG within chamber 1 (1) (the point of connection of flow line (25) to T-dispenser T-valve (24) is shown as element 25, however the flow lines themselves are not shown). The flow lines attached to dispenser T-valve (24) are connected to filling dispensation port(s) (36) of the dispensation enclosure (35). The pressure within flow line(s) (25) is substantially equivalent to the pressure of the PG. LCC (16) collects dispensed liquid which has accumulated. LCC (16) is connected to a drain port T-valve (41). The drain port T-valve (41) allows for accumulated liquid to exit the LCC (16) and be directed to a connected liquid distribution system. One side of drain port T-valve (41) connects to either a liquid collection line (30) (not shown) which directs collected liquid e.g., to a pump which further directs collected liquid to a temperature input exposure line (10) (not shown) passing through a first temperature input (e.g., T1S) (42), while the second side of drain port T-valve (41) connects to either a liquid collection line (30) (not shown) which directs collected liquid e.g., to a pump which further directs collected liquid to a second temperature input exposure line (20) (not shown) passing through a second temperature input (e.g., T2S) (43), each ultimately connecting to a side of a filling/dispensation port (36) to fill chambers (33 or 34) of the dispensation enclosure (35) with TML (e.g., either T1L or T2L).

Still continuing the description of FIG. 5, safety component (6) is connected both to piston (5) and to movable connector (17). Movable connector (17) is embodied as a hoop or frame, that surrounds cylinder (9). At one end of movable connector (17) is a work off-take or converter mechanism (26), embodied in this figure as a rack (e.g., for a rack and pinion work off-take mechanism). On the opposite end of movable connector (17) is a hole (27) in movable connector (17) through which a mechanical connection to a fluid switch (aka T1L/T2L switch) is provided serving as a fluid switch driving device (FSDD), in this figure embodied as pump piston rod (28). Two sets of motion receiving elements (MREs) (31) are attached to or are an integral part of the FSDD (pump piston rod) (28). Upon motion of the movable connector, the pump piston rod (28) slides through hole (27) in the movable connector (17). Movable connector (17) engages with a first set of MREs (31) when forced to move by the movement of the safety component (6) connected to a piston (5) moving in a $1^{st}$ direction. Movable connector (17) engages with a 2nd set of MREs (31) when forced to move by the movement of safety component (6) connected to a piston (5) moving in a 2nd direction.

Figure 6:
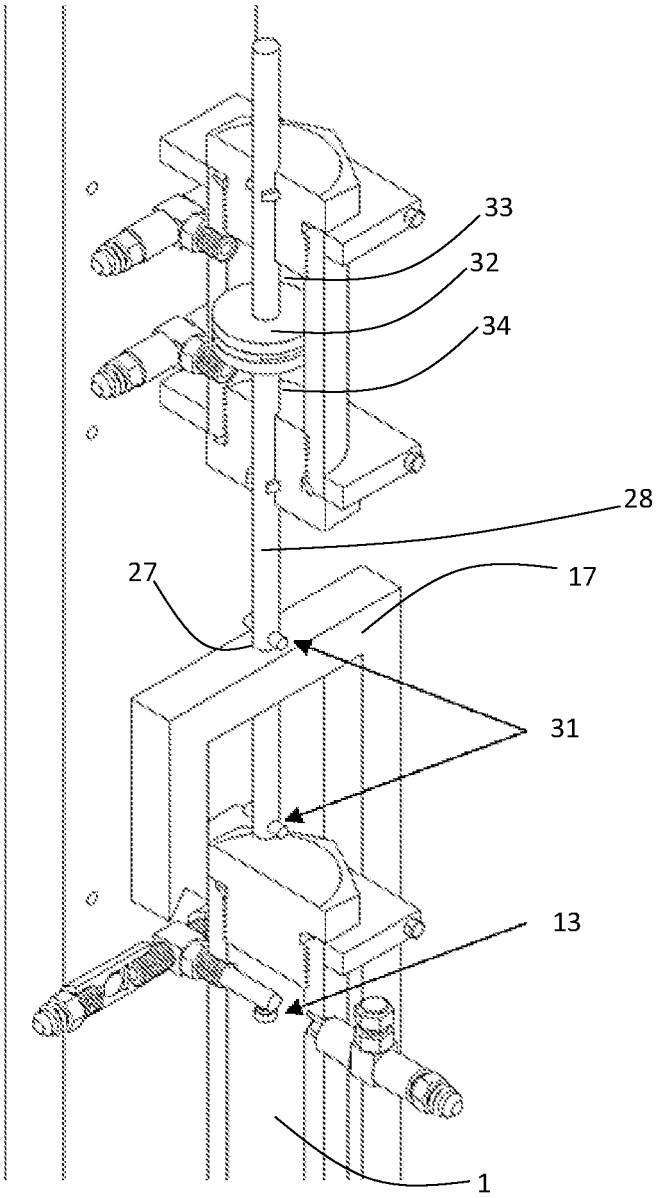
FIG. 6 illustrates an expanded view of one section of FIG. 5 to illustrate the communication and transport of liquids having two differing temperatures within a device and/or system of the invention.

FIG. 6 is an expanded view of the top portion of the device shown in FIG. 5. Hole (27) in movable connector (17) slides upon movement of the piston (5) (not shown), about FSDD embodied here as a piston rod (28). When moving in a first direction, movable connector (17) engages with a first set of MREs (31). When moving in a second direction, movable connector (17) engages with a second set of MREs (31). Engagement of the moving movable connector (17) with a set of MREs (31) on the piston rod (28) causes the T1L/T2L switch, here embodied as a piston (32) to move either in a $1^{st}$ or 2nd direction. To avoid confusing description of this piston with the MC (5), this second piston is referred to as the T1/T2L switch. Movement in a $1^{st}$ direction to cause liquid stored in 1 of chambers A (33) or B (34) to be dispensed and directed toward dispenser (13) of chamber 1 (1) or chamber 2 (2) (not shown) of cylinder (9) via flow lines (25) (not shown).

Returning to the description of FIG. 5, engagement of the movable connector (17) with a set of MREs (31) forces movement of piston rod (28). Attached to piston rod (28) is a fluid switch (T1L/T2L switch) (32). In this embodiment, T1L/T2L switch (32) separates a first chamber A (33) and a second chamber B (34) housed within a single fluid dispensation enclosure (35). First chamber A (33) contains liquid at a first temperature (e.g., T1L) received from an attached LCS (not shown). Second chamber B (34) contains liquid at a second temperature (e.g., T2L) received from an attached LCS (not shown). Each of chambers A (33) and B (34) comprise a T-valve connector connected to a filling port (36). The filling port (36) which allows for chamber A (33) and chamber (34), respectively, to be filled with and/or to dispense a liquid having a first or a second temperature received from a connected LCS (not shown). The T-valve connector (24) allows for liquid(s) to be both received from a connected liquid conducting system (not shown) as well as to be dispensed from chamber A (33) and chamber B (34) and directed to one or more dispensers within chamber 1 (1) or chamber 2 (2) (in some embodiments) within cylinder (9).

Figure 7:
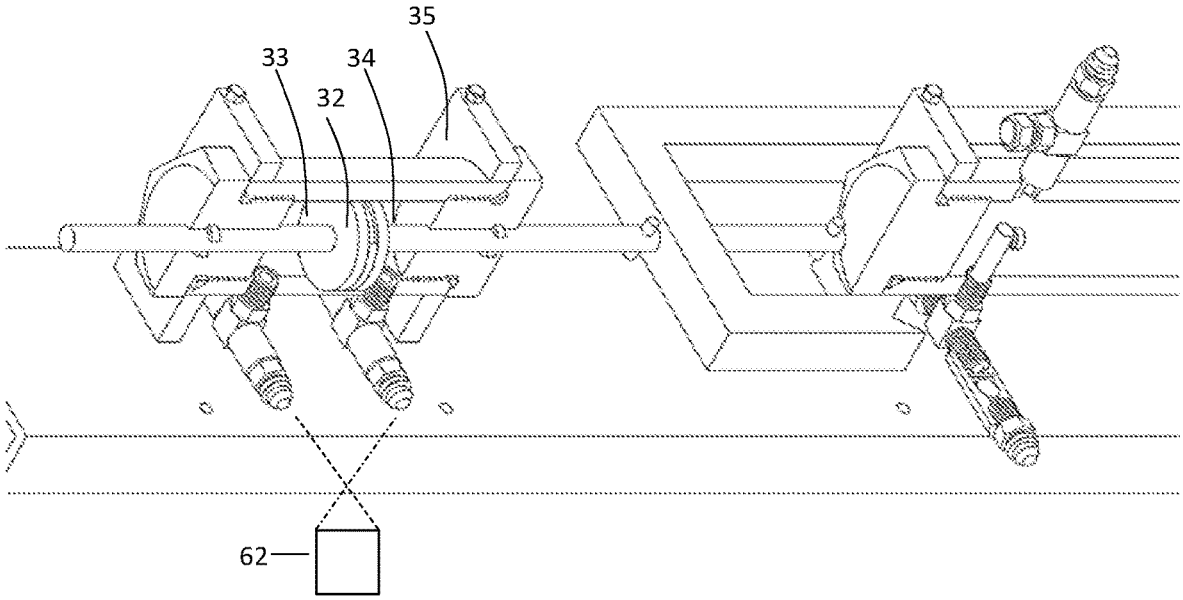
FIG. 7 illustrates an expanded view of one section of FIG. 5, illustrating a mechanical connection between a movable connector and a liquid dispensation enclosure (aka dispensation housing) and related components of an exemplary device.

FIG. 7 is a similar image to FIG. 6 but oriented horizontally instead of vertically. FIG. 7 specifically illustrates an embodiment wherein the presence of a source switch (62) (indicated but not shown in detail/to scale) is capable of reversing the receipt of TMLs T1L and T2L (indicated by dashed lines) such that during periods where the temperatures of T1L and T2L reverse relative to one another, the chamber of the liquid dispensation housing (35), e.g., chamber A (33) first receiving T1L then receives T2L, and chamber B (34) first receiving T2L then receives T1L, such that each chamber in substantially all periods of operation, receives either the warmer of the two TMLs or the colder of the TMLs relative to one another). Accordingly, movement of the T1L/T2L fluid switch (32) in each direction in most circumstances, under normal operation, dispenses a TML having either the warmer or the colder temperature and that does not change during normal operation. Stated another way, movement of the T1L/T2L fluid switch (32) in one direction in most circumstances, under normal operation, dispenses a TML having a first temperature (e.g., a "hot" temperature) and movement of the T1L/T2L fluid switch (32) in the opposite direction in most circumstances, under normal operation, dispenses a TML having a the opposite temperature (e.g., a "cold" temperature), the terms "hot" and "cold" as used here describing the temperature of the two TMLs relative to one another.

Figure 8:
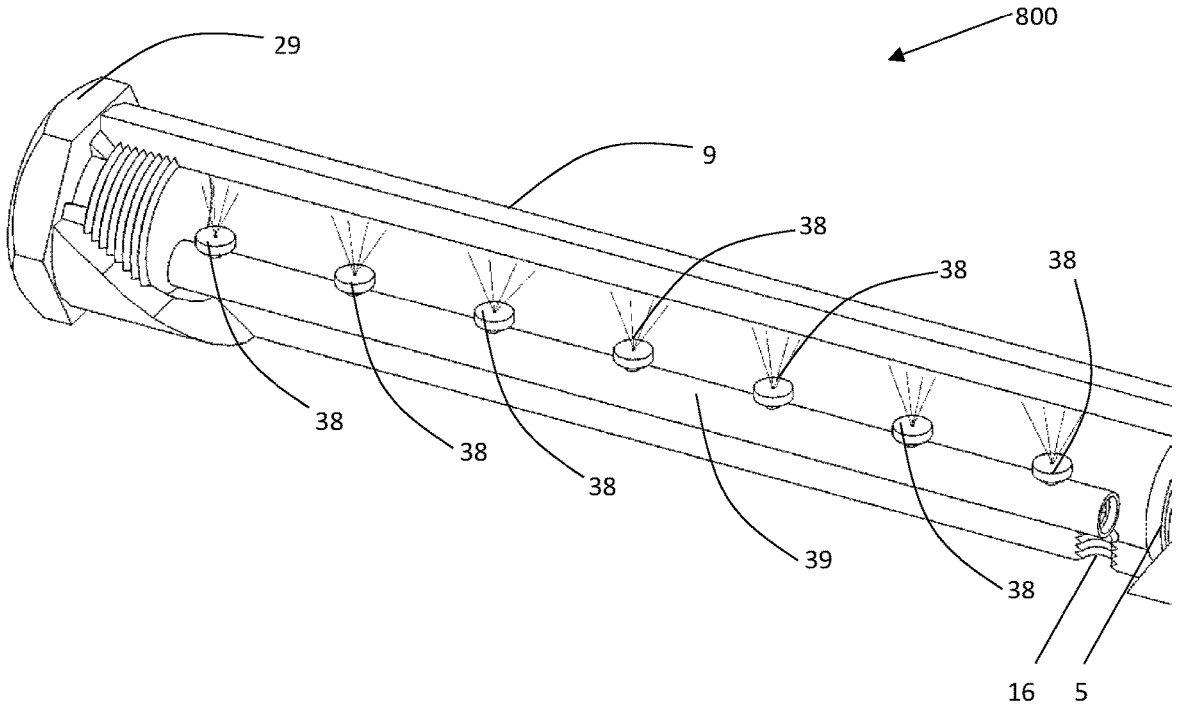
FIG. 8 illustrates one embodiment of a dispensing component, the dispensing component having multiple outlets for dispensing liquid.

FIG. 8 is a side cutaway view of another device (800) comprising a cylindrical housing (9) and a line of dispensers (38) located in a chamber (1). In this aspect, multiple dispenser heads, e.g., nozzles, (38) are present as part of a dispensing component (DC) embodied as a manifold or a "dispenser tree." Dispenser tube (39) receives liquid through an access port (37) in cylinder cap (29). Dispenser tube (39) comprises multiple dispenser nozzles (38), (seven (7) shown for exemplary purposes)) from which liquid received in the dispenser tube (39) is dispensed as a mist into the PG of chamber 1 (1). Use of an collection/array of misters, e.g., as illustrated by the "dispenser tree" allows for more even dispersion of TML dispensed as a mist throughout the PG of the chamber, causing a rapid temperature change and hence a quicker transition of the MC (5) to the opposite direction of travel, increasing the amount of work a device can do in a given period of time (e.g., as opposed to a single dispensation point in a single location within the chamber which may take longer to sufficiently modify the temperature of the PG in the chamber so as to cause MC (5) movement). FIG. 8 illustrates a dispenser tree positioned within the chamber beyond the LCC (16) and SL.

Figure 9:
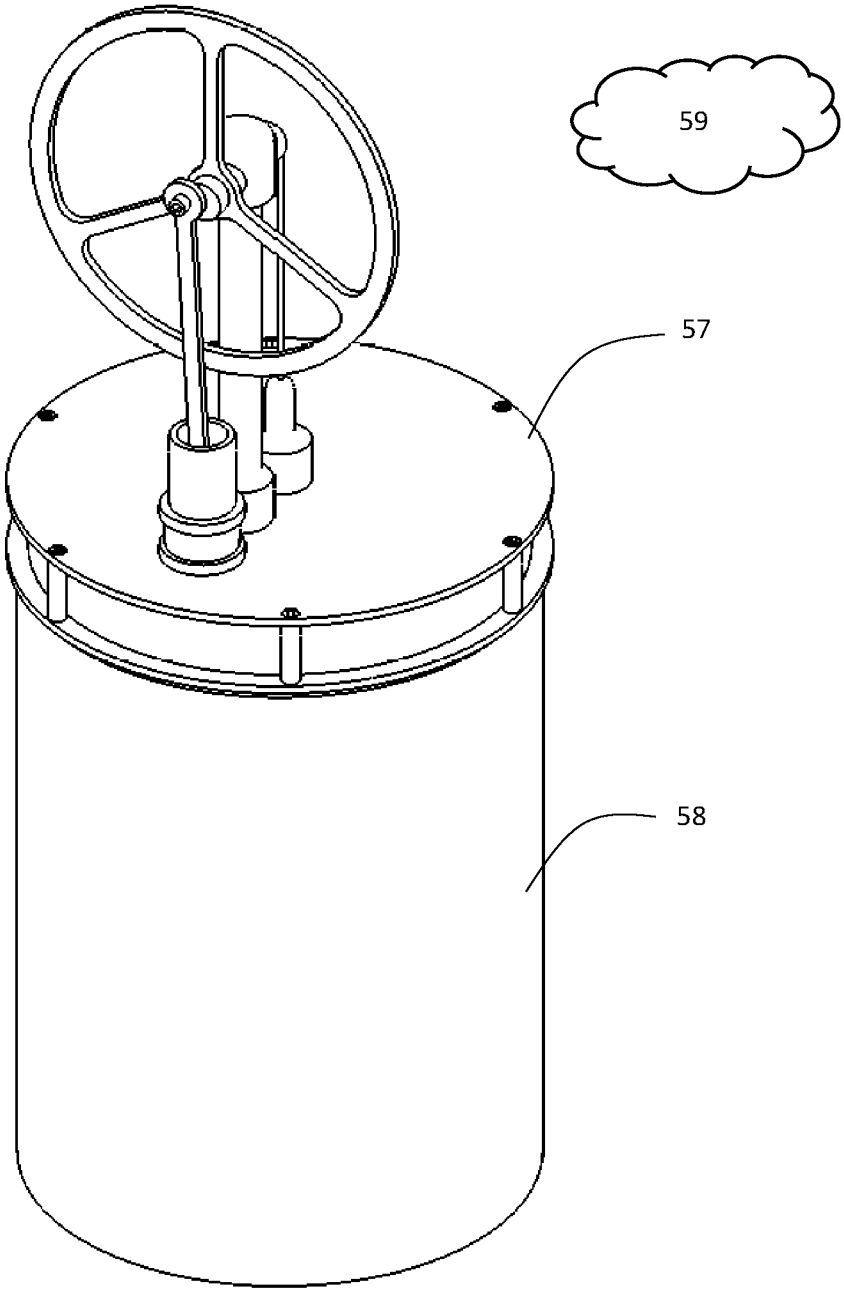
FIG. 9 illustrates the device and conditions used in the performance of the experiment described in Example 1.
Figure 10A:
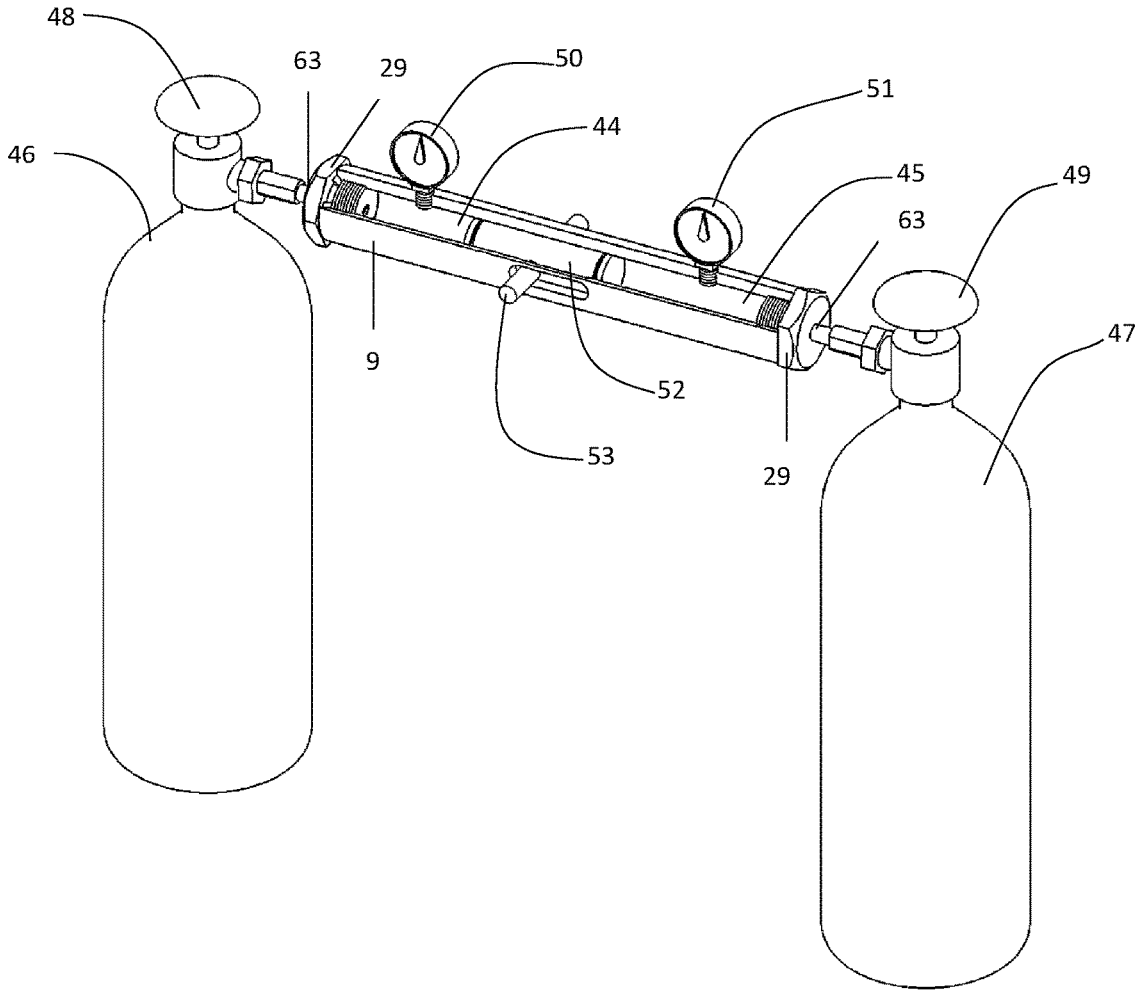
FIGS. 10A and 10B illustrate the device used in the performance of the experiment described in Example 2.
Figure 10B:
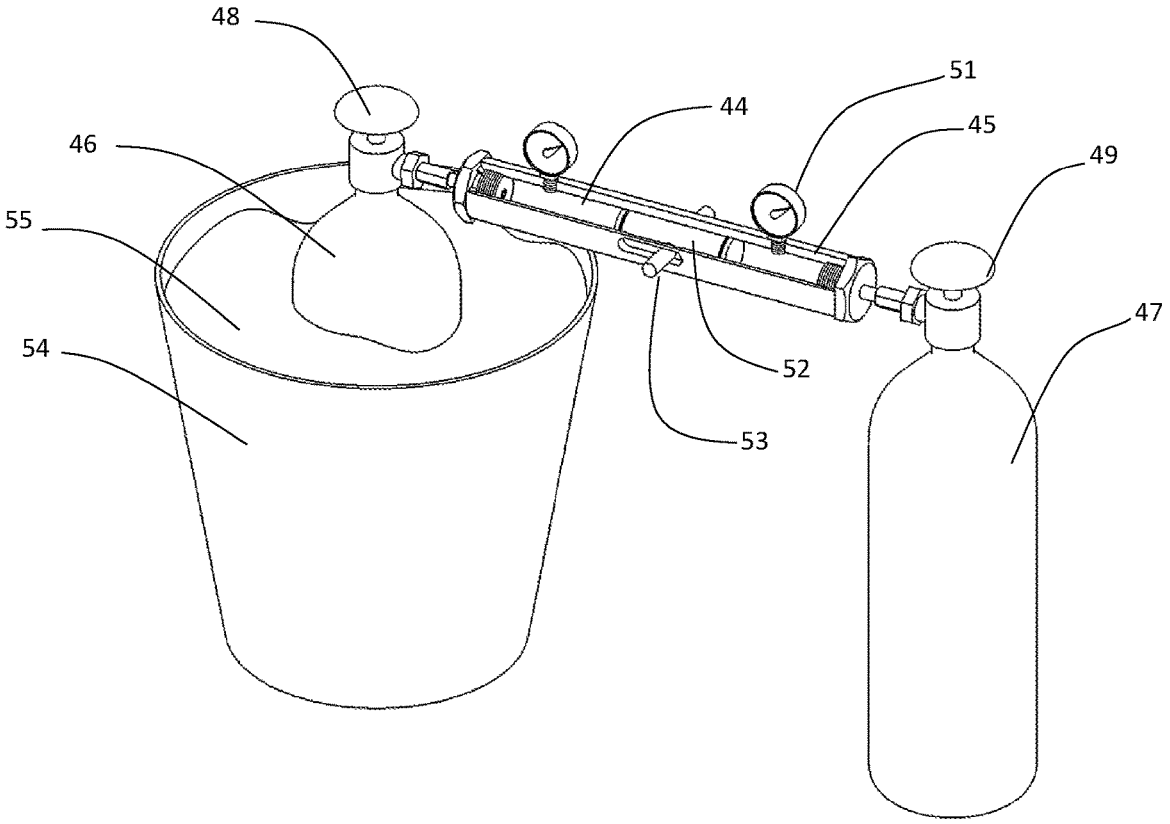
Figure 11:
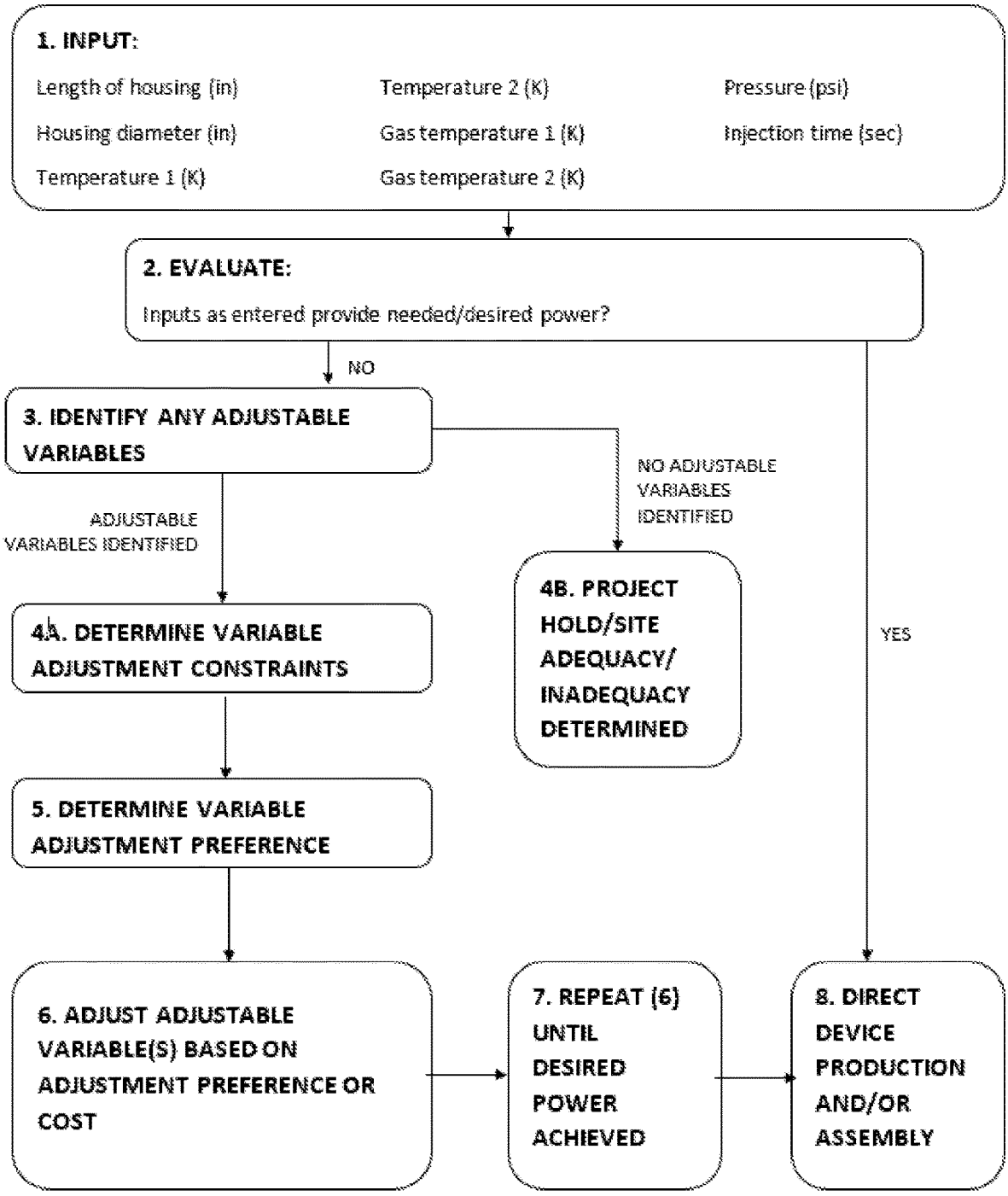
FIG. 11 is a flow chart illustrating a process for designing a power system of the present invention using a computer processor per AOTI.

FIGS. 9 and 10A-10B are discussed in Examples 1 (FIG. 9) and 2 (FIGS. 10A-10B), as they reflect experiments conducted and described therein. FIGS. 11-13 provide examples of automated control device/system AOTI and are also DEH.

PROOF OF CONCEPT EXPERIMENTS/EMBODIMENTS

The following descriptions of performed and planned experimental work demonstrate the feasibility and practical application of exemplary devices and methods of the invention. This portion of the disclosure is intended to both illuminate AOTI and to reflect the inventor's possession of the invention. Thus, these Examples should not be used to limit the scope of the invention.

Example 1: Stirling Engine Investigation (Evaluation of Prior Art)

An experiment was conducted to investigate the operation of a Stirling engine and to begin the scale up of the quantity of useful work that can be extracted from such a system.

FIG. 9 illustrates the experimental set up. A low temperature differential Stirling engine (57), was placed on top of a cylinder of aluminum (58). The low temperature differential Stirling engine (57) and aluminum cylinder (58) were placed outside in the natural environment (59). The air temperature of the natural environment (59) to which the engine and the cylinder were exposed was not controlled in any way, hence the environment experienced frequent temperature changes over time.

The cylinder of aluminum took longer to heat and/or to cool than the air of the atmosphere within which the system was placed. Due to this phenomenon, the bottom plate of the low temperature differential Stirling engine was exposed to a different temperature than the top plate. This temperature differential drove the operation of the engine as expected based on the known operating principles of a Stirling engine.

The experimental system operated 24 hours/day for several weeks. The device continued to operate when temperatures were observed to be −25° C. at night and when the temperature of the atmosphere was −23° C. during the day, hence demonstrating the ability of the system to operate when a minimal environmental temperature differential (minimal T1ΔT2) existed. It was observed that twice per day, once in the morning, and once in the afternoon, the temperature of the aluminum cylinder and the temperature of the atmospheric air became the same. At the such times, the engine ceased to operate for several minutes. The engine required manual intervention to be reinitiated/restarted.

In a modified version of this same experiment, the low temperature differential Stirling engine (57) was placed on top of a steel pipe, the steel pipe being buried vertically four feet into the ground. The system was observed to operate in the same manner.

The key learnings from the conduct of this experiment were:

1. Within a low temperature differential Stirling system, a single unit volume of gas can be heated, e.g., ten degrees, or ten-unit volumes of gas can be heated one degree, and the system will produce the same amount of work. The amount of work capable of being produced by the experimental system was very low and insufficient for a scale of operation above the ability to power an, e.g., single small light. It was observed through the conduct of this experiment that to produce large quantities of work, e.g., work sufficient to generate sufficient power to operate an automobile, boat, apartment, small home, or other such facility, if a low temperature differential is maintained, the displacer of the Stirling engine would need to become far larger, e.g., at least 2×, at least 5×, at least 10×, at least 25×, at least 50×, at least 100×, or even more, such as at least 200×-at least 1000×, and, hence, far heavier, which accordingly would be complicated to balance.

2. Work performed by the Stirling system might be increased with an increase in pressure of the working gas, but such a pressure increase would require use of a large displacer in order to facilitate the holding within a vessel of, and then displacement of, a maximum volume of gas within a pressure vessel. Placement of such a large displacer would be/is complicated, expensive and can quickly become impractical.

3. Heat from the one side of the pressure vessel of the Stirling engine conducts quickly around to the opposite side of the pressure vessel causing the cold side to become warm. The displacer itself becomes a thermal mass and becomes the average temperature of the warm side and the cold side. In operation, the working gas temperature can then only change to the average temperature of the displacer's average temperature and the pressure vessels warm temperature. This creates an operating inefficiency, as the maximum temperature, e.g., that of the environment surrounding the pressure vessel, is essentially diluted and unable to contribute its maximum temperature differential.

From this and similar experiments it was observed that increasing work produced from a low temperature differential Stirling engine would probably not be possible due to inherent limitations of such systems.

Example 2: Exemplary Early Heat Engine Experiments

An experiment was conducted to demonstrate that a low temperature differential powered device (or heat engine) according to the invention could overcome the limitations of the prior art Stirling systems.

It was hypothesized that a system having a pressure of about 2,000 psi, positioned in an environment having an ambient environmental temperature of 300 K, and the system comprising a piston having a diameter of 2 inches (5.08 cm), could be made to experience a change in pressure of approximately 67 psi and to generate an initial piston force of about 209 pounds (lbs.) or about 95 kg when the temperature of a pressurized working gas held within the system was changed by about 10 K.

FIGS. 10A and 10B illustrate the experimental conditions used to test the operation of a device having many of the features described in connection with the device shown in FIG. 1 and described above. Referring to the initial experimental set up described in FIG. 10A, a cylindrical housing (9) device comprising a double acting piston (52) containing two gas regions (44) and (45) was connected to two pressurized nitrogen bottles (46) and (47) containing nitrogen, through ports (63) introduced in end caps (29), as shown. The housing (9) and double acting piston (52) were comprised of heat-treated stress relieved steel 41/40. The nitrogen bottles (46) and (47) had a pressure relief valve setting of 2,200 psi. The nitrogen bottles (46) and (47) were pressurized to 2,000 psi. The gas in the first nitrogen bottle (46) was connected to be in fluid communication with the first gas region (44) through a valve (48). The gas in the second nitrogen bottle (47) was connected to be in fluid communication with the second said gas region (45) through a valve (49).

A first pressure gauge (50) was utilized to show the pressure in the first gas region (44). Likewise, a second pressure gauge (51) was utilized to show the pressure in the second gas region (45). The piston (52) of the double acting piston contained a piston rod (53) to provide a means of utilizing the work performed by the double acting piston. Elsewhere in this disclosure, this component is described as the safety component, dual action safety component, or protruding member (PM). Piston rod (53) was comprised of heat-treated stress relieved steel 41/40. The piston (52) had a diameter of 2 inches or about 5.1 cm.

The experiment was initiated by placing the two valves ((48) and (49)) in open positions. The piston (52) of the double acting piston was initially positioned toward the leftmost location as shown, or toward the first gas region (44). The first gas valve (48) was then closed.

Referring to FIG. 10B, the first nitrogen bottle (46) was then placed in a bucket (54) filled with water (55) at a first temperature, here warmer than that of the nitrogen in the nitrogen bottle.

A timer was set for 10 minutes to allow heat from the warm water (55) to transfer into the nitrogen gas in the bottle (46).

After ten minutes, the first valve (48) was opened. The nitrogen gas in the first nitrogen bottle (46) had experienced an increase in temperature and was at a higher pressure. The gas at higher pressure pushed on the piston (52) through the expansion of the gas until the pressure in the two gas regions (44) and (45), with their respective nitrogen bottles (46) and (47) equalized.

Gas valve (48) was then again closed.

The first pressurized nitrogen bottle (46) was then placed in a bucket (54) filled with water (55) at a second temperature, this time at room temperature, which was cooler than the temperature of the nitrogen gas. A timer was set for 10 minutes to allow heat from the room temperature water (56) to transfer into $N_2$ gas in the 1st bottle (46).

After ten minutes, the first valve (48) was opened. The nitrogen gas in the first nitrogen bottle (46) had experienced a decrease in temperature and was then at a lower pressure. The now higher pressure gas in the second gas region (45) and nitrogen bottle (47) pushed on the piston (52) through the expansion of the gas until the pressure in the two gas regions (44) and (45) equalized.

The experiment was conducted multiple times.

The outcomes of the experiment agreed with predicted values. In one test, 135 lbs. (about 61 kg) of mass were connected by cables (not shown in figures) to the piston rod (53). Upon release of valve (48) after pressurization due to increase in temperature, the mass was moved four inched off the floor of the laboratory. In a second test, a gearbox and generator were connected to the piston rod (53) to serve as a conversion device. A 125 watt heat lamp was successfully powered during a piston movement when valve (48) was released and the pressure differential caused by a change in temperature of the pressurized gas effectuated by exposure to a heat transfer liquid (liquid in the bucket surrounding the pressurized nitrogen bottle) was allowed to equalize by piston movement.

This experiment demonstrates that temperature differences in a closed, high pressure system can effectively generate work. However, the extended period required heat and cool the nitrogen bottles (and nitrogen gas contained therein) is impractical for common use. Accordingly, it was concluded that a faster way to effectuate a change in temperature of the gas would be required to design a practical system capable of producing significant, uninterrupted work.

Example 3: Proposed Manifold Misting Device and Testing Thereof

An experiment will be conducted to test the feasibility of using a manifold misting device to shorten the time required to effectuate a change in temperature of the gas in an energy production device in order to design a practical system of efficiently producing significant, uninterrupted work.

Multiple iterations of the experiment can be conducted, including but not limited to testing of the manifold misting manifold device outside of a pressurized chamber or operating device as well as within a pressurized chamber and/or within an operating device, using multiple temperature modification liquids and multiple types and/or sizes and/or configurations of dispensation outlets (nozzles). Nitrogen gas is expected to mostly or exclusive be utilized as the pressurized gas. Operating pressures of the pressurized gas for iterations of the experiment conducted within a closed chamber are expected to be 2000 psi+/−10%.

Multiple temperature modification liquids, including but which may not be limited to, water, turpentine, kerosene, WD-40, or other liquids having properties described elsewhere herein can be and are expected to be tested. The temperature modification liquid will be placed in a holding container and connected to a misting manifold substantially similar to the misting manifold described in FIG. 8. The manifold is expected to comprise between about 5 and about 20, likely between about 5 and about 10 liquid dispensation outlets in the form of nozzles. Multiple nozzles/nozzle configurations can be tested depending on the liquid tested, e.g., to arrive at, or verify the device includes, a dispensation system capable of dispensing a mist comprising droplets having an VMD (DV0.5) of approximately 50 μm.

Prior to applying any force to the pump, nozzles will be were oriented in an upward orientation such that the liquid dispensed from any one or more nozzles will be directed upward, away from the manifold. In iterations of this experiment wherein the manifold is not placed within a pressurized chamber (within a device), the pressure required for dispensing the liquid is expected to be the pressure required to force the liquid out through the nozzles and the pressure required to overcome any back pressure created by the atmospheric pressure of the environment (air) into which the liquid is dispensed. In iterations of this experiment wherein the manifold is placed within a pressurized chamber (within a device), the experimental system will be closed, such that the pressure required for dispensing the liquid is expected to be the pressure required to force the liquid out through the nozzles; no back pressure is expected to be encountered as the pressure of the liquid and the pressure of the pressurized gas in the chamber will be substantially equal.

In iterations of the experiment wherein the manifold is placed within a pressurized chamber (within a device), one or more visual aid components (e.g., windows) may be incorporated into the system to facilitate viewing of the liquid dispensation within the chamber.

Repeated force will be applied to the experimental system using a pump. Multiple pumps can be tested including a hand pump for some possible iterations of the experiment as well as a rotary pump in other iterations of the experiment. Observations will be made. One aim of any iteration of this experiment will be to establish that prior to applying pressure, essentially or substantially no or no unwanted or uncontrolled release of liquid occurs (e.g., essentially or substantially no or no dripping from nozzles that DOS impacts the efficiency of the system is observed). At least one liquid is expected to be able to be successfully pumped from the source through the manifold and successfully dispensed through each of the individual nozzles of the manifold. No requirement of an excessive amount of force is expected to be experienced. The mist is expected to be extremely fine and capable of quickly (e.g., within less than 1 second) causing a temperature change in the pressurized gas into which it is injected in applicable iterations of the experiment. In embodiments of the experiment wherein the manifold is exposed to the environment and not placed within the confined space of a device chamber, the mist is expected to be observed to expand outward from each of the nozzles, extending along the length of the manifold in a somewhat evenly distributed fashion.

It is expected that this experiment will confirm that the presence of multiple liquid outlets, e.g., multiple nozzles (as in this experiment facilitated by a manifold), significantly increases the volume of liquid capable of being dispensed within the same amount of time, such increased volume expected to have significant impact on the speed in which temperature change could be applied to a pressurized gas into which it is dispensed.

It is expected that this experiment will demonstrate that providing multiple liquid outlets, e.g., multiple nozzles across a length or span of a manifold allow for the substantially even misting of an extended length of space. This is believed to be beneficial when operating within the confined space of a chamber in that if such a manifold were to be placed within a chamber, mist could be applied along the length of the chamber via the series of outlets (nozzles) along the length of the manifold, such that an increased volume of gas held within the chamber would be exposed to the liquid, hence again increasing the speed in which temperature change could be applied to the gas.

Example 4: Testing of a Manifold Dispenser Device

Another experiment can be conducted using a manifold dispenser component used in Example 3 or another manifold dispenser component positioned within a sealed cylindrical housing, the housing having a barrier defining the cylindrical shape and a chamber within. The housing and/or closure components of the housing may incorporate one or more visual aid components to facilitate viewing inside of the chamber. The housing will comprise at least two gas fill valve(s), at least one located near each end of the housing. The housing will also comprise at least one, likely two SLIPBOs (slots) through which a protruding member (e.g., a safety component) attached to the movable component will be allowed to extend.

A movable component in the form of a piston will be positioned within the chamber, separating the chamber in to two smaller chambers, one on either side of the piston and each comprising a gas fill valve in the barrier (wall) of the housing helping to define it. A protruding member (safety component in the form of a pin) will extend from the piston and through the SLIPBO (slot) in the housing. This will aid in observing movement of the piston. The manifold dispenser will be placed within one of the smaller chambers on one side of the piston. One end of the housing, the end of the housing adjacent the smaller chamber not comprising the manifold, will be sealed with a closure component (e.g., an end cap). The housing will also be sealed on the opposite end with an end cap; however, this housing cap will be provided with an access port allowing for the manifold to be connected to the source of temperature modification fluid.

The temperature modification fluid is expected to be selected based on the results of Experiment 3 but can also be selected based on learnings outside of Experiment/Example 3. Multiple temperature modification fluids may be tested under the same experimental conditions.

Using the gas fill valves, each chamber on either side of the piston will be filled with a gas (e.g., likely nitrogen gas) and is expected to be pressurized to approximately 2000 psi (such as about 2000 psi+/−10%. Pressure gauges and/or sensors accessing each chamber can be positioned to monitor the pressure in the chambers. The source of temperature modification liquid will also be pressurized to the approximate pressure of the pressurized gas, e.g., approximately 2000 psi, so that it will be substantially the same as the pressurized gas to create an essentially pressure balanced, substantially pressure balanced, or pressure balanced system. In the ready for operation state, the piston can be in the center of the housing defining two substantially equivalent smaller chambers within the housing, one on either side of the piston.

The temperature of the of the first temperature modification liquid (TL1) at the start of the experiment can be approximately 338 K, the temperature of the second temperature modification liquid (TL2) at the start of the experiment can be approximately 300 K, and the temperature of the nitrogen at the start of the experiment can be approximate 300K, thus, e.g., the temperature differential between the two liquids TL1 and TL2 is expected to be between approximately 30-40 K, e.g., about 35-40 K.

At the start of the experiment, the system will be closed and essentially pressure balanced, substantially pressure balanced, or pressure balanced. Using a pump, e.g., a rotary pump, temperature modification liquid will be pumped from the TL1 liquid source (having a temperature of, e.g., approximately 338 K) into the manifold and out of the plurality of nozzles. Almost immediately, that is, as observed visually, as soon as the liquid is pumped into and exposed to the nitrogen gas, the pressure in the chamber in which the liquid is dispensed will increase due to the heating of the gas and resulting expansion. The safety component is expected to be observed to immediately move toward the end of the slot away from the end of the housing comprising the manifold.

Upon substantial completion of a stroke length of the movable component, TL2 will be pumped from the TL2 liquid source (having a temperature of approximately 300 K) into the manifold and out of the plurality of nozzles. Almost immediately, that is, as observed visually, as soon as the liquid is pumped into and exposed to the nitrogen gas, the pressure in the chamber in which the liquid is dispensed is expected to decrease due to the cooling of the gas. As a result, the pressure differential between the chambers is expected to result in an almost immediate observation of the safety component moving back toward the end of the slot toward the end of the housing comprising the manifold.

This experiment is expected to successfully demonstrate that use of such a liquid dispensation manifold can cause a fast and effective temperature change in a pressurized gas and could facilitate improved operating efficiency and total work performed of such low temperature differential devices. It is expected that the system(s) of this experiment will produce between 200-1000 pounds (lbs.) (about 91-about 454 kg) of force, likely closer to between about 400-about 800 lbs. (about 181-about 363 kg) of force, e.g., about 600 lbs. (272 kg) of force.

EXEMPLARY ASPECTS OF THE INVENTION

The following is a non-limiting list of aspects of the invention:

1. A device for transforming temperature differences into work comprising: (a) a housing comprising (1) a barrier component that is at least substantially impervious to unintentional fluid (e.g., liquid) loss and (2) a chamber formed within the barrier component comprising two internal void spaces each having a length that is at least 7.5% of the length of the chamber; (b) a movable component that (1) is at least primarily positioned in the chamber, (2) comprises a contact surface, and (3) in operation moves a stroke length when acted on by a minimum force, the stroke length being smaller than one or more dimensions of the chamber such that the movable component does not enter the internal void spaces; (c) a pressurized gas contained in the chamber and in contact with the contact surface; and (d) a temperature modulating system comprising (1) a heat transfer liquid that in operation comprises a first portion at a first temperature and a second portion at a second temperature; (2) a dispensing component that in operation dispenses the liquid into the chamber in droplet form; (3) a fluid switch that in operation alternates the dispensing of liquid at the first temperature and the second temperature; where (I) in operation the internal void spaces comprise only the gas or the gas and the liquid; (II) provided that there is a sufficient temperature difference between the first portion and second portion, the alternating dispensing of the liquid creates a temperature differential in the chamber that causes the movable component to repeatedly move back and forth across the stroke length; (III) in operation the pressure of the gas and the pressure of the liquid are such that (i) dispensing the liquid takes up no more than 33% of the work produced by the movement of the movable component, (ii) the pressure of the liquid and the gas before regular operation vary by no more than 5%; or (iii) both (i) and (ii); and (IV) the device operates as an at least substantially closed system with respect to the gas and the liquid.

2. The device of aspect 1, wherein the chamber comprises internal void spaces that each make up at least about 20% of the chamber.

3. The device of aspect 1-2, wherein flow of gas in the chamber in regular operation is substantially in the same orientation.

4. The device of any one of aspects 1-3, wherein the device comprises a converter that converts the movement of the movable component into energy, useful work, or both.

5. The device of any one of aspects 1-4, wherein the liquid comprises one or more liquids that have (i) a viscosity of between about 0.75 to about 3.5 centipoise at temperatures between 295-315 degrees Kelvin and atmospheric pressure; (ii) a specific heat of between about 1.6 kJ/(kg K) to about 4.4 kJ/(kg K); (iii) a surface tension of between about 20 to about 75 dynes/cm; a freezing point of between approximately 210 K to about 275 K; or (iv) a combination of any or all of (i)-(iii).

6. The device of any of aspects 1-5, wherein the device comprises (e) an operation component that allows the device to be selectively operable.

7. The device of any one of aspects 1-6, wherein the dispensing component comprises a plurality of dispensers that each alternatively dispense liquid from the first portion and second portion into a portion of the chamber comprising the internal void space.

8. The device of any of aspects 1-7, wherein the portion of the barrier surrounding the IVS lacks any component that causes a temperature change in the barrier and the temperature of the barrier changes the temperature of the IVS by no more than 10% in regular operation.

9. The device of any one of aspects 1-8, wherein the fluid switch is a valve which alternates the dispensation of liquid at the first temperature and liquid at the second temperature.

10. The device of aspect 9, wherein the fluid switch operates automatically during regular operation.

11. The device of any of aspects 1-10, wherein the device comprises at least 1 connection element for connecting the device to a liquid conducting system comprising at least 2 temperature inputs that are each exposed to different temperatures creating the 1st portion and the $2^{nd}$ portion.

12. The device of any one of aspects 4-11, wherein the converter comprises an electricity generating device.

13. The device of any one of aspects 1-12, wherein ≥~30% of dispensed liquid does not contact the contact surface (of the MC).

14. The device of aspect 13, wherein 80% of the dispensed liquid does not contact the contact surface (of the MC).

15. The device of any one of aspects 1-14, wherein the movable component comprises only one contact surface & the dispensing component is oriented to dispense liquid mostly on one side of the contact surface.

16. The device of any one of aspects 1-15, wherein the contact surface lacks contact with any solid component.

17. The device of any one of aspects 1-16, wherein the pressure in the device in operation is between about 12 and about 720 atmospheres (between about 175-about 10600 psi).

18. The device of any one of aspects 1-17, wherein the liquid has a viscosity of between about 0.75 to about 3.5 centipoise at 295-315 degrees Kelvin and atmospheric pressure.

19. The device of any one of aspects 1-17 wherein the liquid has a specific heat of about 1.6 kJ/(kg K) to about 4.4 kJ/(kg K).

20. The device of any one of aspects 1-18, wherein the liquid has a surface tension of between about 20 to about 40 dynes/cm.

21. The device of any one of aspects 1-20, wherein the liquid has a freezing point of approximately 210 K-about 275 K.

22. The device of any one of aspects 1-18, wherein the liquid is at least primarily a liquid selected from the group comprising water, turpentine, kerosene, or WD-40® or its equivalent.

23. The device of aspect 21, wherein the liquid is a liquid that is non-corrosive to any material of the barrier or contact surface.

24. The device of aspect 21, wherein the liquid at least generally consists of turpentine, kerosene, or WD-40® or its equivalent.

25. The device of any one of aspects 1-24, wherein the device comprises pump(s) that can selectively drive dispensation of liquid into the chamber.

26. The device of aspect 25, wherein the one or more pumps comprise one or more rotary pumps.

27. The device of aspect 25 or aspect 26, wherein the energy to operate the one or more pumps is at least about 75-100% on average generated by the operation of the device.

28. The device of any one of aspects 25-27, wherein the device comprises one or more temperature sensors that detect the temperature differential in one or more parts of the device and a controller that receives inputs from the one or more temperature sensors and that controls the operation of the one or more pumps based upon such inputs.

29. The device of aspect 28, wherein the one or more temperature sensors comprise one or more thermocouples.

30. The device of any one of aspects 1-29, wherein the device is configured so as in operation there is a detectable gap in time (dispensation gap) between completion of dispensation of a first temperature modification liquid and the start of dispensation of a second temperature modification liquid during generally all or all strokes of the MC during regular operation.

31. The device of aspect 30, wherein the dispensation gap is created by operation of a dispensation-gap-generating mechanical component.

32. The device of aspect 30, wherein the dispensation gap is determined by a computer algorithm based on data received from one or more sensors or based on internally calculated parameters such as, for example, parameters based in time calculations and optionally comprises a period of time between the completion of a stroke length by movable component and dispensation of a temperature modification liquid.

33. The device of any one of aspects 1-32, wherein the pressure of the gas is sufficiently high so as to cause any heating or cooling of the gas caused by the barrier to be less than about 1% of the average gas temperature in the chamber at any given time during regular operation.

34. The device of any one of aspects 1-33, wherein about 40% or less of the energy generated by the device is used in dispersing liquid, pumping liquid, or both.

35. The device of aspect 34, wherein less than about 30% of the energy generated by the device is used in dispersing liquid, pumping liquid, or both.

36. The device of any one of aspects 1-35, wherein the device is re-pressurized, on average, no more than once every two years.

37. The device of any one of aspects 1-36, wherein the device comprises a system that (a) automatically stops pumping liquid to the dispensing component when the temperature difference between the first portion and second portion falls below a predetermined threshold, and (b) automatically begins pumping liquid to the dispensing component when the temperature difference between the first portion and second portion exceeds a predetermined threshold.

38. The device of any one of aspects 1-37, wherein the liquid is dispensed through one or more nozzles in the dispensing component capable of forming a mist composed of droplets of the liquid having a volume median diameter (VMD) of between about 25 μm and about 150 μm.

39. The device of aspect 38, wherein the one or more nozzles form a mist having a volume median diameter (VMD) of about 40-about 80 μm.

40. The device of any of aspects 38-39, wherein the mist has a DV0.9 value of about 70 μm.

41. The device of any one of aspects 1-40, wherein the dispensing component comprises at least 2, optionally at least 3, optionally at least 5, and optionally least 10 nozzles, and optionally wherein the nozzles receive liquid from a single access point.

42. The device of aspect 41, wherein the dispensing component comprises a manifold (e.g., a "tree") of about 5-about 300 dispensers (e.g., nozzles) used to dispense liquid into the pressurized gas.

43. The device of aspect 42, wherein the manifold (e.g., "tree") is positioned such that the dispensers (e.g., "nozzles") are oriented in an upward direction such that a minimum force is required to dispense liquid.

44. The device of any one of aspects 42 or 43, wherein the manifold is capable of dispensing a liquid as a mist that fills at least about 50-90% of the volume of the internal void space into which it is dispensed with the dispensed mist.

45. The device of any one of aspects 42-44, wherein the manifold is capable of dispensing a liquid as a mist that fills at least about 50-about 75% of the volume of the portion of chamber of the housing on one side of the movable component into which it is dispensed with the dispensed mist.

46. The device of any one of aspects 1-45, wherein in regular operation the liquid is dispensed in sufficient volume, with a sufficient surface area, such that when a temperature difference of at least 3 degrees C., at least 4 degrees C., or at least 5 degrees C. exists between the first and second portions, each actuation of the dispensing component causes the movable component to move within about 0.25 seconds, within about 0.15 seconds, or within about 0.1 seconds of the liquid being dispensed.

47. The device of any one of aspects 1-46, wherein the system lacks any displacer unit.

48. The device of any one of aspects 1-47, wherein the gas is an inert gas and the specific heat of the gas (Cp, Cv, or both) is greater than air.

49. The device of any one of aspects 1-48, wherein the movable component is capable of completing at least about 250 strokes per minute when the device is in regular operation.

50. The device of aspect 49, wherein the movable component is capable of completing at least about 1000 strokes per minute in peak operation.

51. The device of any one of aspects 1-50, wherein the movable component comprises a safety component which limits the maximum stroke length of the movable component and prevents the movable component from traveling beyond the pre-defined maximum stroke length of the movable component.

52. The device of aspect 51, wherein the safety component is adapted to connect the movable component to a system component located outside of the cylinder.

53. The device of any one of aspects 1-52, wherein the safety component is comprised of a material which is non-water corrosive and is made of a material comprising at yield strength of at least about 60,000 psi, a tensile strength of at least about 75,000 psi, or both a yield strength of at least about 60,000 psi and a tensile strength of at least about 75,000 psi.

54. The device of any one of aspects 1-53, wherein the movement of the movable component triggers the operation of the fluid switch, either directly or indirectly, such that sufficient movement of the movable component causes the fluid switch to alternatingly dispense liquid from the first portion and second portion to the dispensing component.

55. The device of any of aspects 1-54, wherein the contact surface of the MC has no physical connection to any other part of the system.

56. The device of any one of aspects 1-55, wherein the device lacks an active cooling system, other than the liquid, such that any cooling that occurs within the system takes place only by the dispensing of the liquid.

57. The device of any one of aspects 1-56, wherein the diameter of the movable component and the chamber differ by no more than 0.1%.

58. The device of any one of aspects 1-57, wherein the diameter of the movable component is substantially identical throughout most of the movable component, generally all of the movable component, or at least substantially all of the movable component.

59. The device of any one of aspects 1-58, wherein the device does not comprise any friction reduction components (e.g., rollers) between the movable component and the chamber; the movable component is not bound by wires; or both.

60. The device of any one of aspects 1-59, wherein the device produces at least three times the amount of energy it consumes in operation when the temperature of the pressurized gas modified by the temperature modulation system is changed by at least 10 degrees C. upon each alternating dispensation of liquid from a first portion having a first temperature and a second portion having a second temperature.

61. The device of aspect 60, wherein the device produces at least 50 times the amount of energy it consumes in operation when the temperature of the pressurized gas modified by the temperature modulation system is changed by at least 10 degrees C. upon each alternating dispensation of liquid from a first portion having a first temperature and a second portion having a second temperature.

62. The device of aspect 61, wherein the device produces at least 100 times the amount of energy it consumes in operation when the temperature of the pressurized gas modified by the temperature modulation system is changed by at least 10 degrees C. upon each alternating dispensation of liquid from a first portion having a first temperature and a second portion having a second temperature.

63. The device of any one of aspects 1-62, wherein the liquid from the first portion and the second portion are dispersed through different parts of the dispensing system at different times during regular operation.

64. The device of any of aspects 1-63, wherein liquid from the $1^{st}$ portion is dispensed separately from the dispensation of liquid from the $2^{nd}$ portion.

65. The device of any one of aspects 1-64, wherein (a) the portion of the movable component within the chamber consists of or consists essentially of a single component with a uniform composition, (b) the movable component has no subcomponents that move independently of one another, or (c) the portion of the movable component in the chamber consists of or consists essentially of a single component with a uniform composition and has no subcomponents that move independently of one another.

66. The device of any one of aspects 1-65, wherein the housing is stationary in operation.

67. A selectively openable, extended operation system for transforming temperature differences into work comprising (a) a device according to any one of aspects 1-66, (b) one or more secondary components separate from the device of (a) comprising a liquid conducting system capable of holding and conducting a liquid comprising (i) a first portion in contact with a first temperature input, and (ii) a second portion in contact with a second temperature input, and (c) at least one connection element capable of connecting one or more secondary components of (b) to a connection element of the device of (a).

68. The system of aspect 67, wherein the 1 secondary components of the system comprises a power-generating device that receives energy from the device & uses received energy to generate electricity.

69. The system of aspect 67, where the system is capable of receiving & relaying electricity generated by the device, & optionally comprises a secondary component that generates electricity from the device's work 70. The system of any one of aspects 67-69, wherein the system comprises (a) an automated control unit; (b) at least one automated control; (c) at least one data processor, or (d) a combination of any or all thereof, such that at least one component, action, function, process, or result of the system or system operation can be monitored; at least one component, action, function, or process of the system can be controlled without human intervention; any collection of collected data resulting from monitoring any at least two or more of a component, action, function, process, or result from the system or system operation can be processed into monitorable, actionable, or monitorable or actionable data; or any combination thereof.

71. The system of aspect 70, wherein the movable component of the device is coupled with a power-generating system, such that the operation of the device generates electrical energy.

72. The system of any one of aspects 67-71, wherein the system comprises a switch for changing the connection between the dispensers of the device and the liquid conducting system, such that a component of the device receiving the first portion of the liquid from the liquid conducting system is switched to receiving the second portion of the liquid from the liquid conducting system and a component of the device receiving the second portion of the liquid from the liquid conducting system is switched to receiving the first portion of the liquid from the liquid conducting system.

73. The system of aspect 72, wherein the switch is a valve located between the liquid conducting system and device.

74. The system of any one of aspect 72 or aspect 73, wherein the switch allows the system to be operable when the relative temperatures of the first and second portions input reverse such that the first warmer of the two portions becomes the cooler of the two portions and the first cooler of the two becomes the warmer of the two portions.

75. The system of any one of aspects 67-74, wherein the system has an energy production capacity of at least 10 kW.

76. The system of any one of aspects 67-75, wherein the average energy output of the system is at least 7.5 kWh.

77. The system of any one of aspects 75 or 76, wherein the system is able to generate the average energy output whenever there is a temperature differential of about 5° C. or more between the first temperature input in contact with the first portion of liquid of the liquid conducting system and the second temperature input in contact with the second portion of liquid of the liquid conducting system, or between the liquid dispensed from the one or more dispensers of the device in alternating fashion.

78. The system of aspect 77, wherein the system is able to generate the average energy output whenever there is a temperature differential of about 1 degree C. or more between the first temperature input in contact with the first portion of liquid of the liquid conducting system and the second temperature input in contact with the second portion of liquid of the liquid conducting system, or between the liquid dispensed from the one or more dispensers of the primary device in alternating fashion.

79. The system of any one of aspects 67-78, wherein less than 10% of the energy generated by the system is used in dispersing the liquid.

80. The system of any one of aspects 67-79, wherein the system is re-pressurized no more than once per month on average during operation.

81. The system of any one of aspects 67-80, wherein the difference in temperature between the first portion and second portion of the liquid in the liquid conducting system arises by exposing the first portion to the first temperature input and exposing the second portion to the second temperature input, wherein either or both of the first and second temperature inputs are an environmental condition or waste stream.

82. The system of aspect 81, wherein the system is on average operable at least 70% of each day.

83. The system of any one of aspects 67-82, wherein the difference in temperature between the first portion and second portion arises due to at least one of the first portion or second portion being exposed to a temperature input which is a waste heat stream.

84. The system of any one of aspects 67-83, wherein the system is capable of being connected with one or more additional systems having the characteristics described in aspects 67-83, or to a power generating system unrelated to the systems described herein (for example a solar production system or a wind-power production system or a hybrid engine of a vehicle) so as to expand the total amount of power production.

85. A method of transforming a temperature differential into work comprising: (a) providing (i) a liquid held within a closed system, (ii) an enclosed movable component, and (iii) a pressurized gas held within the closed system divided into a first and a second volume separated by the movable component such that the movable component partially defines two void spaces each having a length that is at least 7.5% of the length of each of the first and second volumes; (b) exposing one portion of the liquid within the closed system to a first condition having a first temperature and a second portion of the liquid within the closed system to a second condition having a second temperature to cause a first portion of the liquid to have a first temperature and a second portion of the liquid to have a second temperature; (c) establishing a closed system pressure before regular operation such that the pressure of the liquid having a first temperature and a second temperature is substantially the same as that of the pressurized gas; and (d) causing a first portion of the liquid and a second portion of the liquid to contact at least a first volume of the pressurized gas in alternating fashion in sprayed droplet form such that a difference in temperature between the first volume of gas and the second volume of gas is created, causing a pressure differential on opposing sides of the movable component, and hence causing the movable component to move, wherein the system maintains operability if the first and second conditions change such that warmer of the two conditions becomes the colder of the two conditions and the colder of the two conditions becomes the warmer of the two conditions.

86. The method of aspect 85, wherein the method can continually produce power when the temperature differential between the first condition and the second condition is as low as 10 degrees C.

87. The method of aspect 86, wherein the method can continually produce power when the temperature differential between the first condition and the second condition is as low as 5 degrees C.

88. The method of aspect 87, wherein the method can continually produce power when the temperature differential between the first condition and the second condition is as low as 1 degree C.

89. The method of any one of aspects 85-88, wherein the first condition and second condition are environmental conditions.

90. The method of aspect 89, wherein one of the $1^{st}$ & 2nd conditions is a body of water and at least one of the $1^{st}$ & 2nd conditions is air.

91. The method of any one of aspects 85-90, wherein at least one of the first and second conditions is a mechanical or industrial waste stream.

92. The method of aspect 91, wherein both the $1^{st}$ & 2nd conditions are waste streams.

93. The method of any of aspects 85-92, wherein a 1st portion of the liquid and a second portion of the liquid contact a single volume of pressurized gas in alternating sequence on the same side of the MC.

94. The method of any one of aspects 85-93, wherein the pressurization of the pressurized gas occurs upon system start up and wherein re-pressurization of the gas must occur no more than the earlier of a) the lifetime of the first expiring system seal (e.g., about 2 years), or b) a point in time wherein the system loses at least 5% of its pressure when the system is in continual operation.

95. The method of any one of aspects 85-94, wherein the method further comprises exposing one portion of the liquid to at least a first volume of the pressurized gas upon failure of the movable component to move a minimum distance (minimum stroke length), failure of the method to produce a minimum amount of work, or both failure of the movable component to move a minimum distance and failure of the method to produce a minimum amount of work, such that the movable component is forced to move a minimum distance, the method resumes production of a minimum amount of work, or both the movable component is forced to move a minimum distance and the method resumes production of a minimum amount of work.

96. The method of aspect 95, wherein the exposure of one part of the liquid to at least a first volume of the pressurized gas takes place in an automated fashion, without human intervention, when minimum stroke length and power output parameters fail to be met.

97. The method of any one of aspects 85-96, wherein the method is capable of producing at least 10 kW of energy.

98. The method of any one of aspects 85-97, wherein the average energy output produced by the method is at least 7.5 kWh.

99. The method of any one of aspects 85-98, wherein the method is capable of continuously producing work when the temperature of the first and second conditions reverse, such that the once warmer of the two conditions becomes the cooler of the two conditions and the once cooler of the two conditions becomes the warmer of the two conditions.

100. The method of any one of aspects 85-99, wherein the liquid makes contact with the pressurized gas by being dispensed as a mist into the pressurized gas through one or more dispensers capable of converting the media from a fluid liquid into a liquid mist, the mist having a Volume Median Diameter (VMD) droplet size of between about 25 μm and about 150 μm.

101. The method of aspect 100, wherein the liquid is dispensed as a mist into the pressurized first gas through one or more dispensers capable of converting the liquid from a fluid liquid into a mist having a Volume Median Diameter (VMD) droplet size of between about 30 μm and about 90 μm.

102. The method of aspect 101, wherein the liquid is dispensed as a mist into the pressurized first gas through one or more dispensers capable of converting the liquid from a fluid liquid into a mist having Volume Median Diameter (VMD) droplet size of about 40 μm and about 80 μm.

103. The method of any of aspects 100-102, wherein the droplet size has a DV0.9 value of about 70 μm.

104. The method of any one of aspect 100-103, wherein the droplets are dispensed in sufficient volume so as to affect a sufficient temperature change within the chamber to cause movement of the movable component in a direction opposite to the direction moved by the movable component after the previous mist dispensation.

105. The method of any one of aspects 85-104, wherein sufficient movement of the movable component in either a first or a second direction causes the dispensation of the liquid in the form of a mist into at least a first volume of the pressurized gas, the movement of the movable component in a first direction causing dispensation of the liquid having a first temperature and the movement of the movable component in a second direction causing dispensation of the liquid having a second temperature.

106. The method of aspect 105, wherein sufficient movement of the movable component is at least 5% of the maximum distance it could travel when the system is producing at least its average amount of power output (maximum stroke length).

107. The method of any one of aspects 85-104, wherein dispensation of the liquid is actuated by a mechanism not mechanically linked to the movement of the movable component.

108. The method of any one of aspects 85-107, wherein the method does not comprise a step of displacing a pressurized gas, a step of using stored energy to sustain the method, or a step of actively cooling a component or system partaking in the method to maintain operability.

109. The method of any one of aspects 85-108, wherein the method comprises applying a pump, such as a rotary pump, to the system, to initiate, maintain, or enhance the spraying of the droplets of liquid into the gas or to conduct liquid through the liquid conducting system.

110. The method of aspect 109, wherein the method comprises monitoring the temperature difference between the first volume of pressurized gas and second volume of pressurized gas and automatically pumping liquid in response to pre-programmed conditions.

111. The method of any of aspects 85-110, wherein flow of gas within the closed system in regular operation is substantially in the same orientation.

112. The method of any of aspects 85-111, wherein the method comprises converting the movement of the movable component into electrical energy.

113. The method of any one of aspects 85-112, wherein the method comprises using any one of the devices described in aspects 1-66.

114. The method of any one of aspects 85-113, wherein the method comprises using any one of the systems described in aspects 67-84.

115. An automated system for performing useful work comprising: (a) a device according to aspect 28, aspect 29, or a device according to any one of aspects 30-66 that incorporate the features of aspect 28 or aspect 29; and (b) an operation control component comprising an electronic control unit which comprises (1) at least one data collection unit that stores and executes instructions to receive primary and secondary temperatures from one or more sensor(s) of the device that correspond to the first temperature and second temperature at preprogrammed measurement intervals during an operation cycle comprising periods of device operation and intervening periods and sharing collected data with at least one data processing device; (2) means for relaying temperature information data from the data collection unit; (3) a processor unit comprising at least one unit capable of receiving the data relayed from the data collection unit and means for storing and executing instructions for determining the relationships between the difference in the primary and secondary temperatures and an intermittent off period threshold and executing instructions for initiating operation of the dispensing component to reinitiate the system after conditions are such that the instructions indicate that system re-initiation should occur.

116. The system of aspect 115, wherein the processor performs the activities of aspect 37 based on its analysis of the data and the instructions.

117. The system of aspect 115 or aspect 116, wherein the device comprises a fluid switch according to aspect 10, the fluid switch being under control of the processor unit and the processor unit storing and executing instructions for operating the fluid switch.

118. The system of aspect 117, wherein the device comprises the features of aspect 115.

119. The system of any one of aspects 115-118, wherein the processor executes the algorithm of aspect 32 and controls operation of components of the device to establish a dispensation gap.

120. The system of any one of aspects 115-119, wherein the data collection unit(s) of the system are integral components of the sensor(s).

121. The system of any one of aspects 115-120, wherein the processor unit is located remotely from the device (either at a short distance or far distance away).

122. The system of any one of aspects 115-121, wherein the device comprises a pressure sensor, means for relaying pressure sensor information to the processor, and the processor comprises instructions for evaluating device pressure against a standard to determine if pressure problems exist in the device.

123. The system of any one of aspects 115-122, wherein the device comprises means for measuring movement of the moveable component, means for relaying the movement measurement data to the processor, and the processor comprises instructions for evaluating the movement information to the expected movement of the moveable component based on the primary temperature and secondary temperature data.

124. The system of any one of aspects 115-123, wherein the processor comprises means for storing, retrieving, and further processing any of the data received in an operating cycle of the device.

125. The system of any one of aspects 115-124, wherein the system comprises a viewable user interface that allows a human operator to observe the status of one or more of the temperature, pressure, and movement monitored conditions of the device.

126. The system of aspect 125, where the user interface comprises an interactive interface component for receiving instructions from a user on changing one or more of the operating parameters of the device (e.g., amount of dispensed liquid, frequency of dispensed liquid, forced operation of pumps, dispensation gap(s), or combinations of any or all thereof).

127. A complex comprising a system according to any one of aspects 68-84 in which (a) the device or system comprises a power-generating device or component, (b) the complex comprises a secondary power source, (c) both the system and the secondary power source provide power to a powered apparatus, structure, or network, (d) the complex comprises an electronic sensor network which comprises (1) a first data collection unit that stores and executes instructions to receive primary and secondary temperatures from one or more sensor(s) of the device that correspond to the first temperature and second temperature at preprogrammed measurement intervals during an operation cycle comprising periods of device operation and intervening periods, (2) a second data collection unit that collects the available energy in the second power source, and (3) a third data collection unit that collects the anticipated energy demand of the apparatus, structure, or network; (e) the complex comprises means for relaying information signals from the first, second, and third data collection units; (f) the complex comprises an electronic programmable complex control unit that receives the information signals from the data collection units and stores and executes preprogrammed instructions for directing energy from the system or the second power source to the apparatus, structure, or network depending on the differences between the primary temperature and secondary temperature, the energy needs of the apparatus, structure, or network, and the amount of energy in the second power source.

128. The complex of aspect 127, wherein the complex comprises a viewable user interface that allows a human operator to observe the status of the primary temperature and secondary temperature, the energy level of the second power source, the anticipated energy need of the apparatus, structure, or network, or a combination thereof.

129. The complex of aspect 128, where the user interface comprises an interactive interface component for receiving instructions from a user on changing one or more of the operating parameters of the device (e.g., amount of dispensed liquid, frequency of dispensed liquid, forced operation of pumps, dispensation gap(s), or combinations of any or all thereof), changing sourcing of energy from the second power source, or a combination thereof.

130. A system for fabricating a low temperature differential energy device according to any one of aspects 1-66 comprising (a) entering a required work output for the device to be fabricated to a device design and fabrication processor comprising means for receiving inputs from a user and preprogrammed instructions for analyzing the inputs; (b) entering a series of inputs into the device design and fabrication processor comprising chamber length; anticipated first temperature; anticipated second temperature; anticipated first gas temperature generated by dispensing first temperature modified liquid into the chamber; anticipated second gas temperature generated by dispensing second temperature modified liquid into the chamber; anticipated chamber pressure; anticipated chamber diameter; and anticipated time between injections (anticipated dispensation gap); and directing the device design and fabrication processor to generate an estimated work output that the device is expected to produce based on the inputs; (c) entering constraints associated with the inputs; (d) directing the design and fabrication processor to adjust the variables associated with the inputs based on the constraints and ordering the modulation of variables based on either preprogrammed or inputted criteria to generate a device design anticipated to provide the required work output; and (e) causing the fabrication of one or more components of the device based on the calculated variables.

What is claimed is:

1. A device for transforming temperature differences into work comprising (a) a barrier component that is at least substantially impervious to unintentional fluid loss and that forms one or more chambers, the one or more chambers each comprising a void space having a dimension corresponding to the orientation of the movable component's movement and that is equal to at least 7.5% of the corresponding dimension of the chamber(s); (b) a movable component that comprises a contact surface and that is configured to move along a path having a stroke distance when acted on by a minimum force; (c) a pressurized gas contained in the one or more chambers and in contact with the contact surface; and (d) a temperature modulating system comprising (1) a liquid having a first portion and a second portion, (2) a dispensing component configured to separately dispense the first portion liquid and the second portion liquid into the one or more chambers in droplet form; and (3) a fluid switch that causes alternate dispensation of the first portion of liquid and the second portion of liquid, where in operation (I) the device is at least substantially closed with respect to the liquid and the gas; (II) each void space only comprises the gas or the gas and the liquid; (III) the first portion liquid is at a first temperature and the second portion liquid at a second, different temperature; (IV) the alternating dispensation of the first and second portions creates temperature differences in the one or more chambers that cause the movable component to repeatedly move back and forth across the stroke distance; and (V) the pressures of the gas and the liquid are sufficiently similar such that the pressure of the liquid and the gas vary by no more than 5%.

2. The device of claim 1, wherein each void space comprises a dimension that is equal to at least about 15% of the corresponding dimension of the one or more chambers.

3. The device of claim 2, wherein the movable component comprises only one contact surface and the dispensing component is oriented to dispense liquid on only one side of the contact surface.

4. The device of claim 3, wherein the device comprises two chambers, each chamber comprising a void space, and wherein in operation each chamber comprises pressurized gas and the liquid is dispensed into only one of the two chambers.

5. The device of claim 3, wherein in operation the dispensing component dispenses the liquid as a mist that fills at least about 50%-about 75% of the volume of the portion of the chamber in which the dispensing component is located.

6. The device of claim 5, wherein in operation there is a detectable gap in time between the completion of a first dispensation of first portion liquid and the start of a dispensation of second portion liquid.

7. The device of claim 6, wherein the length of time for the movable component to complete the stroke distance and the period of time between the completion of a first dispensation of first portion liquid and the start of dispensation of second portion liquid differ by no more than 5%.

8. The device of claim 5, wherein the liquid is dispensed as a mist having a droplet DV0.9 value of about 70 μm.

9. The device of claim 8, wherein the pressure in the chamber during most periods of operation is about 175-about 10,600 psi.

10. The device of claim 9, wherein the dispensing component comprises a plurality of dispensers oriented such that at least some amount of force is required to dispense the liquid.

11. The device of claim 8, wherein the liquid has (i) a viscosity of about 0.75 to about 3.5 centipoise at temperatures of about 295 to about 315 degrees Kelvin and atmospheric pressure; (ii) a specific heat of about 1.6 kJ/(kg K) to about 4.4 kJ/(kg K); (iii) a surface tension of about 20 to about 75 dynes/cm; (iv) a freezing point of approximately 208 K to about 275 K; (v) a boiling point of about 370 to about 575 K; or (vi) a combination of any or all of (i)-(v).

12. The device of claim 4, wherein the liquid has (i) a viscosity of about 1 to about 3.5 centipoise at temperatures about 295 to about 315 degrees Kelvin and atmospheric pressure; (ii) a specific heat of about 1.6 kJ/(kg K) to about 4.4 kJ/(kg K); (iii) a surface tension of about 20 to about 35 dynes/cm; (iv) a freezing point of approximately 208 K to about 235 K; (v) a boiling point of about 420-575 K; or (vi) a combination of any or all of (i)-(v).

13. The device of claim 12, wherein the liquid is at least primarily composed of one or more hydrocarbon compounds comprising a 4-30 carbon backbone.

14. The device of claim 8, wherein the device comprises an energy conversion component that converts work of the movable component into energy, and wherein the components and operating parameters of the device are such that the device has an energy production capacity of at least 10 kW, an average energy output of at least 7.5 kWh, or both.

15. The device of claim 14, wherein the device can generate an average energy output of 7.5 kWh whenever there is a temperature differential of about 1 degree C. or more between the first temperature and the second temperature.

16. The device of claim 8, wherein the device comprises one or more sensors that detect temperature in one or more parts of the device and the device further comprises or is operatively associated with (a) one or more pumps that can use stored or extraneous power to control flow of liquid through the device and (b) one or more preprogrammed electronic controller(s) that receive(s) inputs from the one or more temperature sensor(s), analyzes the inputs, and automatically controls the operation of the one or more pumps based upon such inputs.

17. The device of claim 16, wherein the electronic controller(s) control the timing of the dispensation of the first portion liquid and the second portion liquid according to a preprogrammed length of time.

18. The device of claim 6, wherein the gap in time between the completion of dispensation of first portion liquid and the start of dispensation of second portion liquid during at least most periods of operation is determined by a computer algorithm based on data received from one or more sensors that detect temperature or pressure in one or more parts of the device or based on programmed or calculated parameters.

19. The device of claim 5, wherein the device comprises or is operatively associated with a source switch which allows the system to be operable when the relative temperatures of the first and second portions reverse such that the first warmer of the two portions becomes the cooler of the two portions and the first cooler of the two becomes the warmer of the two portions.

20. The device of claim 19, wherein the source switch operates automatically in response to one or more preprogrammed conditions.

21. A device for transforming temperature differences into work comprising (a) a barrier component that is at least substantially impervious to unintentional fluid loss and that forms one or more chambers, the one or more chambers each comprising a void space having a dimension corresponding to the orientation of the movable component's movement and that is equal to at least 15% of the corresponding dimension of the chamber(s); (b) a movable component that comprises a single contact surface and that is configured to move along a path having a stroke distance when acted on by a minimum force; (c) a pressurized gas contained in the one or more chambers and in contact with the contact surface; and (d) a temperature modulating system comprising (1) a liquid having a first portion and a second portion, (2) a dispensing component configured to separately dispense the first portion liquid and the second portion liquid into one chamber on one side of the contact surface in droplet form; and (3) a fluid switch that causes alternate dispensation of the first portion of liquid and the second portion of liquid, where in operation (I) the device is at least substantially closed with respect to the liquid and the gas; (II) each void space only comprises the gas or the gas and the liquid; (III) the first portion liquid is at a first temperature and the second portion liquid at a second, different temperature; (IV) the alternating dispensation of the first and second portions creates temperature differences in the one or more chambers that cause the movable component to repeatedly move back and forth across the stroke distance; (V) the pressures of the gas and the liquid are sufficiently similar such that (i) dispensing the liquid takes up no more than 33% of the work produced by the movement of the movable component in a complete stroke, (ii) the pressure of the liquid and the gas vary by no more than 5%; or (iii) both (i) and (ii); and (VI) wherein in operation the dispensing component dispenses the liquid as a mist that fills at least about 50%-about 75% of the volume of the portion of the chamber in which the dispensing component is located.

22. The device of claim 21, wherein the device comprises two chambers, each chamber comprising a void space, and wherein in operation each chamber comprises pressurized gas and the liquid is dispensed into only one of the two chambers.

23. The device of claim 21, wherein in operation there is a detectable gap in time between the completion of a first dispensation of first portion liquid and the start of a dispensation of second portion liquid.

24. The device of claim 23, wherein the length of time for the movable component to complete the stroke distance and the period of time between the completion of a first dispensation of first portion liquid and the start of dispensation of second portion liquid differ by no more than 5%.

25. The device of claim 21, wherein the liquid is dispensed as a mist having a droplet DV0.9 value of about 70 μm.

26. The device of claim 25, wherein the pressure in the chamber during most periods of operation is about 175-about 10,600 psi.

27. The device of claim 26, wherein the dispensing component comprises a plurality of dispensers oriented such that at least some amount of force is required to dispense the liquid.

28. The device of claim 25, wherein the liquid has (i) a viscosity of about 0.75 to about 3.5 centipoise at temperatures of about 295 to about 315 degrees Kelvin and atmospheric pressure; (ii) a specific heat of about 1.6 kJ/(kg K) to about 4.4 kJ/(kg K); (iii) a surface tension of about 20 to about 75 dynes/cm; (iv) a freezing point of approximately 208 K to about 275 K; (v) a boiling point of about 370 to about 575 K; or (vi) a combination of any or all of (i)-(v).

29. The device of claim 22, wherein the liquid has (i) a viscosity of about 1 to about 3.5 centipoise at temperatures about 295 to about 315 degrees Kelvin and atmospheric pressure; (ii) a specific heat of about 1.6 kJ/(kg K) to about 4.4 kJ/(kg K); (iii) a surface tension of about 20 to about 35 dynes/cm; (iv) a freezing point of approximately 208 K to about 235 K; (v) a boiling point of about 420-575 K; or (vi) a combination of any or all of (i)-(v).

30. The device of claim 29, wherein the liquid is at least primarily composed of one or more hydrocarbon compounds comprising a 4-30 carbon backbone.

31. The device of claim 25, wherein the device comprises an energy conversion component that converts work of the movable component into energy, and wherein the components and operating parameters of the device are such that the device has an energy production capacity of at least 10 kW, an average energy output of at least 7.5 kWh, or both.

32. The device of claim 31, wherein the device can generate an average energy output of 7.5 kWh whenever there is a temperature differential of about 1 degree C. or more between the first temperature and the second temperature.

33. The device of claim 25, wherein the device comprises one or more sensors that detect temperature in one or more parts of the device and the device further comprises or is operatively associated with (a) one or more pumps that can use stored or extraneous power to control flow of liquid through the device and (b) one or more preprogrammed electronic controller(s) that receive(s) inputs from the one or more temperature sensor(s), analyzes the inputs, and automatically controls the operation of the one or more pumps based upon such inputs.

34. The device of claim 33, wherein the electronic controller(s) control the timing of the dispensation of the first portion liquid and the second portion liquid according to a preprogrammed length of time.

35. The device of claim 23, wherein the gap in time between the completion of dispensation of first portion liquid and the start of dispensation of second portion liquid during at least most periods of operation is determined by a computer algorithm based on data received from one or more sensors that detect temperature or pressure in one or more parts of the device or based on programmed or calculated parameters.

36. The device of claim 21, wherein the device comprises or is operatively associated with a source switch which allows the system to be operable when the relative temperatures of the first and second portions reverse such that the first warmer of the two portions becomes the cooler of the two portions and the first cooler of the two becomes the warmer of the two portions.

37. The device of claim 36, wherein the source switch operates automatically in response to one or more preprogrammed conditions.

38. A device for transforming temperature differences into work comprising (a) a barrier component that is at least substantially impervious to unintentional fluid loss and that forms two chambers each comprising a void space having a dimension corresponding to the orientation of the movable component's movement and that is equal to at least 15% of the corresponding dimension of the chamber(s); (b) a movable component that comprises a single contact surface and that is configured to move along a path having a stroke distance when acted on by a minimum force; (c) a pressurized gas contained in each of the two chambers and in contact with the contact surface; and (d) a temperature modulating system comprising (1) a liquid having a first portion and a second portion, (2) a dispensing component configured to separately dispense the first portion liquid and the second portion liquid into one chamber on one side of the contact surface in droplet form; and (3) a fluid switch that causes alternate dispensation of the first portion of liquid and the second portion of liquid, where in operation (I) the device is at least substantially closed with respect to the liquid and the gas; (II) each void space only comprises the gas or the gas and the liquid; (III) the first portion liquid is at a first temperature and the second portion liquid at a second, different temperature; (IV) the alternating dispensation of the first and second portions creates temperature differences in the one or more chambers that cause the movable component to repeatedly move back and forth across the stroke distance; (V) the pressures of the gas and the liquid are sufficiently similar such that (i) dispensing the liquid takes up no more than 33% of the work produced by the movement of the movable component in a complete stroke, (ii) the pressure of the liquid and the gas vary by no more than 5%; or (iii) both (i) and (ii); and (VI) the liquid has (i) a viscosity of about 1 to about 3.5 centipoise at temperatures about 295 to about 315 degrees Kelvin and atmospheric pressure; (ii) a specific heat of about 1.6 kJ/(kg K) to about 4.4 kJ/(kg K); (iii) a surface tension of about 20 to about 35 dynes/cm; (iv) a freezing point of approximately 208 K to about 235 K; (v) a boiling point of about 420-575 K; or (vi) a combination of any or all of (i)-(v).

39. The device of claim 38, wherein the liquid is at least primarily composed of one or more hydrocarbon compounds comprising a 4-30 carbon backbone.

* * * * *